US007106270B2

(12) United States Patent
Iigusa et al.

(10) Patent No.: US 7,106,270 B2
(45) Date of Patent: Sep. 12, 2006

(54) ARRAY ANTENNA CAPABLE OF CONTROLLING ANTENNA CHARACTERISTIC

(75) Inventors: Kyoichi Iigusa, Kyoto (JP); Takuma Sawaya, Kyoto (JP); Takashi Ohira, Kyoto (JP); Hiroki Tanaka, Kyoto (JP)

(73) Assignee: Advanced Telecommunications Research Institute International, Kyoto (JP)

( * ) Notice: Subject to any disclaimer, the term of this patent is extended or adjusted under 35 U.S.C. 154(b) by 59 days.

(21) Appl. No.: 11/046,924

(22) Filed: Feb. 1, 2005

(65) Prior Publication Data

US 2005/0206573 A1 Sep. 22, 2005

(30) Foreign Application Priority Data

Feb. 3, 2004 (JP) ..... 2004-026644
Feb. 24, 2004 (JP) ..... 2004-047636
Jun. 25, 2004 (JP) ..... 2004-188268

(51) Int. Cl.
*H01Q 19/00* (2006.01)
*H01Q 9/00* (2006.01)

(52) U.S. Cl. ..... 343/833; 343/834; 343/750

(58) Field of Classification Search ..... 343/833, 343/834, 749, 750, 853
See application file for complete search history.

(56) References Cited

U.S. PATENT DOCUMENTS 6,337,668 B1 * 1/2002 Ito et al. ..... 343/833
6,606,057 B1 * 8/2003 Chiang et al. ..... 342/374
6,864,852 B1 * 3/2005 Chiang et al. ..... 343/817
6,894,653 B1 * 5/2005 Chiang et al. ..... 343/757

FOREIGN PATENT DOCUMENTS

JP 2002-261532 9/2002

OTHER PUBLICATIONS

Yamamoto, M., et al., "Print Slot Yagi-Uda Array Antenna with Through-Hole Cavity", Communications Society Conference 2001, B-1-159, IEICE, p. 165.
Akiyama, A., et al., "A Basic Study of Radial Line Slot Antenna for 60GHz Band Wireless LAN", Proceedings of the 1997 IEICE General Conference, B-1-85.
Itakura, A., et al., "A Study on Double-Resonance H-Type Slot Antenna", The IEICE Transactions on Communications (B), vol. J86-B, No. 12 (Dec. 2003) pp. 2533-2542.

* cited by examiner

*Primary Examiner*—Hoang V. Nguyen
(74) *Attorney, Agent, or Firm*—McDermott Will & Emery LLP

(57) ABSTRACT

An array antenna includes a feeder element, a parasitic element implemented by a slot line, a variable capacitance element, and a directivity switching unit. The variable capacitance element is loaded in the slot line. The directivity switching unit supplies a control voltage to the variable capacitance element in order to vary the capacitance, and switches directivity of the array antenna.

20 Claims, 36 Drawing Sheets

FRONT SURFACE

SIDE SURFACE

SIDE SURFACE

FRONT SURFACE

SIDE SURFACE

SIDE SURFACE

ARRAY ANTENNA CAPABLE OF CONTROLLING ANTENNA CHARACTERISTIC

BACKGROUND OF THE INVENTION

1. Field of the Invention

The present invention relates to an array antenna capable of controlling an antenna characteristic.

2. Description of the Background Art

A conventional array antenna includes a cavity resonator, a feeder element, and a plurality of slot lines. The cavity resonator has a substantially cylindrical shape and is made of metal. The feeder element is provided in the cavity resonator. The plurality of slot lines are arranged substantially in parallel to one another on a cylinder end surface of the cavity resonator in a direction of a rotation axis of the cylindrical shape.

An electromagnetic wave emitted from the feeder element by feeding electric power thereto is emitted outside the cavity resonator through the plurality of slot lines arranged on the cylinder end surface (see "Print Slot Yagi-Uda Antenna with Through-hole Cavity," Manabu Yamamoto, Naoki Kobayashi, and Kiyohiko Itoh, Communications Society Conference 2001, The Institute of Electronics, Information and Communication Engineers, p 165).

In addition, a radial line slot antenna is known as a conventional array antenna (see "A Basic Study of Radial Line Slot Antenna for 60 GHz Band Wireless LAN," Akira Akiyama, Tetsuya Yamamoto, Makoto Ando, Naohisa Goto, and Eriko Takeda, Proceedings of the 1997 IEICE General Conference, B-1-85). The radial line slot antenna is a planar array antenna using a radial line as a waveguide. The terminal end portion is short-circuited, and provided with matching slots for canceling reflection. Fed from a central portion, electric power propagates through radial waveguides.

When slot elements are arranged concentrically in the radial line slot antenna, a conical beam is emitted when the element is excited in axially symmetrical manner. Meanwhile, when the element is excited in a rotating electromagnetic field mode, a beam in a front direction can be emitted.

Moreover, an H-type slot antenna including slots has conventionally been known as an antenna that can be mounted on a notebook-type PC (personal computer), a PDA (personal digital assistant) or the like (see "A Study on Double Resonance H-Type Slot Antenna," Akira Itakura, Yoshinobu Okano and Minoru Abe, The IEICE Transactions on Communications (B), Vol. J86-B, No. 12 (December 2003) pp. 2533–2542). The H-type slot antenna is implemented by a slot formed in an H-shape, and it can be adapted for use in both 2.4 GHz band and 5.2 GHz band. The H-type slot antenna is mounted on a surface of a notebook-type PC. In this manner, the H-type slot antenna can be arranged in the vicinity of metal.

Furthermore, an antenna apparatus including one feeder element and six parasitic elements has conventionally been known as an antenna allowing electrical switching of directivity (see Japanese Patent Laying-Open No. 2002-261532).

In this antenna, the feeder element has one end fixed to a dielectric support substrate and arranged substantially perpendicular to the dielectric support substrate. Six parasitic elements are divided into three groups of two parasitic elements, and respective groups are provided on three printed boards. Three printed boards are arranged substantially perpendicular to the dielectric support substrate.

Here, three printed boards are arranged on the dielectric support substrate such that six parasitic elements are arranged around the feeder element located in the center and on a perimeter of a circle having a prescribed radius.

As described above, a variety of antennas have conventionally been known.

SUMMARY OF THE INVENTION

In the conventional array antenna having a slot line on the surface of the cavity resonator, a characteristic of an antenna can be controlled based on a shape, a dimension, and arrangement of the slot line formed on the cavity resonator. On the other hand, once the slot line is formed in the cavity resonator, modification of a shape, a dimension, and arrangement thereof is no longer allowed, resulting in failure in controlling the antenna characteristic.

In addition, the conventional slot antenna has sensitivity in substantially all directions, without attaining directivity.

Moreover, in the conventional antenna allowing switching of directivity, the feeder element and the parasitic element are arranged substantially perpendicular to the dielectric support substrate. Accordingly, the antenna is large in size.

From the foregoing, an object of the present invention is to provide an array antenna including a slot line, capable of controlling an antenna characteristic.

Another object of the present invention is to provide an array antenna having sensitivity even when it is located near a conductor and allowing electrical switching of its directivity.

Yet another object of the present invention is to provide a compact array antenna allowing electrical switching of the directivity.

According to the present invention, an array antenna allows electrical switching of directivity. The array antenna includes a feeder element, a parasitic element, and a directivity switching unit. The parasitic element has a variable capacitance element loaded, and is implemented by a slot line. The directivity switching unit varies a capacitance of the variable capacitance element and switches the directivity of the array antenna.

Preferably, the array antenna further includes a cavity conductor. The cavity conductor attains a function as a resonator or a waveguide. The feeder element is provided inside the cavity conductor. The parasitic element is implemented by a plurality of slot lines having at least one variable capacitance element loaded, and provided on a surface of the cavity conductor. The directivity switching unit varies a capacitance of at least one variable capacitance element.

Preferably, the cavity conductor has a substantially cylindrical shape. The plurality of slot lines are provided substantially in parallel to one another on an outer circumferential surface of the cavity conductor.

Preferably, the feeder element has a spiral shape or a bar shape formed in a direction of a rotation axis of the cylindrical shape.

Preferably, the feeder element includes a first feeder element and at least one second feeder element. The first feeder element is provided in a direction of the rotation axis of the cylindrical shape. At least one second feeder element is provided in a radial direction of the cylindrical shape.

Preferably, the cavity conductor has a substantially cylindrical shape. The plurality of slot lines are arranged substantially in parallel to one another or substantially radially around the rotation axis of the cylindrical shape on at least one of two cylinder end surfaces provided perpendicular to the rotation axis in the direction of the rotation axis of the cylindrical shape.

Preferably, the parasitic element is implemented by at least one slot line having a variable capacitance element loaded, and provided on one main surface of a substrate member. The feeder element has one end provided in the substrate member at a prescribed angle with respect to a normal direction of the one main surface. The directivity switching unit varies at least one capacitance of the variable capacitance element so as to switch the directivity.

Preferably, the feeder element has one end fixed to the substrate member.

Preferably, the feeder element is retractable in its longitudinal direction.

Preferably, the feeder element can pivot around one end.

Preferably, the feeder element can pivot around one end and is retractable in its longitudinal direction.

Preferably, the feeder element is implemented by a first slot line formed on one main surface of a dielectric substrate. The parasitic element is implemented by a second slot line formed on one main surface of the dielectric substrate and having the variable capacitance element loaded.

Preferably, the first and second slot lines are arranged substantially in parallel to each other.

Preferably, the first and second slot lines are arranged at a prescribed angle with respect to each other.

Preferably, the parasitic element is implemented by a plurality of parasitic elements. A directivity switching unit varies at least one capacitance of a plurality of variable capacitance elements loaded in the plurality of parasitic elements, so as to control directivity.

Preferably, an equal number of the plurality of parasitic elements are arranged on opposing sides of the feeder element, respectively.

Preferably, the plurality of parasitic elements are arranged symmetrically around the feeder element.

Preferably, the array antenna further includes another parasitic element, which is implemented by a third slot line formed on one main surface of the dielectric substrate without having a variable capacitance element loaded.

In the array antenna according to the present invention, the parasitic element implemented by the slot line is excited/non-excited by variation of a capacitance of the variable capacitance element carried out by the directivity switching unit. The radio wave emitted from the feeder element is emitted from the array antenna through the excited slot line.

Therefore, according to the present invention, directivity can be switched in the array antenna including the slot line.

In addition, in the array antenna according to the present invention, the slot line formed on the surface of the cavity conductor is excited/non-excited by controlling the capacitance of the loaded variable capacitance element. The radio wave emitted from the feeder element is emitted from the cavity conductor through the excited slot line.

Therefore, according to the present invention, the antenna characteristic of the array antenna can be controlled by controlling the capacitance of the variable capacitance element.

Moreover, in the array antenna according to the present invention, the feeder element and the first parasitic element are implemented by slots. The first parasitic element has the variable capacitance element loaded. The directivity control unit varies the capacitance of the variable capacitance element loaded in the first parasitic element, so as to control the directivity of the array antenna.

Therefore, according to the present invention, the array antenna allowing electrical switching of directivity can operate even in the vicinity of a conductor such as metal.

Furthermore, in the array antenna according to the present invention, at least one parasitic element is arranged on one main surface of a substrate member, and the feeder element is arranged at a prescribed angle with respect to a normal direction of one main surface of the substrate member. The directivity switching unit switches the directivity of the array antenna by varying at least one capacitance of the variable capacitance element loaded in at least one parasitic element.

Therefore, according to the present invention, the array antenna allowing electrical switching of directivity can be compact.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
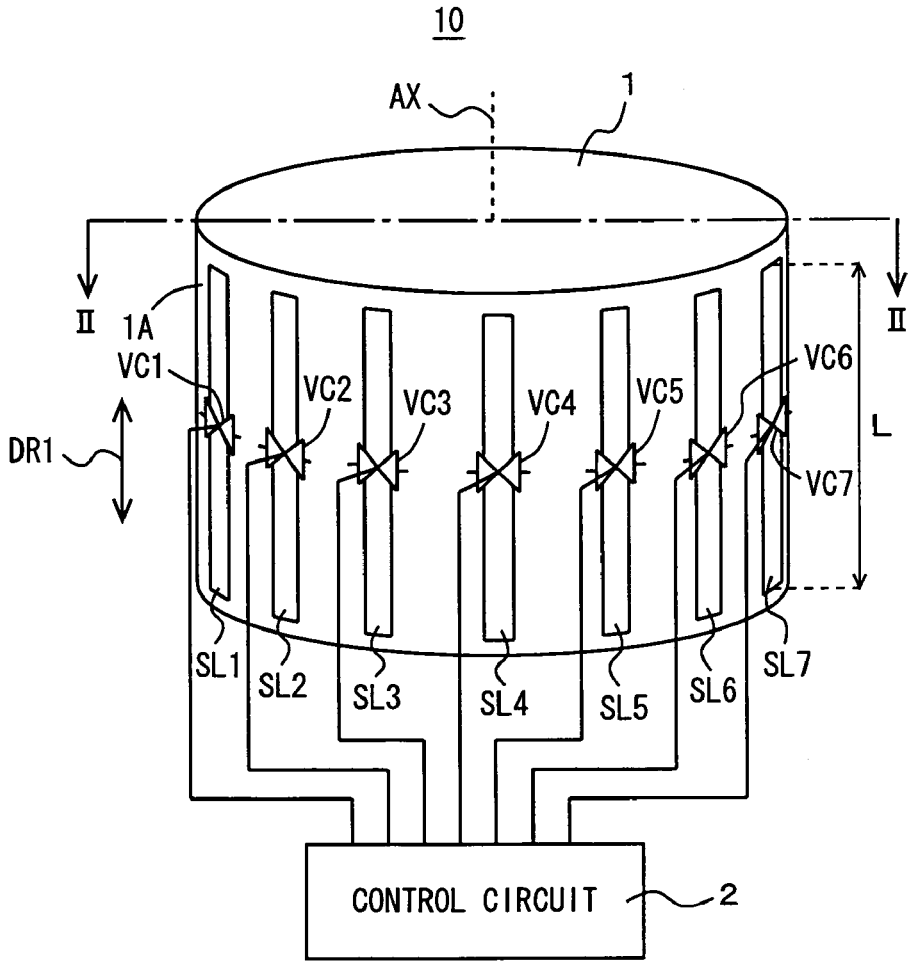
FIG. 1 is a schematic diagram of an array antenna in Embodiment 1.

In the following, embodiments of the present invention will be described in detail with reference to the figures. It is noted that the same reference characters refer to the same or corresponding components in the figures.

Embodiment 1

FIG. 1 is a schematic diagram of an array antenna in Embodiment 1. An array antenna 10 in Embodiment 1 includes a cavity conductor 1, a plurality of slot lines SL1 to SL7, variable capacitance elements VC1 to VC7, and a control circuit 2.

Though seven slot lines SL1 to SL7 and seven variable capacitance elements VC1 to VC7 are shown in FIG. 1, in actual, array antenna 10 includes twelve slot lines SL1 to SL12 and twelve variable capacitance elements VC1 to VC12.

Cavity conductor 1 has a substantially cylindrical shape and is made of copper (Cu). Cavity conductor 1 attains a function as a resonator or a waveguide. Each of slot lines SL1 to SL7 is provided on an outer circumferential surface 1A of cavity conductor 1 along a rotation axis direction DR1. Each of slot lines SL1 to SL7 has a length L, which is comparable to approximately $\lambda/2$ when a radio wave transmitted/received by array antenna 10 has a wavelength $\lambda$.

Variable capacitance elements VC1 to VC7 are loaded in slot lines SL1 to SL7, respectively.

Control circuit 2 supplies a control voltage CTLV to each of variable capacitance elements VC1 to VC7, so as to control the antenna characteristic of array antenna 10.

Figure 2:
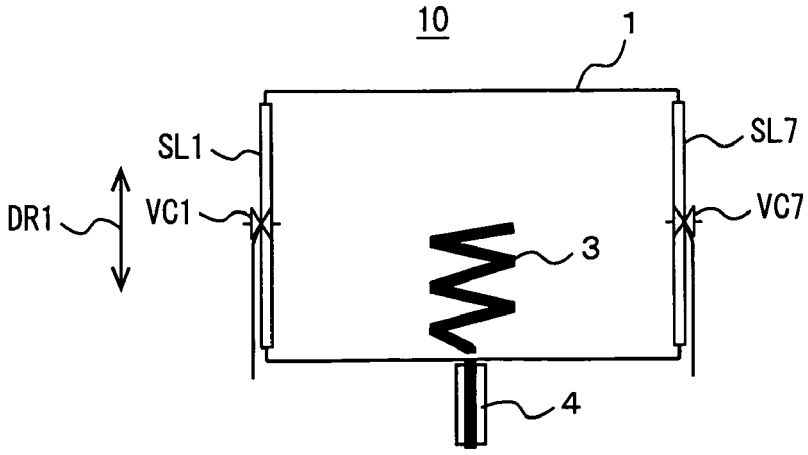
FIG. 2 is a cross-sectional view of the array antenna along the line II—II shown in FIG. 1.

FIG. 2 is a cross-sectional view of array antenna 10 along the line II—II shown in FIG. 1. Array antenna 10 further includes a feeder element 3. Feeder element 3 is provided inside cavity conductor 1, and formed in a spiral shape in the rotation axis direction DR1. Feeder element 3 is connected to a feeder circuit (not shown) through a coaxial cable 4.

Figure 3:
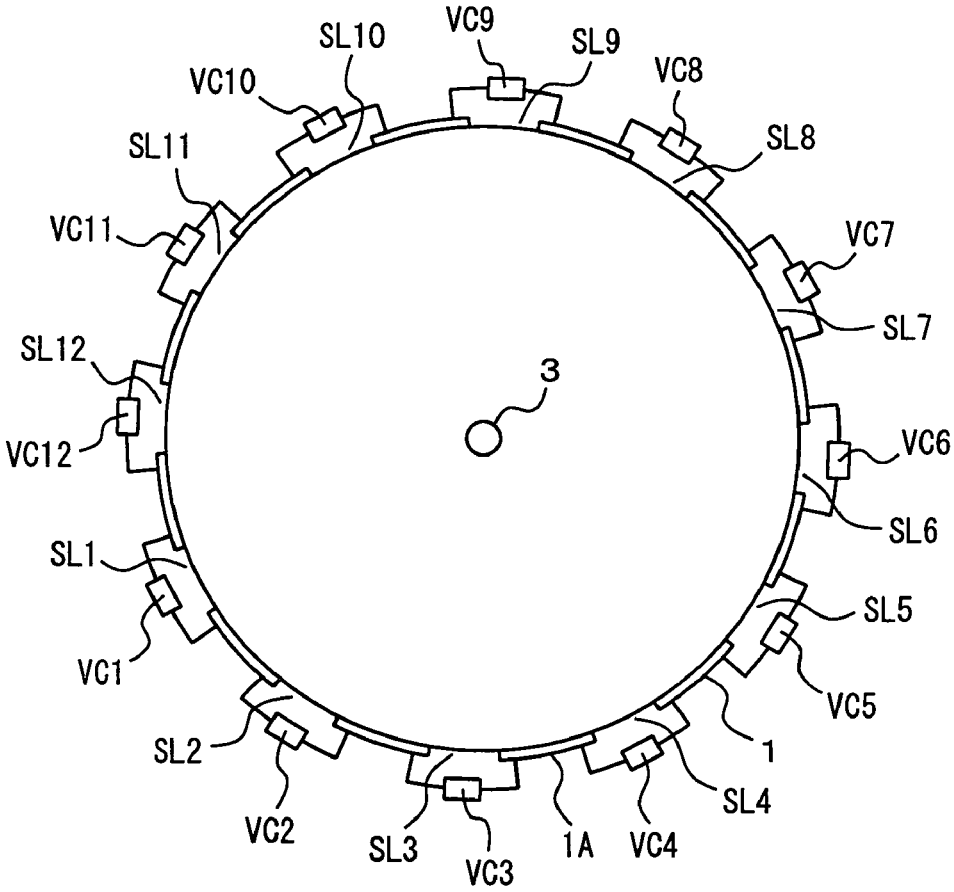
FIG. 3 is a plan view of the array antenna viewed in a direction of a rotation axis.

FIG. 3 is a plan view of array antenna 10 viewed in rotation axis direction DR1. As shown in FIG. 3, array antenna 10 includes twelve slot lines SL1 to SL12. Twelve slot lines SL1 to SL12 are arranged at regular intervals on outer circumferential surface 1A of cavity conductor 1, and have variable capacitance elements VC1 to VC12 loaded respectively.

Therefore, a central angle of a sector defined by adjacent two slot lines and feeder element 3 is set to 30°.

Feeder element 3 is arranged in the center of cavity conductor 1. As a conductor is not present in portions where slot lines SL1 to SL12 are formed, feeder element 3 can emit an electromagnetic wave to the outside of cavity conductor 1 through twelve slot lines SL1 to SL12.

Figure 4:
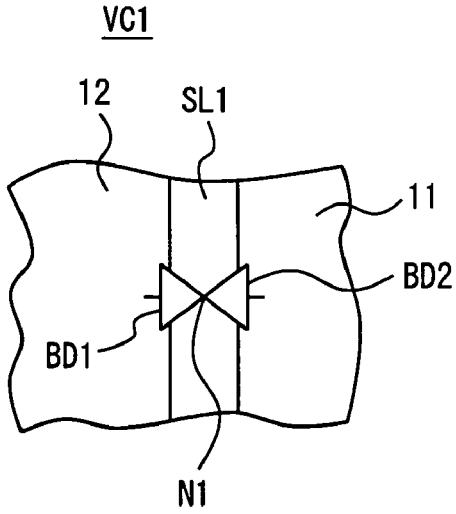
FIG. 4 illustrates a structure of a variable capacitance element.

FIG. 4 illustrates a structure of variable capacitance element VC1. Variable capacitance element VC1 consists of two varactor diodes BD1, BD2. Varactor diodes BD1, BD2 are connected between conductors 11, 12 (cavity conductor 1) located on opposing sides of slot line SL1 in an anti-serial manner (in such a manner that respective cathodes are connected). Control circuit 2 supplies control voltage CTLV to a node N1 between varactor diode BD1 and varactor diode BD2.

By supplying control voltage CTLV to the node between two varactor diodes BD1, BD2 connected in the anti-serial manner as described above, an equal voltage can simultaneously be applied to two varactor diodes BD1, BD2, thereby facilitating control of the capacitance of variable capacitance element VC1.

Figure 5A:
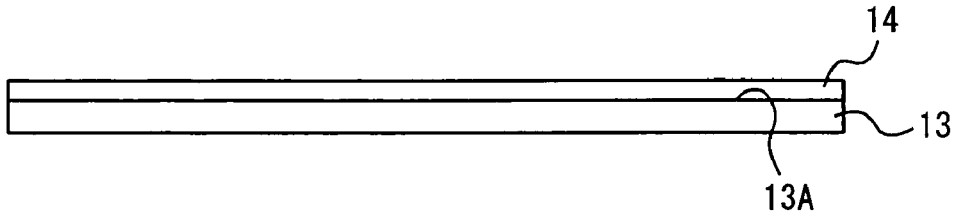
FIGS. 5A to 5C illustrate steps for fabricating the array antenna shown in FIG. 1.
Figure 5B:
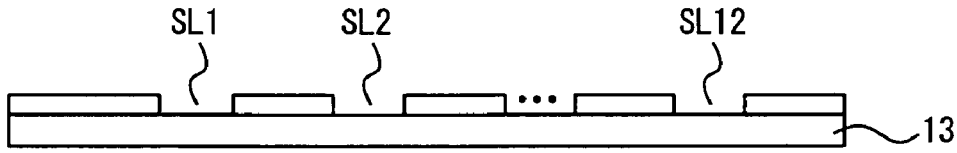
Figure 5C:
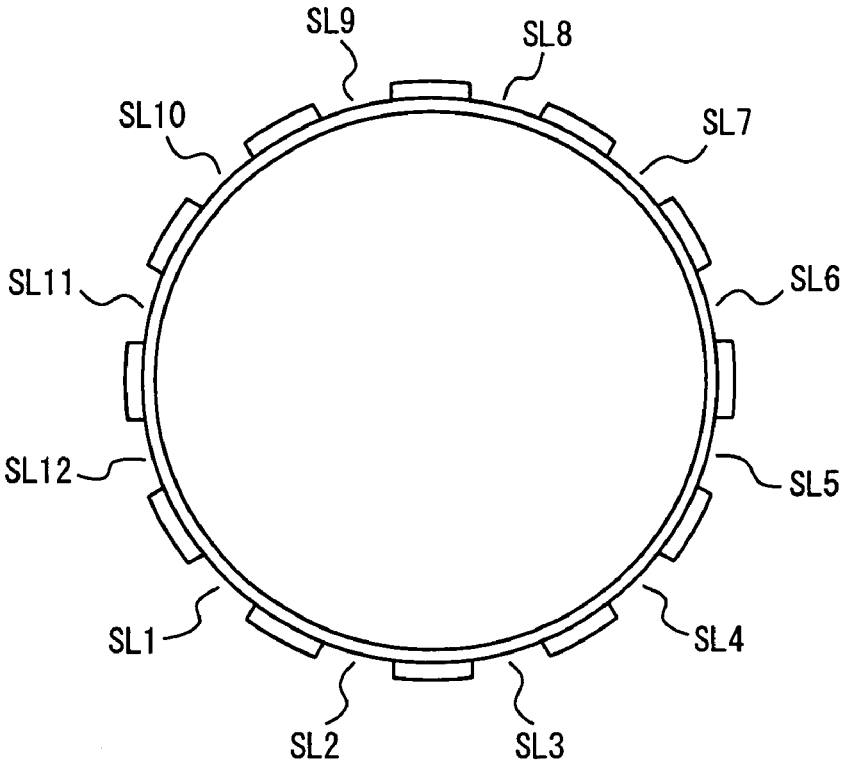

FIGS. 5A to 5C illustrate steps for fabricating array antenna 10 shown in FIG. 1. A copper foil 14 is formed on one main surface 13A of a dielectric 13 such as a printed board (see FIG. 5A). Then, copper foil 14 is etched by a prescribed width at regular intervals, so as to form twelve slot lines SL1 to SL12 (see FIG. 5B).

Thereafter, dielectric 13 is bent so as to form a cylindrical shape with slot lines SL1 to SL12 being exposed, thus fabricating a cylindrical cavity conductor 1 (see FIG. 5C). Copper foil 14 is formed on two annular printed boards for covering opposing end surfaces of cylindrical cavity conductor 1, as shown in FIG. 5A. One printed board out of two annular printed boards having copper foil 14 formed covers one end surface of cylindrical cavity conductor 1. The other printed board has feeder element 3 attached, and the printed board having feeder element 3 attached covers the other end surface of cylindrical cavity conductor 1. Then, variable capacitance elements VC1 to VC12 are attached to twelve slot lines SL1 to SL12, thus completing array antenna 10.

Figure 6A:
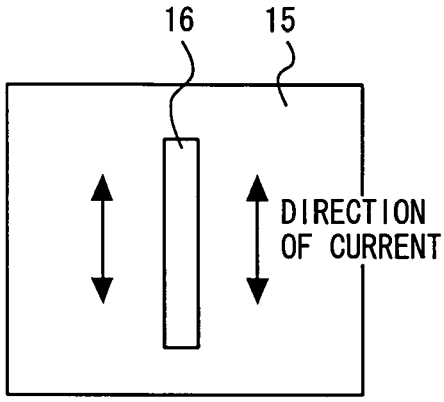
FIGS. 6A to 6C are conceptual views showing whether or not a radio wave is emitted through a slot line.
Figure 6B:
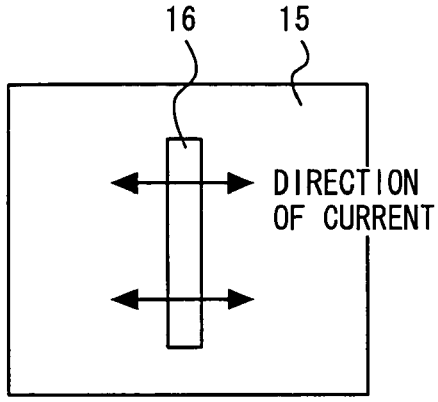
Figure 6C:
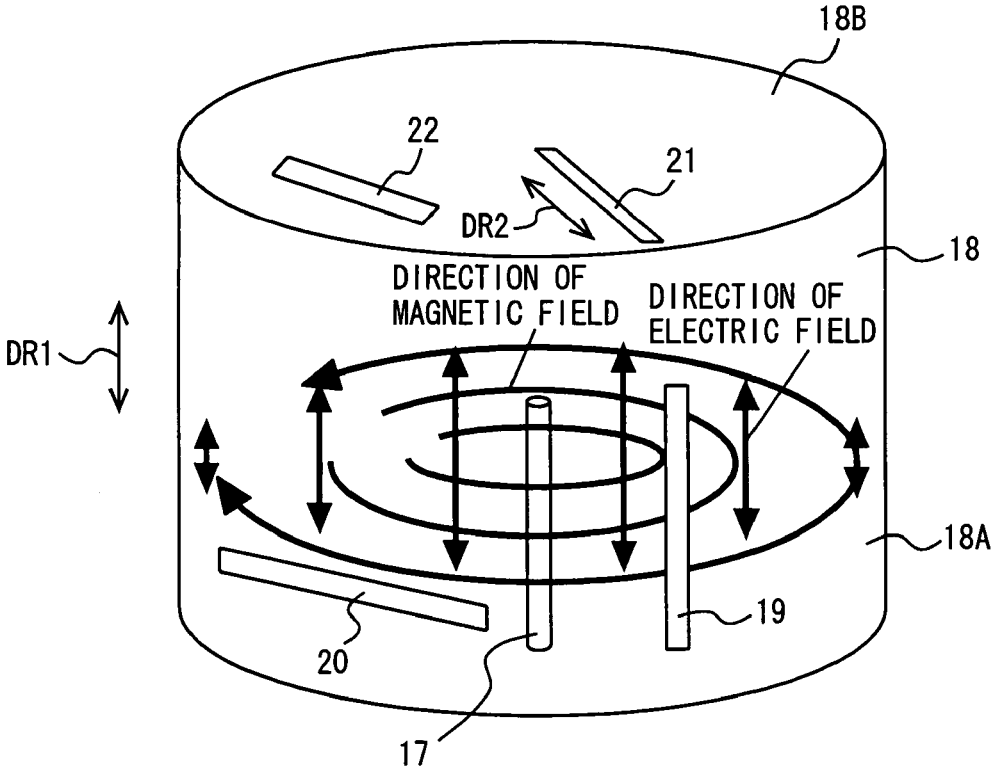

FIGS. 6A to 6C are conceptual views showing whether or not a radio wave is emitted through a slot line. Here, a slot line 16 formed in a conductor 15 will be considered. When slot line 16 is arranged in parallel to a direction of a current flowing through conductor 15, the radio wave is not emitted through slot line 16 (see FIG. 6A).

On the other hand, if slot line 16 is orthogonal to the direction of a current flowing through conductor 15, the radio wave is emitted through slot line 16 (see FIG. 6B).

Now, an example in which a bar-shaped feeder element 17 is provided inside a cavity conductor 18 having a substantially cylindrical shape will be considered. Feeder element 17 emits a radio wave having magnetic field oriented in a circumferential direction of cavity conductor 18 and electric field oriented in rotation axis direction DR1 on an outer circumferential surface 18A of cavity conductor 18.

Then, a current flows in rotation axis direction DR1 on outer circumferential surface 18A of cavity conductor 18, while a current flows in a radial direction DR2 on a cylinder end surface 18B of cavity conductor 18.

As a result, a slot line 19 out of slot lines 19, 20 formed on outer circumferential surface 18A of cavity conductor 18 is in parallel to the current, while slot line 20 is orthogonal thereto. Accordingly, the radio wave is not emitted from slot line 19 but from slot line 20.

In addition, a slot line 21 out of slot lines 21, 22 formed on cylinder end surface 18B of cavity conductor 18 is in parallel to the current, while slot line 22 is orthogonal thereto. Accordingly, the radio wave is not emitted from slot line 21 but from slot line 22 (see FIG. 6C).

In this manner, if the slot line crosses the direction of the current (that is, the direction of the electric field), a radio wave is emitted through the slot line.

In array antenna 10 shown in FIG. 1, though slot lines SL1 to SL12 are provided on outer circumferential surface 1A of cavity conductor 1 in a manner similar to slot line 19 shown in FIG. 6C, feeder element 3 is formed in a spiral shape in rotation axis direction DR1. Accordingly, slot lines SL1 to SL12 intersect with a direction of electric field of the radio wave emitted from feeder element 3.

Therefore, in array antenna 10, a radio wave is emitted through slot lines SL1 to SL12.

Control of directivity in array antenna 10 will now be described.

Control circuit 2 switches directivity of array antenna 10 by supplying a voltage to node N1 between varactor diodes BD1, BD2 constituting each of variable capacitance elements VC1 to VC12. Here, control circuit 2 supplies voltage V1 or voltage V2 to node N1.

It is assumed that voltages V1, V2 are set to 0V and 20V respectively. When control circuit 2 supplies voltage V1=0V to node N1 of variable capacitance element VC1, two varactor diodes BD1, BD2 enter such a state that they are almost short-circuited, thereby slot line SL1 not being excited. On the other hand, when control circuit 2 supplies voltage V2=20V to node N1 of variable capacitance element VC1, two varactor diodes BD1, BD2 enter such a state that they are almost open-circuited, thereby slot line SL1 being excited.

Therefore, by changing a pattern of voltage sets VVC1 to VVC12 to be supplied to twelve nodes N1 of variable capacitance elements VC1 to VC12, directivity of array antenna 10 can be switched.

Figure 7A:
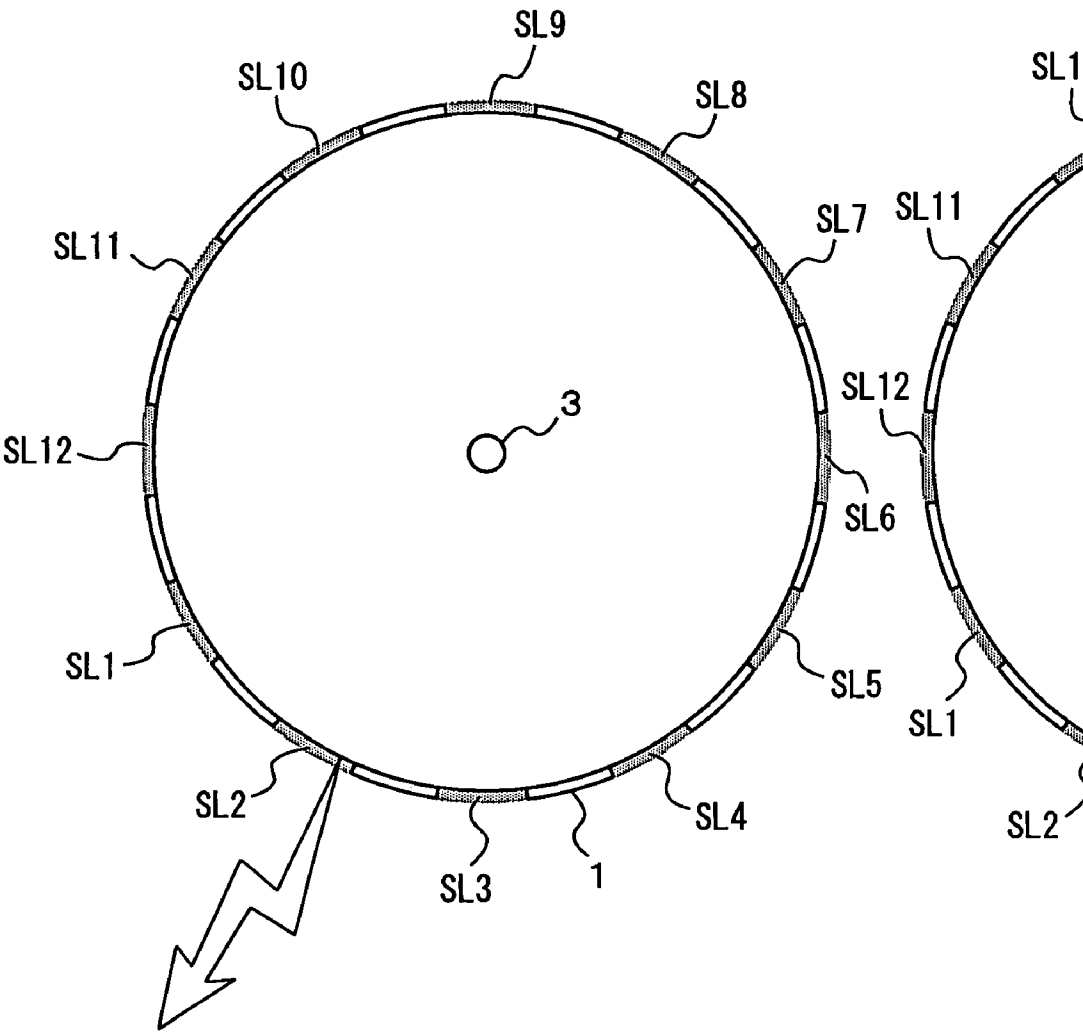
FIGS. 7A and 7B are conceptual views showing switching of directivity of the array antenna.
Figure 7B:
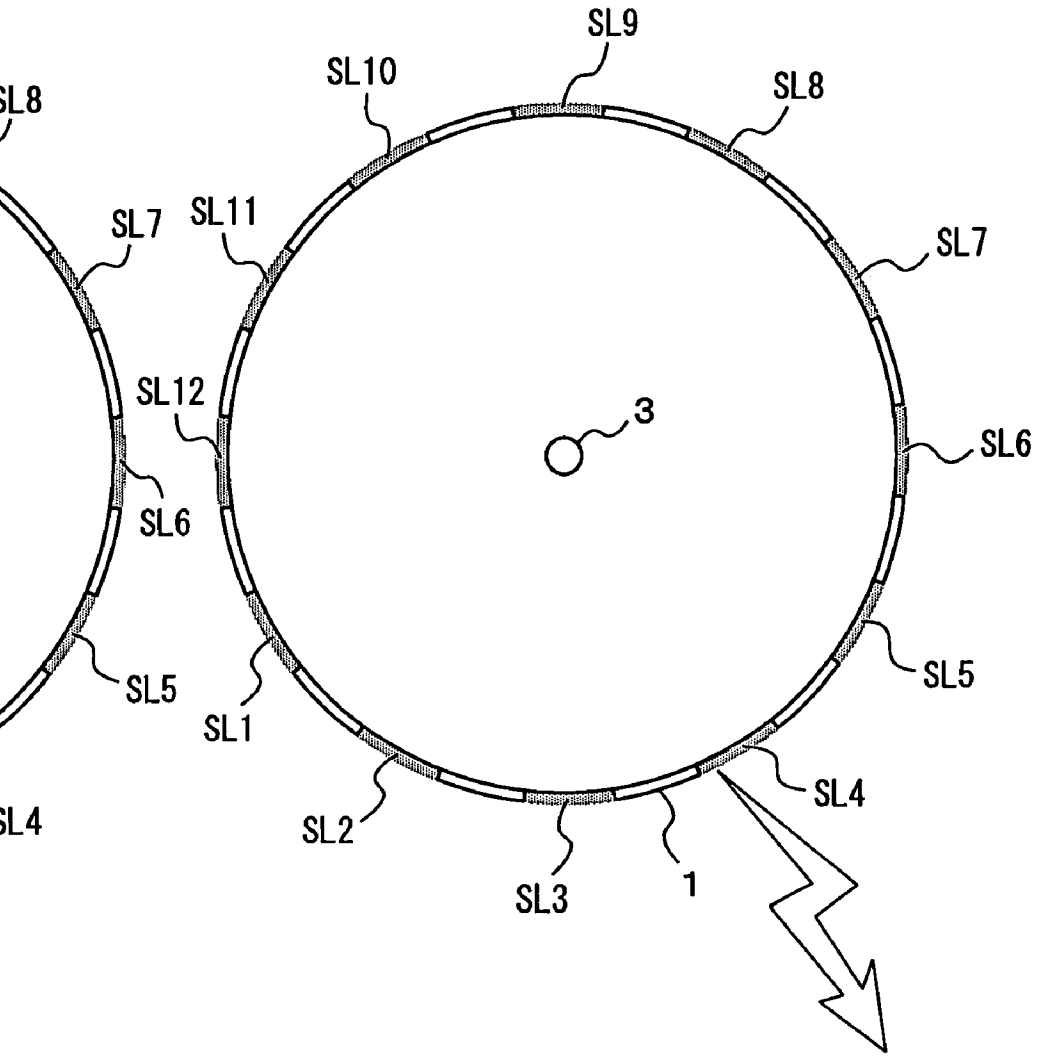

FIGS. 7A and 7B are conceptual views showing switching of directivity of array antenna 10. Control circuit 2 supplies voltages VVC1 to VVC3 set to 20V to nodes N1 of variable capacitance elements VC1 to VC3 respectively, and supplies voltages VVC4 to VVC12 set to 0V to nodes N1 of variable capacitance elements VC4 to VC12 respectively.

Then, varactor diodes BD1, BD2 of variable capacitance elements VC1 to VC3 enter such a state that they are almost open-circuited, thereby slot lines SL1 to SL3 being excited. Meanwhile, varactor diodes BD1, BD2 of variable capacitance elements VC4 to VC12 enter such a state that they are almost short-circuited, thereby slot lines SL4 to SL12 not being excited.

As a result, array antenna 10 emits a radio wave mainly in a direction from feeder element 3 to slot line SL2 (see FIG. 7A).

When control circuit 2 supplies voltages VVC3 to VVC5 set to 20V to nodes N1 of variable capacitance elements VC3 to VC5 respectively and supplies voltages VVC1, VVC2, and VVC6 to VVC12 set to 0V to nodes N1 of variable capacitance elements VC1, VC2, and VC6 to VC12 respectively, varactor diodes BD1, BD2 of variable capacitance elements VC3 to VC5 enter such a state that they are almost open-circuited, thereby slot lines SL3 to SL5 being excited. Meanwhile, varactor diodes BD1, BD2 of variable capacitance elements VVC1, VVC2, and VVC6 to VVC12 enter such a state that they are almost short-circuited, thereby slot lines SL1, SL2, and SL6 to SL12 not being excited.

As a result, array antenna 10 emits a radio wave mainly in a direction from feeder element 3 to slot line SL4 (see FIG. 7B).

The direction of radio wave radiation shown in FIG. 7A and the direction of radio wave radiation shown in FIG. 7B establish such a relation as obtained by rotating array antenna 10 in a circumferential direction of cavity conductor 1. Therefore, array antenna 10 electrically obtains an effect the same as that obtained by rotating the antenna mechanically in the circumferential direction.

Now, a difference in a shape of a beam emitted from array antenna 10 between when a voltage value representing each of voltages VVC1 to VVC12 is set to binary values 0V and 20V and when the voltage value is continuously switched in a prescribed voltage range will be described.

Figure 8:
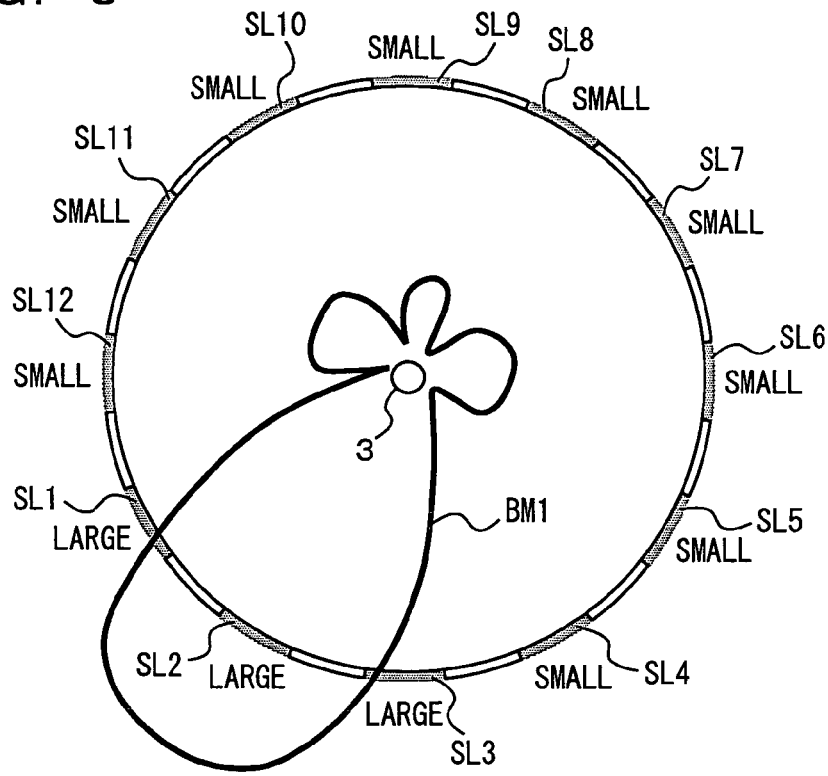
FIG. 8 is a conceptual view when a beam shape is controlled based on binary voltage values.
Figure 9:
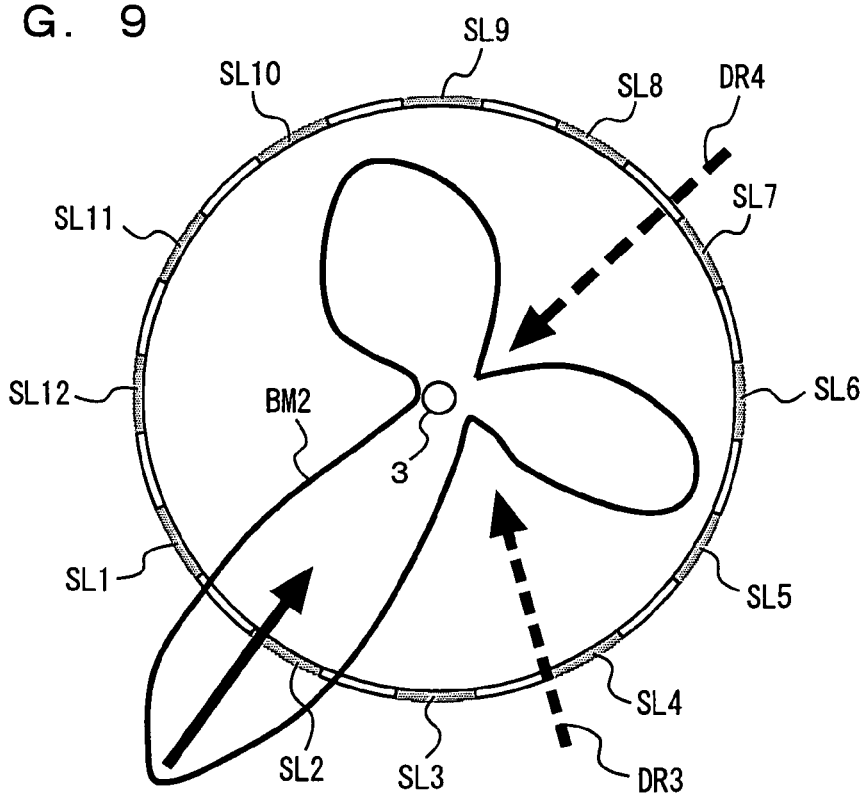
FIG. 9 is a conceptual view when a beam shape is controlled based on multilevel voltage values.

FIG. 8 is a conceptual view when a beam shape is controlled based on binary voltage values, while FIG. 9 is a conceptual view when a beam shape is controlled based on multilevel voltage values. When voltages VVC1 to VVC3 set to 20V are supplied to nodes N1 of variable capacitance elements VC1 to VC3 respectively and voltages VVC4 to VVC12 set to 0V are supplied to nodes N1 of variable capacitance elements VC4 to VC12 respectively, array antenna 10 emits a beam BM1 mainly in a direction from feeder element 3 to slot line SL2 (see. FIG. 8).

On the other hand, when a set of voltages VVC1 to VVC12 representing continuous values is supplied to twelve nodes N1 of variable capacitance elements VC1 to VC12, array antenna 10 emits a beam BM2 (see FIG. 9). Though beam BM2 is directed mainly in a direction from feeder element 3 to slot line SL2 in a manner the same as beam BM1, beam BM2 has a width smaller than beam BM1. In addition, beam BM2 has null in interference wave directions DR3, DR4.

In this manner, a shape of a beam emitted from array antenna 10 can be controlled by controlling a set of voltages VVC1 to VVC12 supplied to twelve nodes N1 of variable capacitance elements VC1 to VC12 to a voltage set pattern set to binary values or to a voltage set pattern set to multilevel values.

It is noted that control of each of voltages VVC1 to VVC12 to binary values is comparable to control of a capacitance of each of variable capacitance elements VC1 to VC12 to binary values, and control of each of voltages VVC1 to VVC12 to multilevel values is comparable to control of a capacitance of each of variable capacitance elements VC1 to VC12 to multilevel values.

Figure 10A:
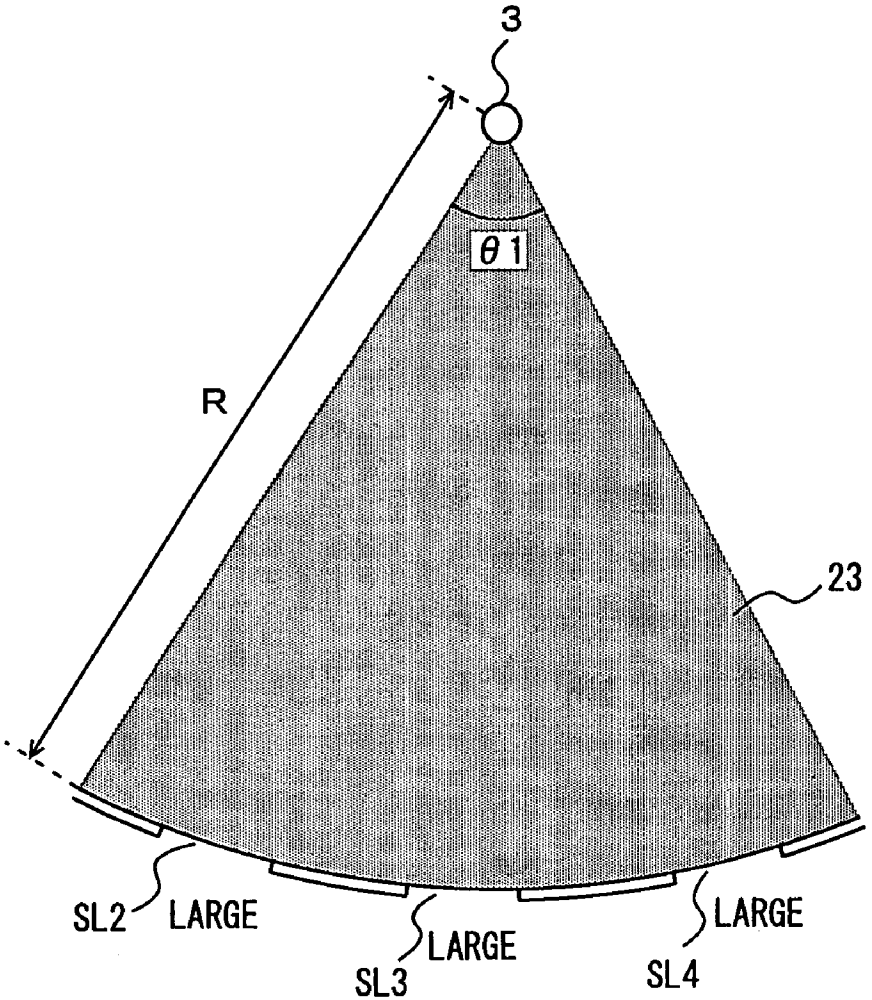
FIGS. 10A and 10B illustrate a beam shape when the number of slot lines to be excited is relatively large.
Figure 10B:
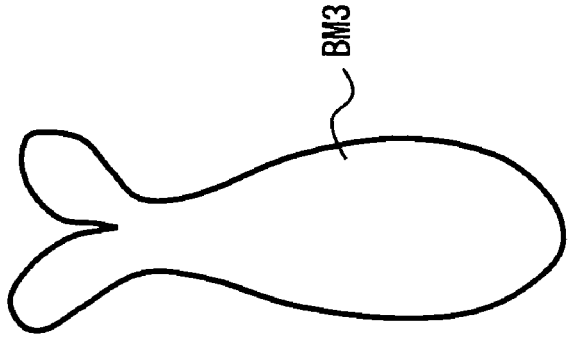
Figure 11A:
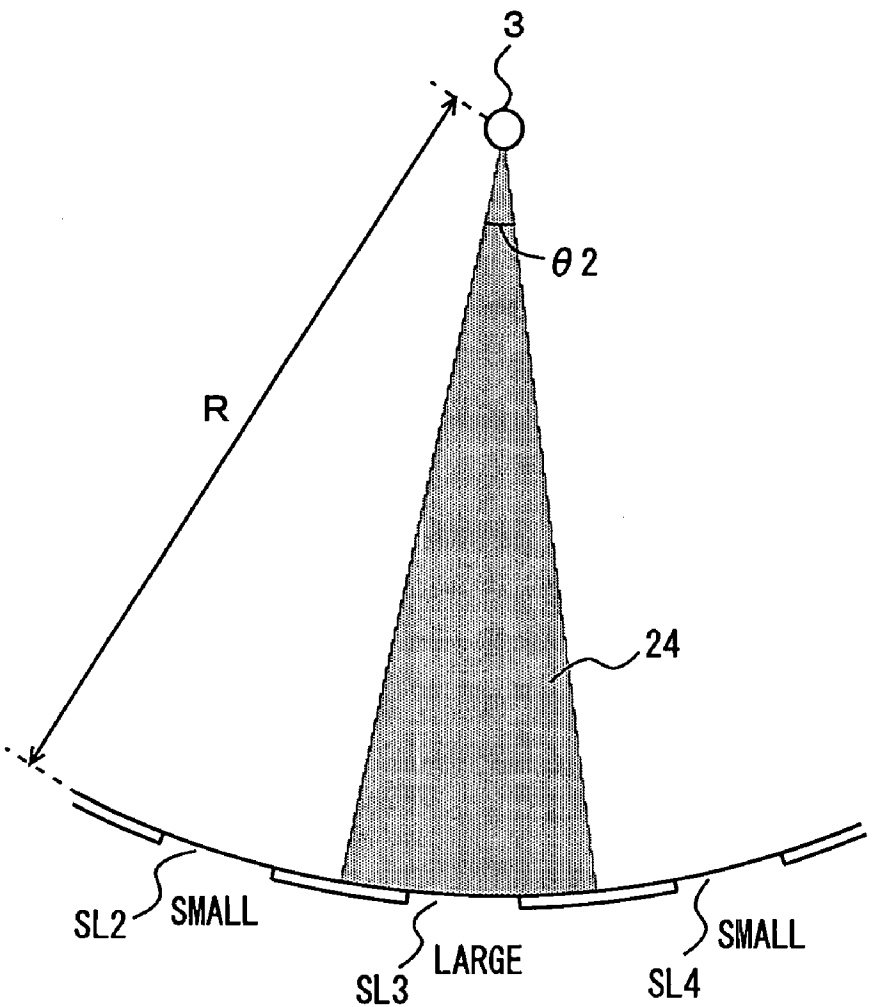
FIGS. 11A and 11B illustrate a beam shape when the number of slot lines to be excited is relatively small.

A difference in beam shapes due to a difference in the number of slot lines to be excited will now be described. FIGS. 10A and 10B illustrate a beam shape when the number of slot lines to be excited is relatively large, while FIGS. 11A and 11B illustrate a beam shape when the number of slot lines to be excited is relatively small.

When voltages VVC2 to VVC4 set to 20V are supplied to nodes N1 of variable capacitance elements VC2 to VC4 respectively and voltages VVC1, and VVC5 to VVC12 set to 0V are supplied to nodes N1 of variable capacitance elements VC1, and VC5 to VC12 respectively, slot lines SL2 to SL4 are excited (see FIG. 10A) and slot lines SL1, and SL5 to SL12 are not excited, whereby array antenna 10 emits a beam BM3 as shown in FIG. 10B. Here, beam BM3 is directed from feeder element 3 to slot line SL3. When a radius of cavity conductor 1 is denoted by R, a central angle of a sector 23 is denoted by θ1, and an area of sector 23 is denoted by S1, a relation $S1=(R^2\theta 1)/2$ is established (see FIG. 10A).

Figure 11B:
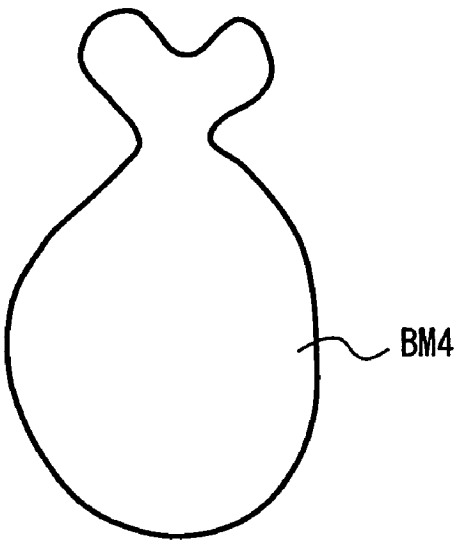

On the other hand, when voltage VVC3 set to 20V is supplied to node N1 of variable capacitance element VC3 and voltages VVC1, VVC2, and VVC4 to VVC12 set to 0V are supplied to nodes N1 of variable capacitance elements VC1, VC2, and VC4 to VC12 respectively, slot line SL3 is excited (see FIG. 11A) and slot lines SL1, SL2, and SL4 to SL12 are not excited, whereby array antenna 10 emits a beam BM4 as shown in FIG. 11B. Here, beam BM4 is directed from feeder element 3 to slot line SL3 in a manner the same as beam BM3. When a central angle of a sector 24 is denoted by θ2 and an area of sector 24 is denoted by S2, a relation $S2=(R^2\theta 2)/2$ is established (see FIG. 11A).

Beam BM3 has a width smaller than beam BM4. In addition, as central angle θ1 is larger than central angle θ2, area S1 is larger than area S2.

Therefore, when the number of slot lines emitting the radio wave is increased, that is, when an area of an opening through which radio wave is emitted is increased, a beam having a relatively small beam width can be emitted from array antenna 10.

As described above, by changing a slot line to be excited among twelve slot lines SL1 to SL12, directivity of array antenna 10 can be switched. In addition, the voltage values of voltages VVC1 to VVC12 supplied to variable capacitance elements VC1 to VC12 are changed between binary values and multilevel values, so that a beam shape can be controlled. Moreover, the beam shape can be controlled also by changing the number of slot lines to be excited.

In other words, in array antenna 10, the antenna characteristic can be controlled by controlling a set of voltages VVC1 to VVC12 supplied to variable capacitance elements VC1 to VC12.

[Variation of Feeder Element]

Figure 12:
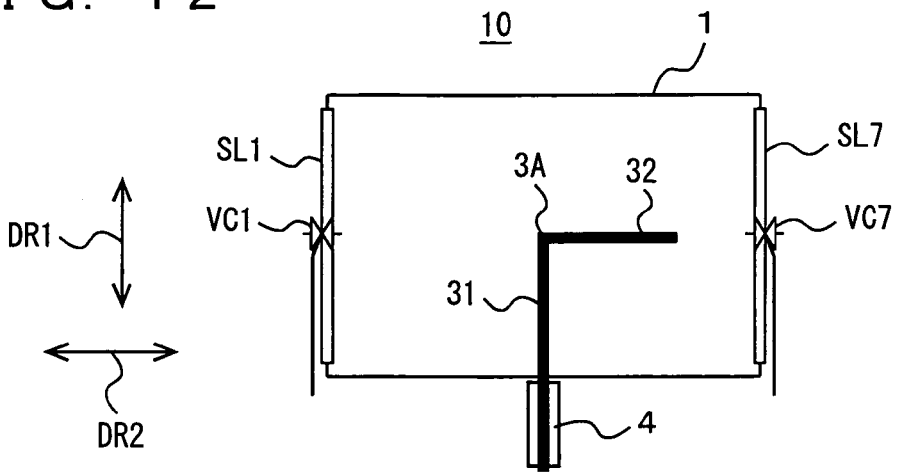
FIG. 12 shows a first variation of a feeder element shown in FIG. 2.

FIG. 12 shows a first variation of feeder element 3 shown in FIG. 2. Array antenna 10 may include a feeder element 3A instead of feeder element 3. Feeder element 3A includes feeder members 31, 32. Feeder member 31 has one end connected to coaxial cable 4, and is arranged along rotation axis direction DR1 of cavity conductor 1. Feeder member 32 has one end connected to feeder member 31, and is arranged along radial direction DR2 of cavity conductor 1.

As electric field of a radio wave emitted from feeder element 3A is directed to a circumference of cavity conductor 1 by virtue of feeder member 32, slot lines SL1 to SL12 are orthogonal to the electric field. Therefore, slot lines SL1 to SL12 can emit a radio wave also when feeder element 3A is employed.

Figure 13:
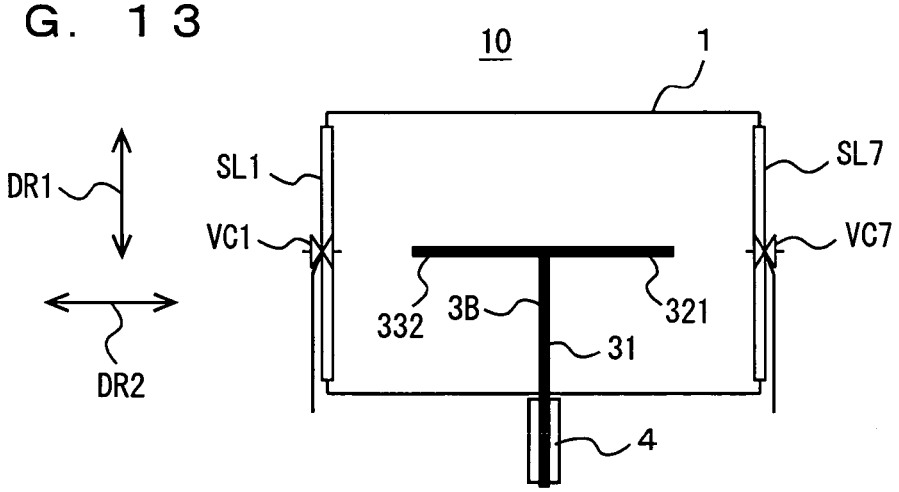
FIG. 13 shows a second variation of the feeder element shown in FIG. 2.

FIG. 13 shows a second variation of feeder element 3 shown in FIG. 2. Array antenna 10 may include a feeder element 3B instead of feeder element 3. Feeder element 3B is obtained by replacing feeder member 32 for feeder element 3A shown in FIG. 12 with feeder members 321 to 332. Feeder element 3B is otherwise the same as feeder element 3A. FIG. 13 only shows two feeder members 321, 332 among twelve feeder members 321 to 332.

Feeder element 3B is characterized by including feeder members 321 to 332 in the number the same as that of slot lines SL1 to SL12. Each of feeder members 321 to 332 has one end connected to feeder member 31, and is arranged along radial direction DR2 of cavity conductor 1. That is, feeder members 321 to 332 are radially arranged around feeder member 31 in radial direction DR2.

Here, feeder members 321 to 332 may be arranged so as to oppose slot lines SL1 to SL12 respectively, or alternatively, each of feeder members 321 to 332 may be arranged so as to oppose a portion between two adjacent slots.

Slot lines SL1 to SL12 can emit a radio wave also when feeder element 3B is employed, as in the example where feeder element 3A is employed. When feeder element 3B is employed, rotational symmetry of the slot line to be excited can be maintained.

Figure 14:
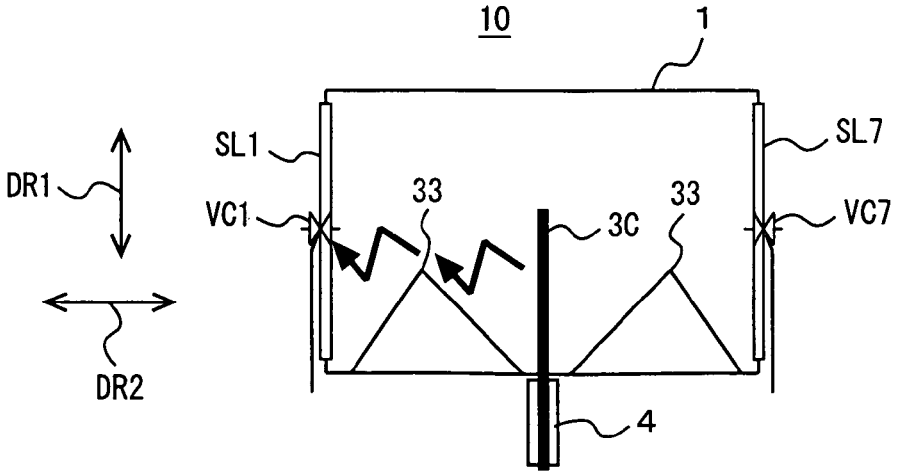
FIG. 14 shows a third variation of the feeder element shown in FIG. 2.

FIG. 14 shows a third variation of feeder element 3 shown in FIG. 2. Array antenna 10 may include a feeder element 3C instead of feeder element 3. Here, array antenna 10 further includes a scatterer 33.

Feeder element 3C has one end connected to coaxial cable 4. Feeder element 3C has a bar shape, and is arranged in rotation axis direction DR1 of cavity conductor 1. Scatterer 33 is made of a metal or a dielectric, and arranged between feeder element 3C and slot lines SL1 to SL12.

A radio wave emitted from feeder element 3C is scattered by scatterer 33, and reaches slot lines SL1 to SL12. Therefore, the electric field of the radio wave intersects with slot lines SL1 to SL12 on the outer circumferential surface of cavity conductor 1. As a result, slot lines SL1 to SL12 can emit a radio wave.

[Variation of Array Antenna]

Figure 15:
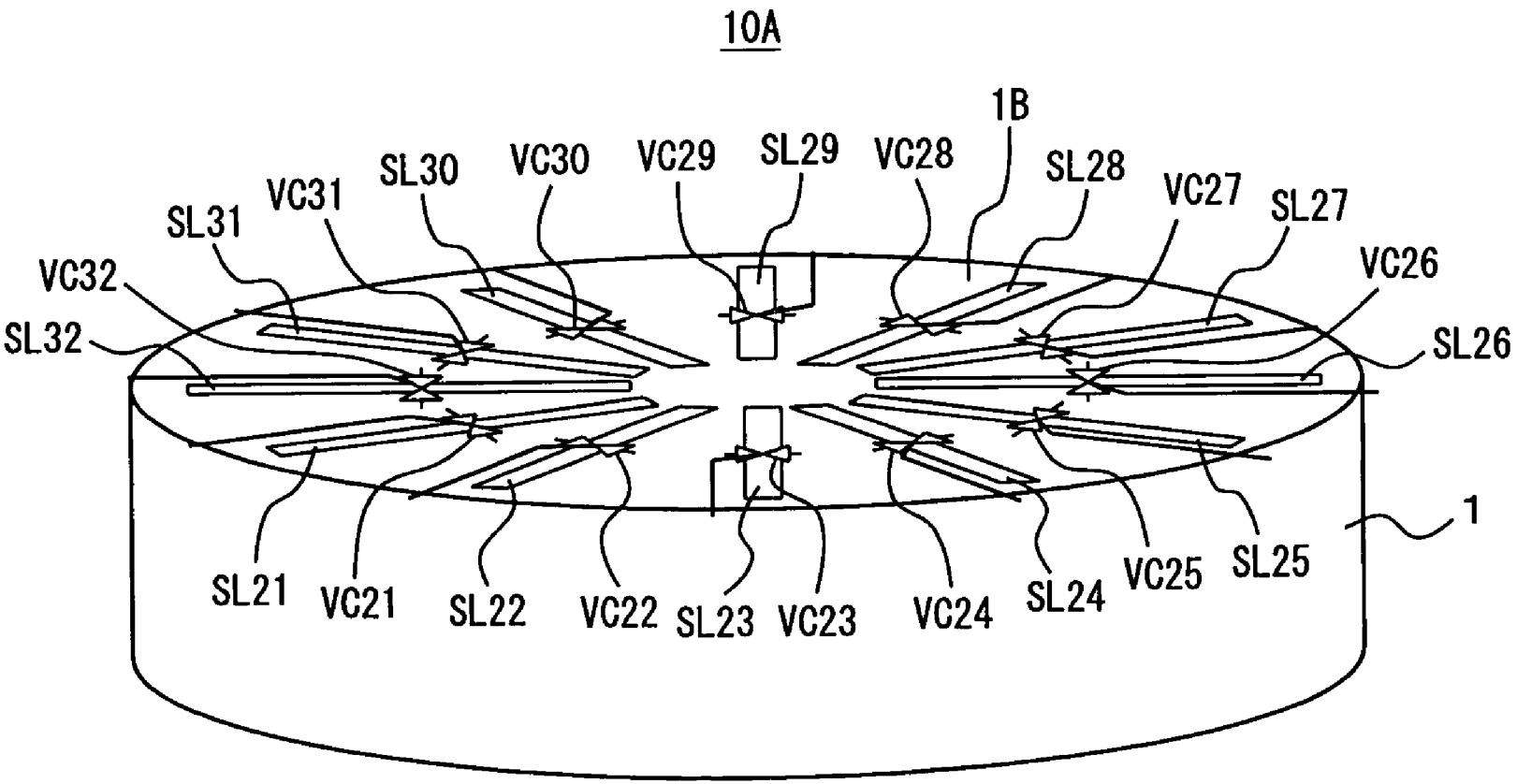
FIG. 15 shows another conceptual view of the array antenna.

FIG. 15 shows another conceptual view of the array antenna. The array antenna according to Embodiment 1 may be implemented by an array antenna 10A shown in FIG. 15. Array antenna 10A is obtained by replacing slot lines SL1 to SL12 and variable capacitance elements VC1 to VC12 in array antenna 10 shown in FIG. 1 with slot lines SL21 to SL32 and variable capacitance elements VC21 to VC32 respectively. Array antenna 10A is otherwise the same as array antenna 10.

Slot lines SL21 to SL32 are arranged radially on cylinder end surface 1B of cavity conductor 1. Variable capacitance elements VC21 to VC32 are loaded to slot lines SL21 to SL32 respectively. Each of variable capacitance elements VC21 to VC32 has a structure the same as that of variable capacitance element VC1 shown in FIG. 4.

Array antenna 10A includes any one of feeder elements 3, 3A, 3B, and 3C described above. If array antenna 10A includes feeder element 3C, it also includes scatterer 33 shown in FIG. 14.

Therefore, the electric field of the radio wave emitted from the feeder element (any one of feeder elements 3, 3A, 3B, and 3C) intersects with slot lines SL21 to SL32. Accordingly, even when slot lines SL21 to SL32 are arranged along a radial direction of cavity conductor 1, array antenna 10A can emit a radio wave through slot lines SL21 to SL32.

In array antenna 10A, by controlling a pattern of voltages applied to twelve nodes N1 of variable capacitance elements VC21 to VC32, beams of a variety of shapes are emitted in obliquely upward direction.

Figure 16:
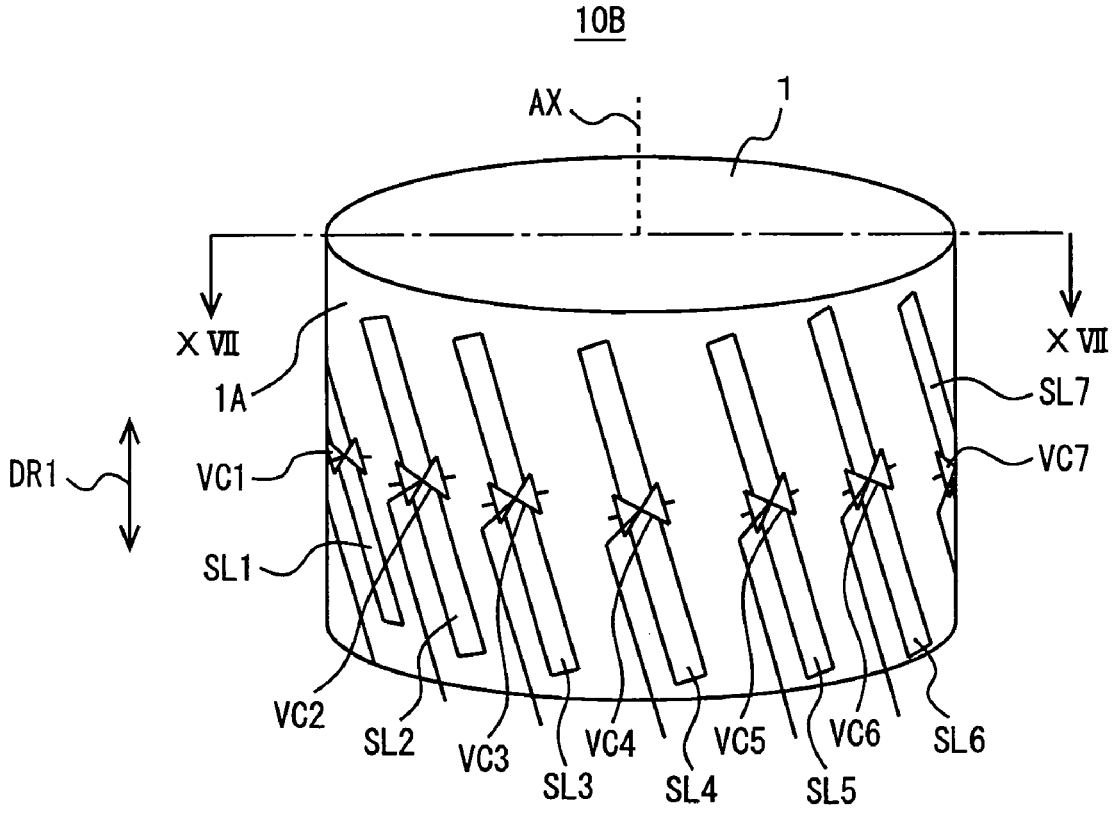
FIG. 16 shows yet another conceptual view of the array antenna.
Figure 17:
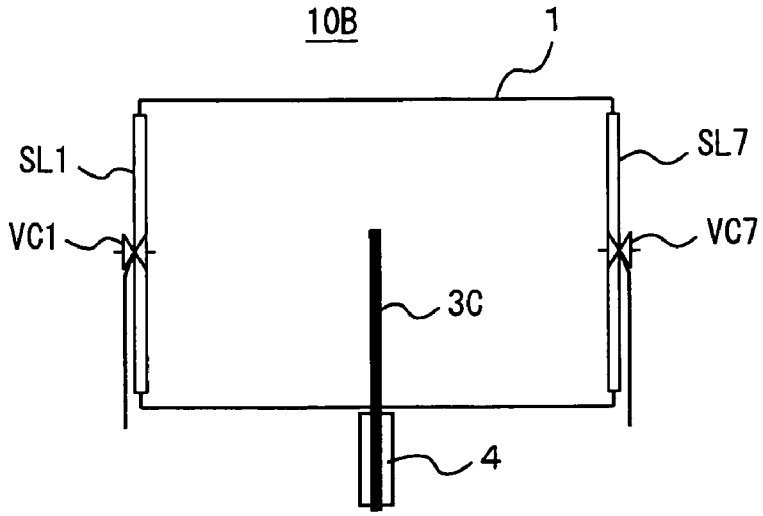
FIG. 17 is a cross-sectional view of the array antenna along the line XVII—XVII shown in FIG. 16.

FIG. 16 shows yet another conceptual view of the array antenna, and FIG. 17 is a cross-sectional view of the array antenna along the line XVII—XVII shown in FIG. 16. An array antenna 10B according to Embodiment 1 is obtained by replacing feeder element 3 with feeder element 3C and by changing an orientation of slot lines SL1 to SL12 and variable capacitance elements VC1 to VC12 of array antenna 10. Array antenna 10B is otherwise the same as array antenna 10.

In array antenna 10B, slot lines SL1 to SL12 are arranged on outer circumferential surface 1A such that slot lines SL1 to SL12 are at a prescribed angle with respect to a rotation axis AX of cavity conductor 1. Though feeder element 3C generates such electric field that a current flows in rotation axis direction DR1 on outer circumferential surface 1A of cavity conductor 1, slot lines SL1 to SL12 intersect with the current flowing on outer circumferential surface 1A, because the slot lines are at a prescribed angle with respect to rotation axis direction DR1. As a result, array antenna 10B can emit a radio wave through slot lines SL1 to SL12.

It is noted that any one of feeder elements 3, 3A and 3B may be employed instead of feeder element 3C, or scatterer 33 shown in FIG. 14 may be added in array antenna 10B.

Figure 18:
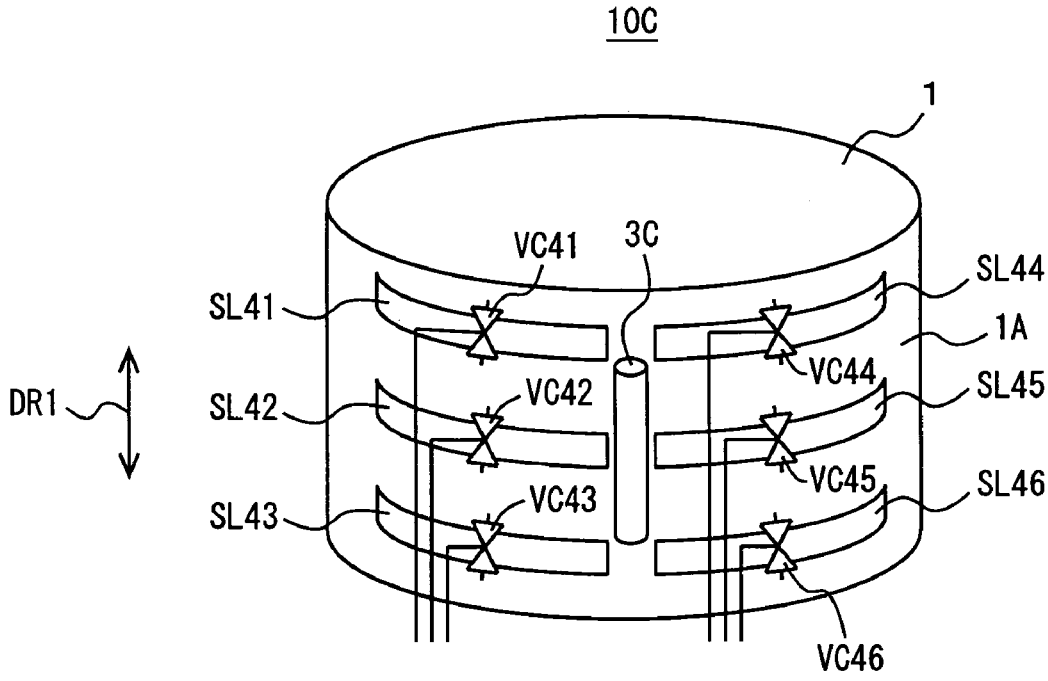
FIGS. 18 to 26 are further conceptual views of the array antenna.

FIG. 18 is yet another conceptual view of the array antenna. The array antenna according to Embodiment 1 may be implemented by an array antenna 10C shown in FIG. 18. Array antenna 10C is obtained by replacing slot lines SL1 to SL12, variable capacitance elements VC1 to VC12, and feeder element 3 in array antenna 10 with slot lines SL41 to SL52, variable capacitance elements VC41 to VC52, and feeder element 3C respectively. Array antenna 10C is otherwise the same as array antenna 10.

It is noted that FIG. 18 only shows slot lines SL41 to SL46 out of slot lines SL41 to SL52 and variable capacitance elements VC41 to VC46 out of variable capacitance elements VC41 to VC52.

Slot lines SL41 to SL52 are arranged so as to be orthogonal to rotation axis direction DR1 on outer circumferential surface 1A of cavity conductor 1. Variable capacitance elements VC41 to VC52 are loaded to slot lines SL41 to SL52 respectively. Each of variable capacitance elements VC41 to VC52 has a structure the same as that of variable capacitance element VC1 shown in FIG. 4.

Though feeder element 3C generates such electric field that a current flows in rotation axis direction DR1 on outer circumferential surface 1A of cavity conductor 1, slot lines SL41 to SL52 intersect with the current flowing on outer circumferential surface 1A. As a result, array antenna 10C can emit a radio wave from slot lines SL41 to SL52.

It is noted that any one of feeder elements 3, 3A and 3B may be employed instead of feeder element 3C, or scatterer 33 shown in FIG. 14 may be added in array antenna 10C.

Figure 19:
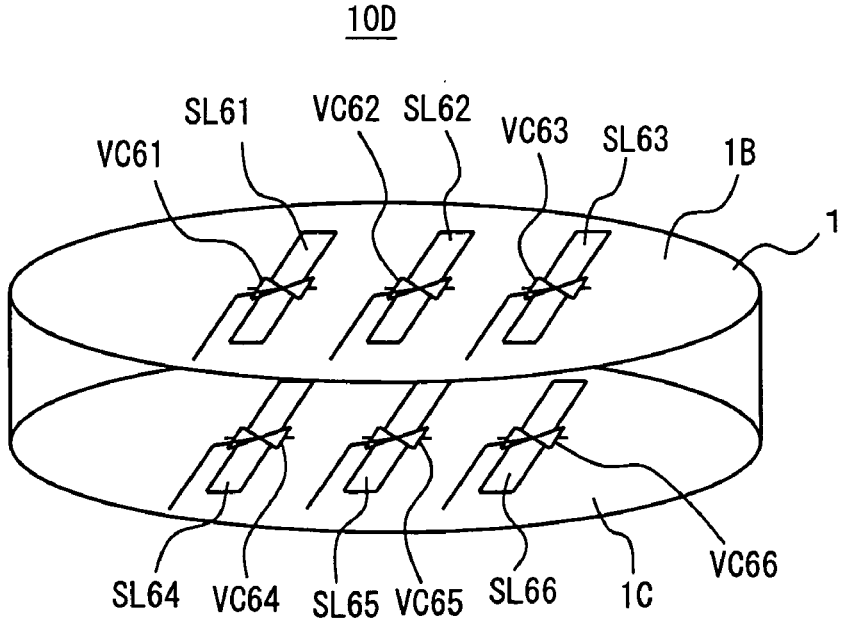

FIG. 19 is yet another conceptual view of the array antenna. The array antenna according to Embodiment 1 may be implemented by an array antenna 10D shown in FIG. 19. Array antenna 10D is obtained by replacing slot lines SL1 to SL12, variable capacitance elements VC1 to VC12, and feeder element 3 in array antenna 10 with slot lines SL61 to SL66, variable capacitance elements VC61 to VC66, and feeder element 3C respectively. Array antenna 10D is otherwise the same as array antenna 10.

It is noted that feeder element 3C is not shown in FIG. 19.

Slot lines SL61 to SL63 are arranged substantially in parallel to one another on cylinder end surface 1B of cavity conductor 1, while slot lines SL64 to SL66 are arranged substantially in parallel to one another on a cylinder end surface 1C of cavity conductor 1. Variable capacitance elements VC61 to VC66 are loaded to slot lines SL61 to SL66 respectively. Each of variable capacitance elements VC61 to VC66 has a structure the same as that of variable capacitance element VC1 shown in FIG. 4.

Though feeder element 3C generates such electric field that a current flows in a radial direction of cavity conductor 1 on cylinder end surfaces 1B and 1C, slot lines SL61 to SL66 intersect with the current flowing on cylinder end surfaces 1B and 1C, because slot lines SL61 to SL63 and slot lines SL64 to SL66 are arranged in parallel to one another.

Therefore, array antenna 10D can emit a radio wave from slot lines SL61 to SL66.

In addition, in array antenna 10D, a beam can be emitted from cylinder end surface 1B side or cylinder end surface 1C side by controlling voltages VVC61 to VVC66 supplied to six nodes N1 of variable capacitance elements VC61 to VC66.

In other words, when voltages VVC61 to VVC63 set to 20V are supplied to nodes N1 of variable capacitance elements VC61 to VC63 respectively and voltages VVC64 to VVC66 set to 0V are supplied to nodes N1 of variable capacitance elements VC64 to VC66 respectively, array antenna 10D emits a beam from cylinder end surface 1B side. Meanwhile, when voltages VVC61 to VVC63 set to 0V are supplied to nodes N1 of variable capacitance elements VC61 to VC63 respectively and voltages VVC64 to VVC66 set to 20V are supplied to nodes N1 of variable capacitance elements VC64 to VC66 respectively, array antenna 10D emits a beam from cylinder end surface 1C side.

In addition, when voltages VVC61 to VVC66 set to 20V are supplied to nodes N1 of variable capacitance elements VC61 to VC66 respectively, array antenna 10D emits a beam from both of cylinder end surfaces 1B and 1C.

It is noted that any one of feeder elements 3, 3A and 3B may be employed instead of feeder element 3C, or scatterer 33 shown in FIG. 14 may be added in array antenna 10D.

Figure 20:
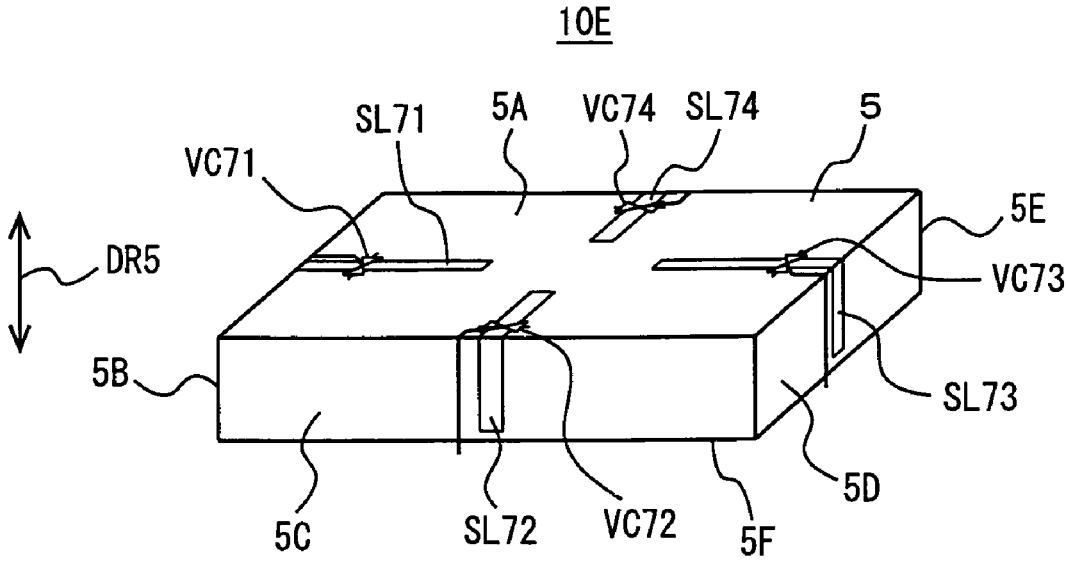

FIG. 20 is yet another conceptual view of the array antenna. The array antenna according to Embodiment 1 may be implemented by an array antenna 10E shown in FIG. 20. Array antenna 10E includes feeder element 3C, a cavity conductor 5, slot lines SL71 to SL74, and variable capacitance elements VC71 to VC74. It is noted that feeder element 3C is not shown in FIG. 20.

Slot line SL71 is provided on an upper surface 5A and on a side surface 5B of cavity conductor 5 in a bent manner. Slot line SL72 is provided on upper surface 5A and on a side surface 5C of cavity conductor 5 in a bent manner. Slot line SL73 is provided on upper surface 5A and on a side surface 5D of cavity conductor 5 in a bent manner. Slot line SL74 is provided on upper surface 5A and on a side surface 5E of cavity conductor 5 in a bent manner.

Variable capacitance elements VC71 to VC74 are loaded to slot lines SL71 to SL74 respectively. Each of variable capacitance elements VC71 to VC74 has a structure the same as that of variable capacitance element VC1 shown in FIG. 4. Feeder element 3C is provided inside cavity conductor 5 in a manner perpendicular to a bottom surface 5F of cavity conductor 5.

Feeder element 3C generates such electric field that a current flows in an up-down direction DR5 on side surfaces 5B, 5C, 5D, and 5E of cavity conductor 5, whereas it generates such electric field that a current orthogonal to slot lines SL71, SL73 or slot lines SL72, SL74 flows on upper surface 5A.

Therefore, array antenna 10E can emit a radio wave from slot lines SL71 to SL74.

It is noted that any one of feeder elements 3, 3A and 3B may be employed instead of feeder element 3C, or scatterer 33 shown in FIG. 14 may be added in array antenna 10E.

Figure 21:
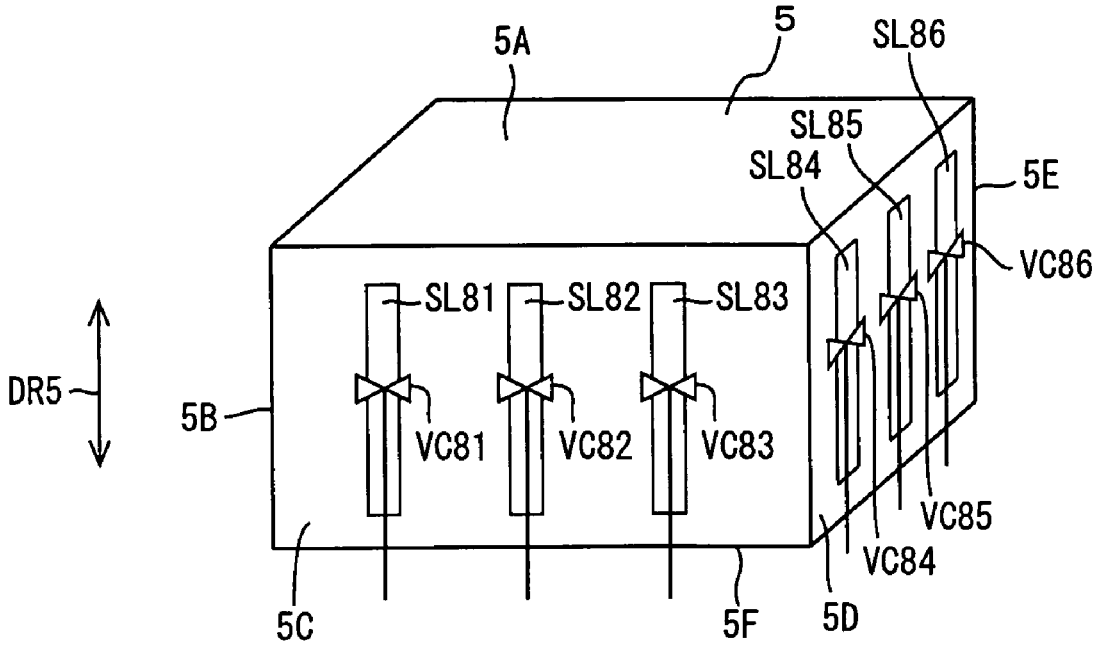

FIG. 21 is yet another conceptual view of the array antenna. The array antenna according to Embodiment 1 may be implemented by an array antenna 10F shown in FIG. 21. Array antenna 10F includes feeder element 3, cavity conductor 5, slot lines SL81 to SL86, and variable capacitance elements VC81 to VC86. It is noted that feeder element 3 is not shown in FIG. 21.

Slot lines SL81 to SL83 are provided substantially in parallel along up-down direction DR5 on side surface 5C of cavity conductor 5, while slot lines SL84 to SL86 are provided substantially in parallel along up-down direction DR5 on side surface 5D of cavity conductor 5.

Variable capacitance elements VC81 to VC86 are loaded to slot lines SL81 to SL86 respectively. Each of variable capacitance elements VC81 to VC86 has a structure the same as that of variable capacitance element VC1 shown in FIG. 4. Feeder element 3 is provided inside cavity conductor 5 in a manner perpendicular to bottom surface 5F of cavity conductor 5.

Though three slot lines having the variable capacitance elements loaded respectively are provided substantially in parallel to one another in a manner similar to slot lines SL81 to SL83 also on side surfaces 5B, 5E of cavity conductor 5, they are not shown in FIG. 21.

Feeder element 3 generates electric field intersecting with slot lines SL81 to SL86. Therefore, array antenna 10F can emit a radio wave from slot lines SL81 to SL86.

It is noted that any one of feeder elements 3A, 3B, and 3C may be employed instead of feeder element 3, or scatterer 33 shown in FIG. 14 may be added in array antenna 10F.

Figure 22:
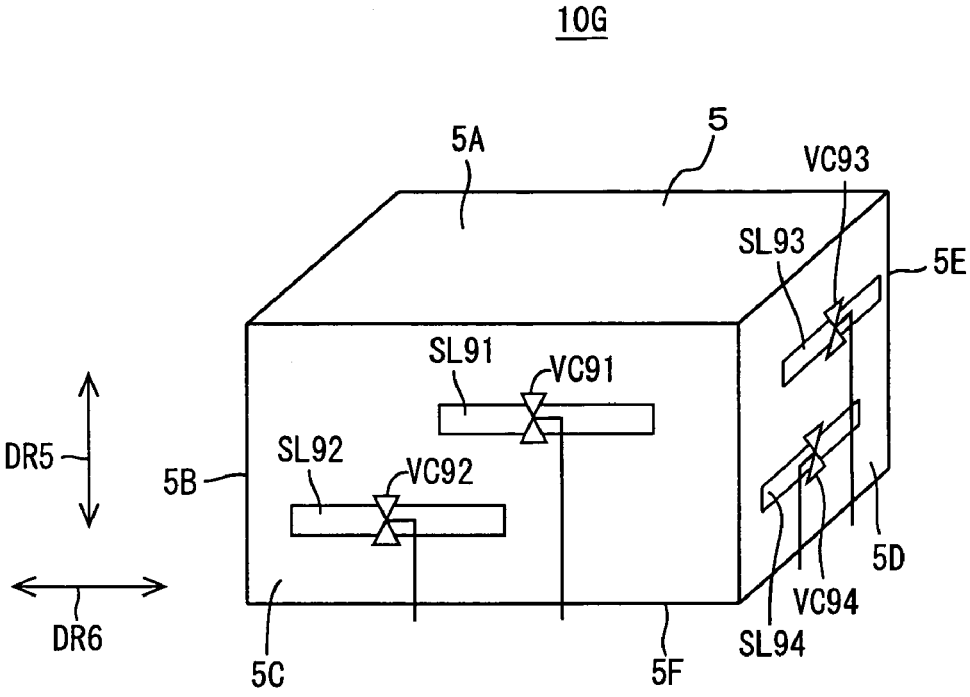

FIG. 22 is yet another conceptual view of the array antenna. The array antenna according to Embodiment 1 may be implemented by an array antenna 10G shown in FIG. 22. Array antenna 10G includes feeder element 3C, cavity conductor 5, slot lines SL91 to SL94, and variable capacitance elements VC91 to VC94. It is noted that feeder element 3C is not shown in FIG. 22.

Slot lines SL91, SL92 are provided substantially in parallel along a direction DR6 perpendicular to up-down direction DR5 on side surface 5C of cavity conductor 5, while slot lines SL93, SL94 are provided substantially in parallel along a direction DR6 perpendicular to up-down direction DR5 on side surface 5D of cavity conductor 5.

Variable capacitance elements VC91 to VC94 are loaded to slot lines SL91 to SL94 respectively. Each of variable capacitance elements VC91 to VC94 has a structure the same as that of variable capacitance element VC1 shown in FIG. 4. Feeder element 3C is provided inside cavity conductor 5 in a manner perpendicular to bottom surface 5F of cavity conductor 5.

Though two slot lines having the variable capacitance elements loaded respectively are provided substantially in parallel to each other in a manner similar to slot lines SL91, SL92 on side surfaces 5B, 5E of cavity conductor 5, they are not shown in FIG. 22.

Feeder element 3C generates electric field orthogonal to slot lines SL91 to SL94. Therefore, array antenna 10G can emit a radio wave from slot lines SL91 to SL94.

It is noted that any one of feeder elements 3, 3A and 3B may be employed instead of feeder element 3C, or scatterer 33 shown in FIG. 14 may be added in array antenna 10G.

Figure 23:
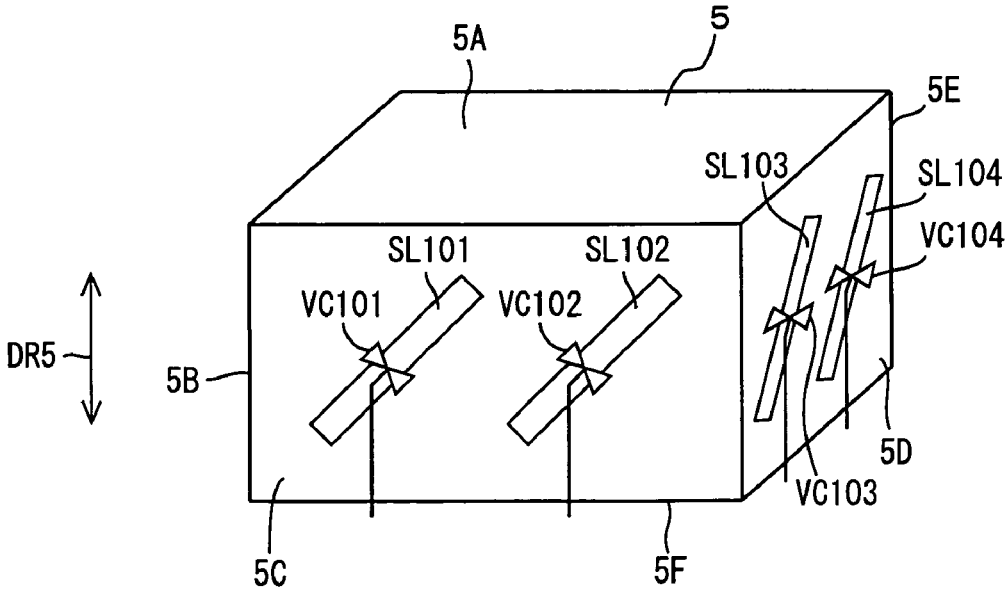

FIG. 23 is yet another conceptual view of the array antenna. The array antenna according to Embodiment 1 may be implemented by an array antenna 10H shown in FIG. 23. Array antenna 10H includes feeder element 3C, cavity conductor 5, slot lines SL101 to SL104, and variable capacitance elements VC101 to VC104. It is noted that feeder element 3C is not shown in FIG. 23.

Slot lines SL101, SL102 are provided substantially in parallel to each other and diagonally with respect to up-down direction DR5 on side surface 5C of cavity conductor 5, while slot lines SL103, SL104 are provided substantially in parallel to each other and diagonally with respect to up-down direction DR5 on side surface 5D of cavity conductor 5.

Variable capacitance elements VC101 to VC104 are loaded to slot lines SL101 to SL104 respectively. Each of variable capacitance elements VC101 to VC104 has a structure the same as that of variable capacitance element VC1 shown in FIG. 4. Feeder element 3C is provided inside cavity conductor 5 in a manner perpendicular to bottom surface 5F of cavity conductor 5.

Though two slot lines having the variable capacitance elements loaded respectively are provided on side surfaces 5B, 5E of cavity conductor 5 substantially in parallel to each other in a manner similar to slot lines SL101, SL102, they are not shown in FIG. 23.

Feeder element 3C generates electric field intersecting with slot lines SL101 to SL104. Therefore, array antenna 10H can emit a radio wave from slot lines SL101 to SL104.

It is noted that any one of feeder elements 3, 3A and 3B may be employed instead of feeder element 3C, or scatterer 33 shown in FIG. 14 may be added in array antenna 10H.

Figure 24:
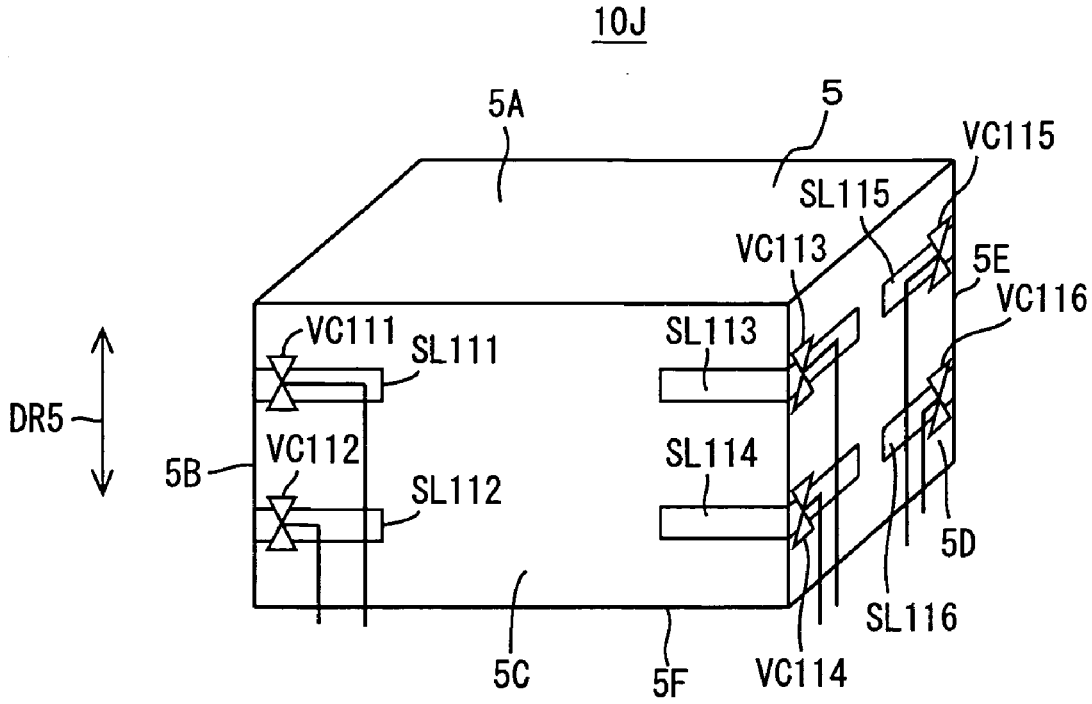

FIG. 24 is yet another conceptual view of the array antenna. The array antenna according to Embodiment 1 may be implemented by an array antenna 10J shown in FIG. 24. Array antenna 10J includes feeder element 3C, cavity conductor 5, slot lines SL111 to SL116, and variable capacitance elements VC111 to VC116. It is noted that feeder element 3C is not shown in FIG. 24.

Slot lines SL111, SL112 are provided on side surfaces 5B and 5C of cavity conductor 5 in a bent manner. Slot lines SL113, SL114 are provided on side surfaces 5C and 5D of cavity conductor 5 in a bent manner. Slot lines SL115, SL116 are provided on side surfaces 5D and 5E of cavity conductor 5 in a bent manner.

Variable capacitance elements VC111 to VC116 are loaded to slot lines SL111 to SL116 respectively. Each of variable capacitance elements VC111 to VC116 has a structure the same as that of variable capacitance element VC1 shown in FIG. 4. Feeder element 3C is provided inside cavity conductor 5 in a manner perpendicular to bottom surface 5F of cavity conductor 5.

Feeder element 3C generates such electric field that a current flows in up-down direction DR5 on side surfaces 5B, 5C, 5D, and 5E of cavity conductor 5. Therefore, array antenna 10J can emit a radio wave from slot lines SL111 to SL116.

It is noted that any one of feeder elements 3, 3A and 3B may be employed instead of feeder element 3C, or scatterer 33 shown in FIG. 14 may be added in array antenna 10J.

Figure 25:
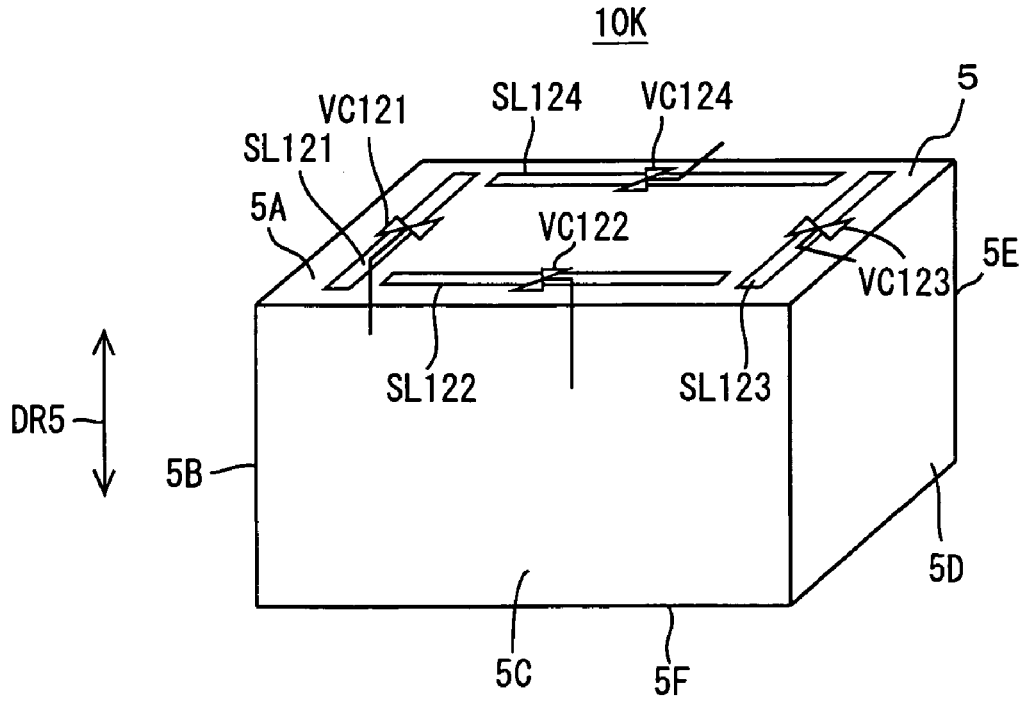

FIG. 25 is yet another conceptual view of the array antenna. The array antenna according to Embodiment 1 may be implemented by an array antenna 10K shown in FIG. 25. Array antenna 10K includes feeder element 3C, cavity conductor 5, slot lines SL121 to SL124, and variable capacitance elements VC121 to VC124. It is noted that feeder element 3C is not shown in FIG. 25.

Slot lines SL121 to SL124 are provided on upper surface 5A of cavity conductor 5 so as to substantially form a square.

Variable capacitance elements VC121 to VC124 are loaded to slot lines SL121 to SL124 respectively. Each of variable capacitance elements VC121 to VC124 has a structure the same as that of variable capacitance element VC1 shown in FIG. 4. Feeder element 3C is provided inside cavity conductor 5 in a manner perpendicular to bottom surface 5F of cavity conductor 5.

Feeder element 3C generates electric field intersecting with slot lines SL121 to SL124. Therefore, array antenna 10K can emit a radio wave from slot lines SL121 to SL124.

In array antenna 10K, slot lines SL121 to SL124 and variable capacitance elements VC121 to VC124 may be provided on bottom surface 5F, or on both upper surface 5A and bottom surface 5F. In general, in array antenna 10K, slot lines SL121 to SL124 and variable capacitance elements VC121 to VC124 may be provided on at least one of pairs of surfaces (side surfaces 5B and 5D, side surfaces 5C and 5E, and side surfaces 5A and 5F).

It is noted that any one of feeder elements 3, 3A and 3B may be employed instead of feeder element 3C, or scatterer 33 shown in FIG. 14 may be added in array antenna 10K.

Figure 26:
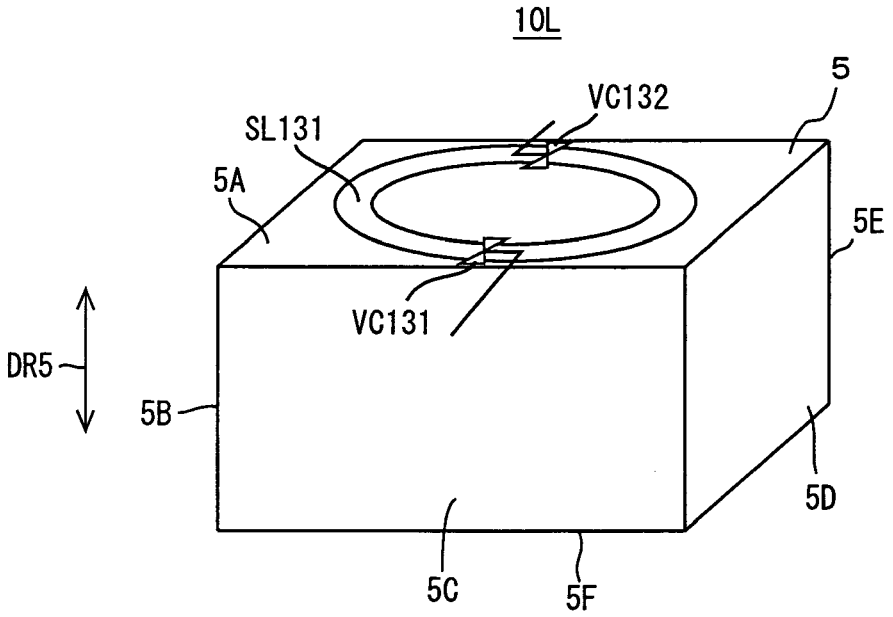

FIG. 26 is yet another conceptual view of the array antenna. The array antenna according to Embodiment 1 may be implemented by an array antenna 10L shown in FIG. 26. Array antenna 10L includes feeder element 3C, cavity conductor 5, slot line SL131, and variable capacitance elements VC131 and VC132. It is noted that feeder element 3C is not shown in FIG. 26.

Slot line SL131 has a substantially annular shape, and is arranged on upper surface 5A of cavity conductor 5. Variable capacitance elements VC131, VC132 are loaded to slot line SL131. Each of variable capacitance elements VC131, VC132 has a structure the same as that of variable capacitance element VC1 shown in FIG. 4. Feeder element 3C is provided inside cavity conductor 5 in a manner perpendicular to bottom surface 5F of cavity conductor 5.

Feeder element 3C generates electric field intersecting with slot line SL131. Therefore, array antenna 10L can emit a radio wave from slot line SL131.

In array antenna 10L, slot line SL131 and variable capacitance elements VC131, VC132 may be provided on bottom surface 5F, or on both upper surface 5A and bottom surface 5F. In general, in array antenna 10L, slot line SL131 and variable capacitance elements VC131, VC132 may be provided on at least one of pairs of surfaces (side surfaces 5B and 5D, side surfaces 5C and 5E, and side surfaces 5A and 5F).

It is noted that any one of feeder elements 3, 3A and 3B may be employed instead of feeder element 3C, or scatterer 33 shown in FIG. 14 may be added in array antenna 10L.

[Variation of Slot Line]

Figure 27:
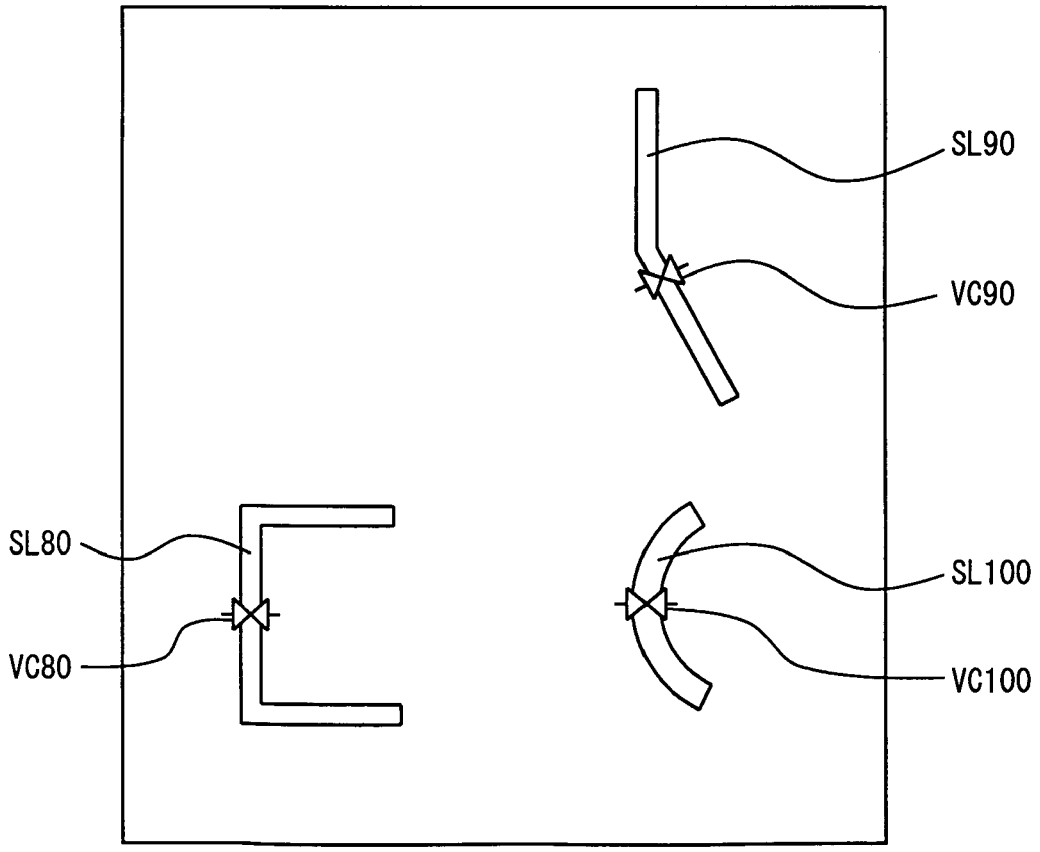
FIG. 27 shows a variation of the slot line.

FIG. 27 shows a variation of the slot line. In the present invention, the slot line may be implemented by any one of slot lines SL80, SL90 and SL100 shown in FIG. 27.

Slot line SL80 has a substantial cup shape, and slot line SL90 has a bent shape. In addition, slot line SL100 has an arc shape. Slot lines SL80, SL90 and SL100 have variable capacitance elements VC80, VC90, and VD100 loaded, respectively. Here, variable capacitance elements VC80, VC90, and VD100 may be loaded to any position, so long as they are loaded on slot lines SL80, SL90 and SL100 respectively. Each of variable capacitance elements VC80, VC90, and VD100 has a structure the same as that of variable capacitance element VC1 shown in FIG. 4.

Array antennas 10, 10A, 10B, 10C, 10D, 10E, 10F, 10G, 10H, 10J, 10K, and 10L described above may include any one of slot lines SL80, SL90 and SL100.

The array antenna according to Embodiment 1 should only include at least one slot line. The variable capacitance elements do not need to be loaded to all slot lines, and it should only be loaded in at least one slot line that has been provided.

Though the cavity conductor having a cylindrical shape or a cubic shape has been described above, the cavity conductor generally should have a polyhedral shape in the present invention.

Embodiment 2

Figure 28:
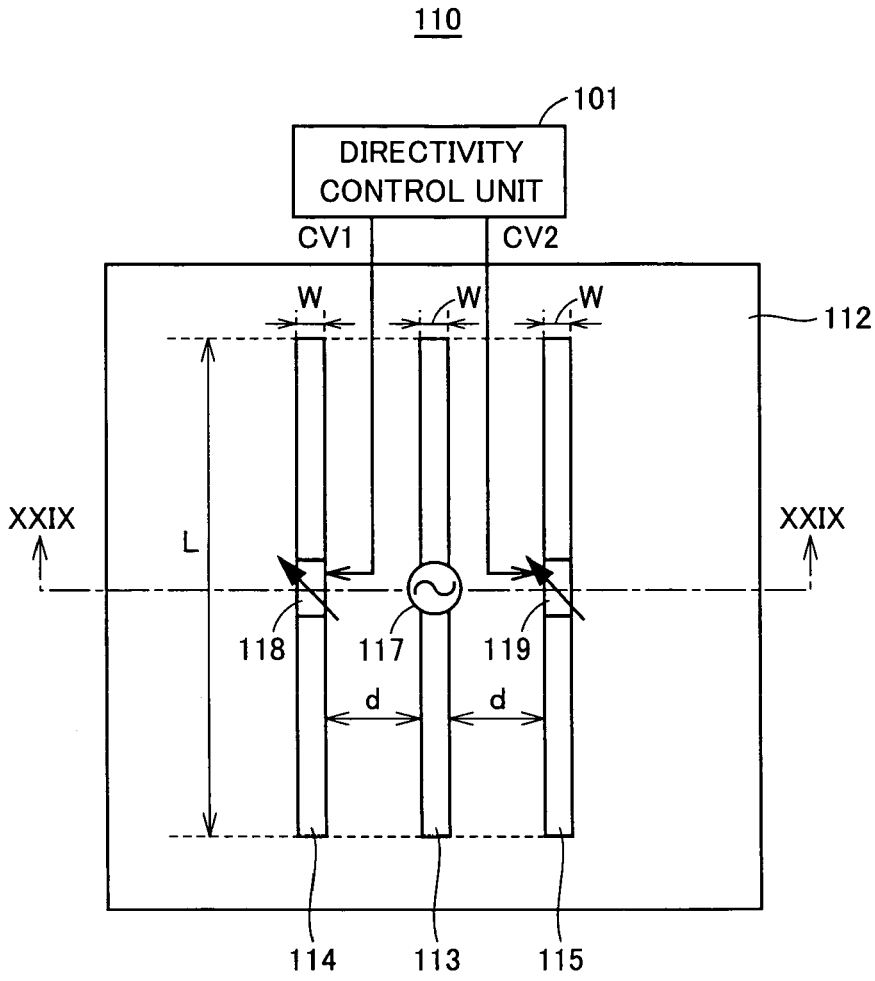
FIG. 28 is a plan view of the array antenna according to Embodiment 2.
Figure 29:
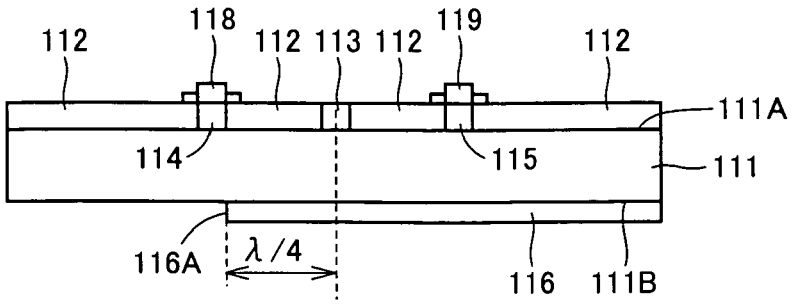
FIG. 29 is a cross-sectional view of the array antenna along the line XXIX—XXIX shown in FIG. 28.

FIG. 28 is a plan view of the array antenna according to Embodiment 2, and FIG. 29 is a cross-sectional view of the array antenna along the line XXIX—XXIX shown in FIG. 28. An array antenna 110 according to Embodiment 2 includes a dielectric substrate 111, slot lines 113 to 115, a microstrip line 116, a feeder unit 117, varactor diodes 118, 119, and a directivity control unit 101.

Dielectric substrate 111 has a substantially rectangular two-dimensional shape. A conductor 112 is adhered on an entire one main surface 111A of dielectric substrate 111, and slot lines 113 to 115 are formed by removing a prescribed portion of conductor 112. Here, all of slot lines 113 to 115 have an equal length L and an equal width W, and the slot lines are provided substantially in parallel to one side of the rectangle. Slot line 114 and slot line 115 are arranged symmetrically around slot line 113. Here, an interval d between slot line 113 and slot lines 114, 115 is set, for example, to ¼ of a wavelength λ of a radio wave used in the antenna.

Microstrip line 116 is formed on one main surface 111B on a side opposite to one main surface 111A so as to be orthogonal to slot lines 113 to 115. Here, microstrip line 116 is formed such that a distance between the center of slot line 113 and one end 116A is set to λ/4. As a result, microstrip line 116 serves to feed power to feeder unit 117 of slot line 113.

Varactor diode 118 is connected between conductors on opposing sides of slot line 114. Meanwhile, varactor diode 119 is connected between conductors on opposing sides of slot line 115. Consequently, slot lines 114, 115 have the variable capacitance elements loaded.

In array antenna 110, slot lines 113 serves as a feeder element, while slot lines 114, 115 serve as parasitic elements. Parasitic elements 114, 115 are short-circuited when capacitances of varactor diodes 118, 119 attain maximum values by control voltages CV1, CV2 respectively, that is, they are not excited. Meanwhile, parasitic elements 114, 115 are open-circuited when capacitances of varactor diodes 118, 119 attain minimum values by control voltages CV1, CV2 respectively, that is, they are excited.

Directivity control unit 101 supplies control voltages CV1, CV2 to varactor diodes 118, 119 respectively, so as to vary the capacitances of varactor diodes 118, 119. Control voltages CV1, CV2 are set to voltages Va, Vb. Here, voltages Va, Vb are set so as to control the capacitances of varactor diodes 118, 119 in a range from a minimum value to a maximum value.

Directivity control unit 101 supplies [CV1=Va, CV2=Vb] or [CV1=Vb, CV2=Va] to varactor diodes 118, 119. In this manner, a combination of reactance values Xa, Xb loaded to slot lines 114, 115 is changed. In other words, directivity control unit 101 changes a combination of reactance values Xa, Xb (capacitance) loaded to slot lines 114, 115, so as to control directivity of array antenna 110.

Figure 30A:
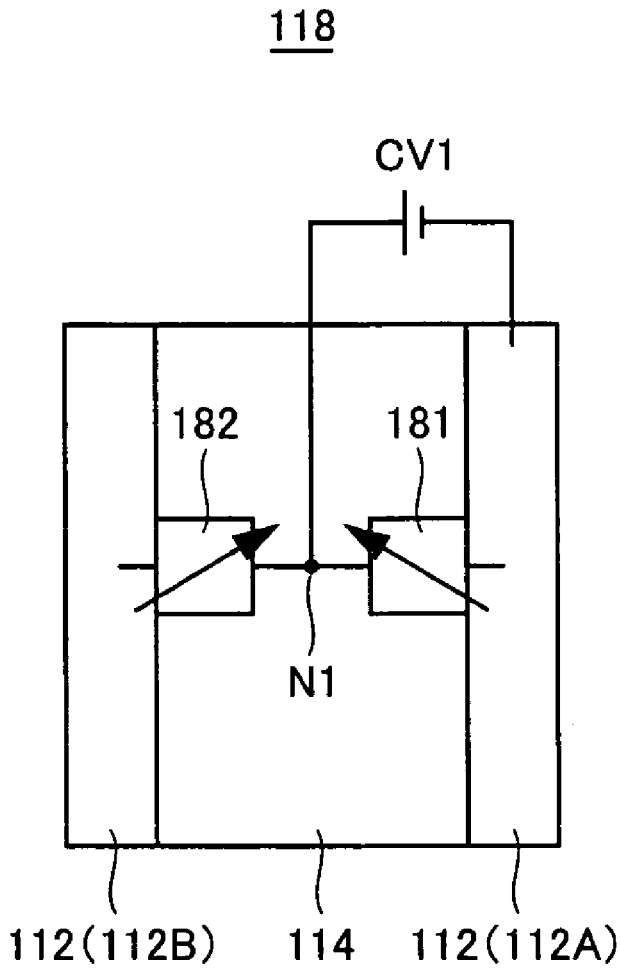
FIGS. 30A and 30B illustrate in detail a method of connecting a varactor diode shown in FIGS. 28 and 29.
Figure 30B:
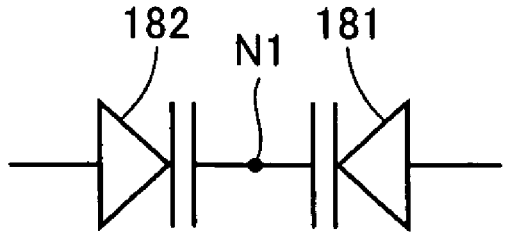

FIGS. 30A and 30B illustrate in detail a method of connecting a varactor diode 118 shown in FIGS. 28 and 29. Varactor diode 118 consists of a pair of varactor diodes 181, 182. Varactor diodes 181, 182 are connected in an anti-serial manner between conductors 112A and 112B present on opposing sides of slot line 114. Varactor diode 181 receives control voltage CV1 between node N1 between varactor diodes 181, 182 and conductor 112A. Here, control voltage CV1 is applied such that node N1 side attains a positive potential. As a result, since conductor 112A is short-circuited to conductor 112B in such a manner that a direct current flows, control voltage CV1 is also applied to varactor diode 182 such that a node N1 side attains a positive potential.

Therefore, by connecting two varactor diodes 181, 182 between conductors 112A, 112B arranged on opposing sides of slot line 114 in an anti-serial manner, application of control voltage CV1 to two varactor diodes 181, 182 is facilitated.

The description with regard to varactor diode 118 above is also applicable to varactor diode 119 of slot line 115.

It is noted that positions of varactor diodes 181, 182 may be reversed in a left-right direction of FIG. 30B, and varactor diodes 181, 182 may be connected in an anti-serial manner. Here, node N1 is biased to a negative potential.

FIGS. 31A to 31I illustrate comparison of an antenna including slots with an antenna including conductors. An antenna 120 has a slot line 121, and transmits a radio wave having a polarization direction 124 (see FIG. 31A). Antenna 120 emits a radio wave in two directions perpendicular to a dielectric substrate 122 unless a metal is present in the vicinity (see FIG. 31B).

Figure 31A:
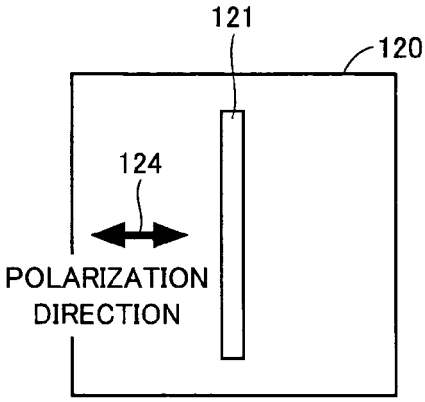
FIGS. 31A to 31I illustrate comparison of an antenna including slots with an antenna including conductors.
Figure 31B:
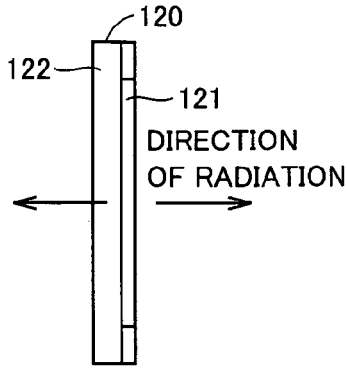
Figure 31C:
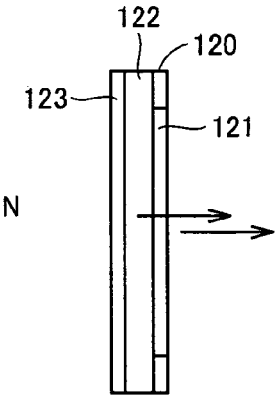

In addition, when a base plate 123 made of metal is provided on a side opposite to slot line 121 assuming dielectric substrate 122 as the center, antenna 120 emits a radio wave to slot line 121 in a direction perpendicular to dielectric substrate 122 (see FIG. 31C). In this manner, antenna 120 including slot line 121 can emit a radio wave even if it is disposed in the vicinity of the metal (base plate 123).

Figure 31D:
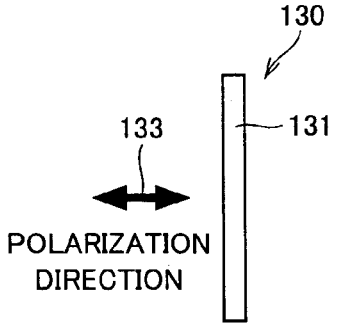
Figure 31E:
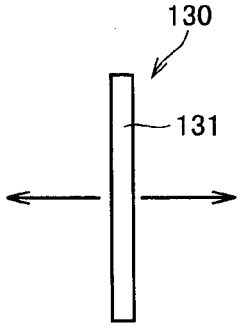
Figure 31F:
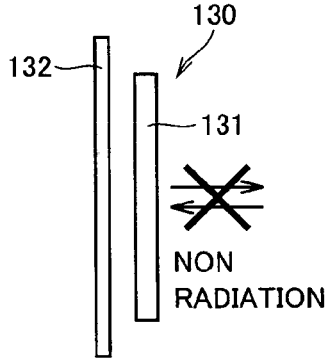

On the other hand, an antenna 130 shown in FIG. 31D is made of a conductor 131, and antenna 130 transmits a radio wave having a polarization direction 133. If metal is not present in the vicinity, antenna 130 emits a radio wave in a direction perpendicular to a longitudinal direction of conductor 131 (see FIG. 31E). On the other hand, if base plate 132 made of metal is present in the vicinity, antenna 130 does not emit a radio wave (see FIG. 31F). In this manner, antenna 130 made of conductor 131 cannot emit a radio wave if metal is present in the vicinity.

Figure 31G:
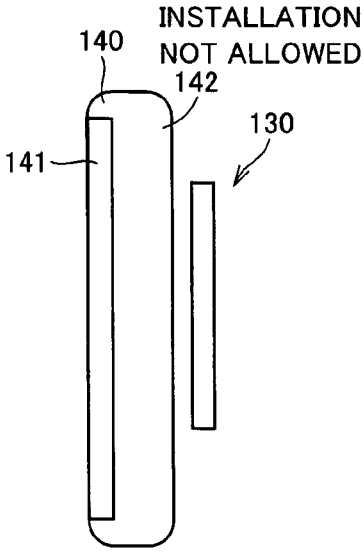
Figure 31H:
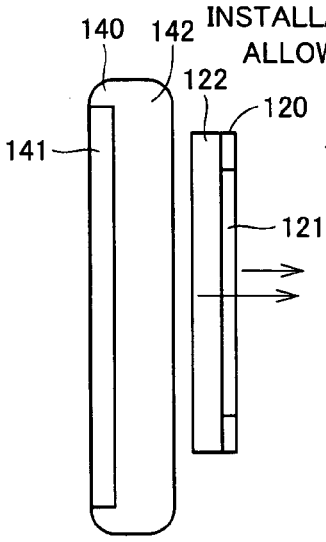
Figure 31I:
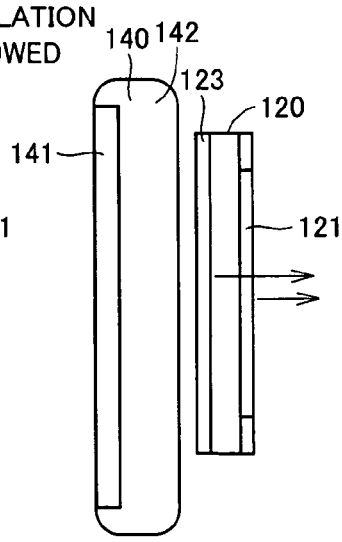
Figure 32A:
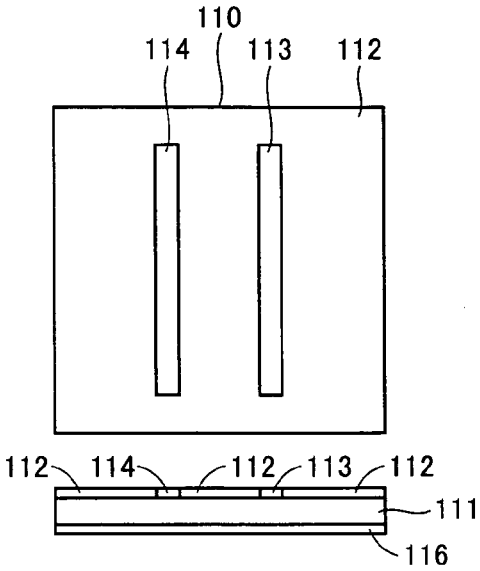
FIGS. 32A to 32D illustrate characteristics of the array antenna shown in FIGS. 28 and 29.
Figure 32B:
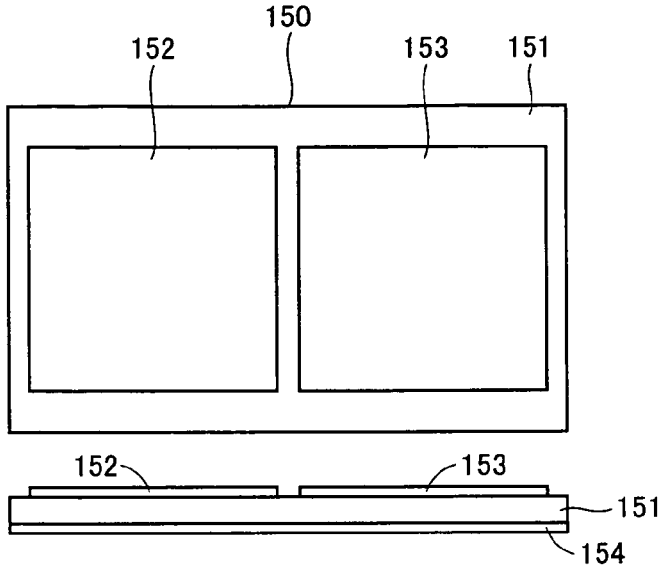
Figure 32C:
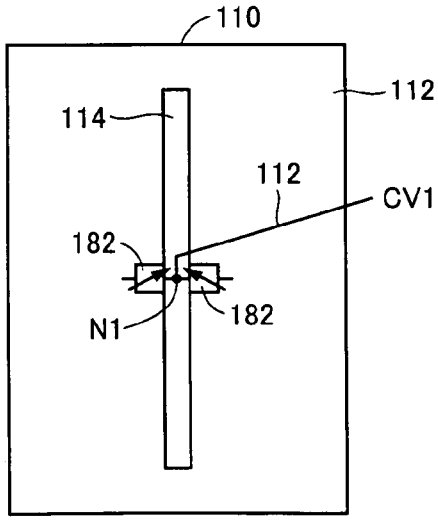
Figure 32D:
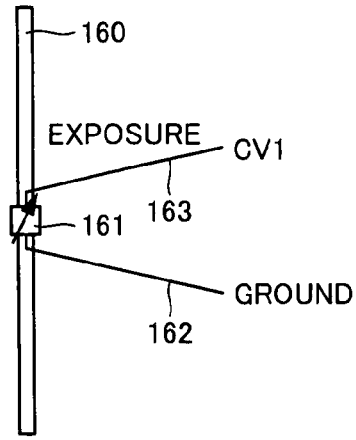

As shown in FIG. 31G, a liquid crystal display device 140 includes a liquid crystal display screen 141 and a metal portion 142. As antenna 130 does not emit a radio wave when it is disposed in the vicinity of the metal, antenna 130 cannot be installed in the vicinity of metal portion 142 of liquid crystal display device 140. In contrast, as antenna 120 can emit a radio wave regardless of presence/absence of metal plate 123, antenna 120 can be installed in the vicinity of metal portion 142 of liquid crystal display device 140 (see FIGS. 31H and 31I).

Therefore, array antenna 110 including slot lines 113 to 115 can be installed in the vicinity of metal portion 142 and can be mounted on a back surface of liquid crystal display device 140.

FIGS. 32A to 32D illustrate characteristics of array antenna 110 shown in FIGS. 28 and 29. As array antenna 110 includes slot lines 113, 114 (slot line 115 is not shown in FIGS. 32A to 32D), an area for arranging elements can be reduced (see FIG. 32A).

On the other hand, a patch antenna 150 includes a dielectric substrate 151, radiating elements 152, 153, and a feeder element 154. Radiating elements 152, 153 are formed on one main surface of dielectric substrate 151, while feeder element 154 is formed on a side opposite to one main surface of dielectric substrate 151. Radiating elements 152, 153 have a substantially square shape. Therefore, an area for arranging elements is large in patch antenna 150 (see FIG. 32B).

In this manner, array antenna 110 is characterized by an area for arranging elements smaller than in patch antenna 150.

In array antenna 110, varactor diodes 181, 182 are connected between conductors 112, 112 present on opposing sides of slot line 114 in the anti-serial manner. When control voltage CV1 is applied between node N1 between varactor diodes 181, 182 and conductor 112, control voltage CV1 is applied to two varactor diodes 181, 182. Therefore, it is not necessary to provide a ground line, and a line 102 for supplying control voltage CV1 to node N1 can be formed on conductor 112, thereby avoiding exposure of line 102 to air (see FIG. 32C).

On the other hand, when a varactor diode 161 is connected to a conductor 160, it is necessary to provide a ground line 162, and a line 163 for supplying control voltage CV1 to varactor diode 160 should also be provided. As a result, line 163 is exposed to air.

In this manner, array antenna 110 is also characterized in that it is not necessary to provide a ground line and that a line for supplying control voltage CV1 is not exposed to air.

Figure 33:
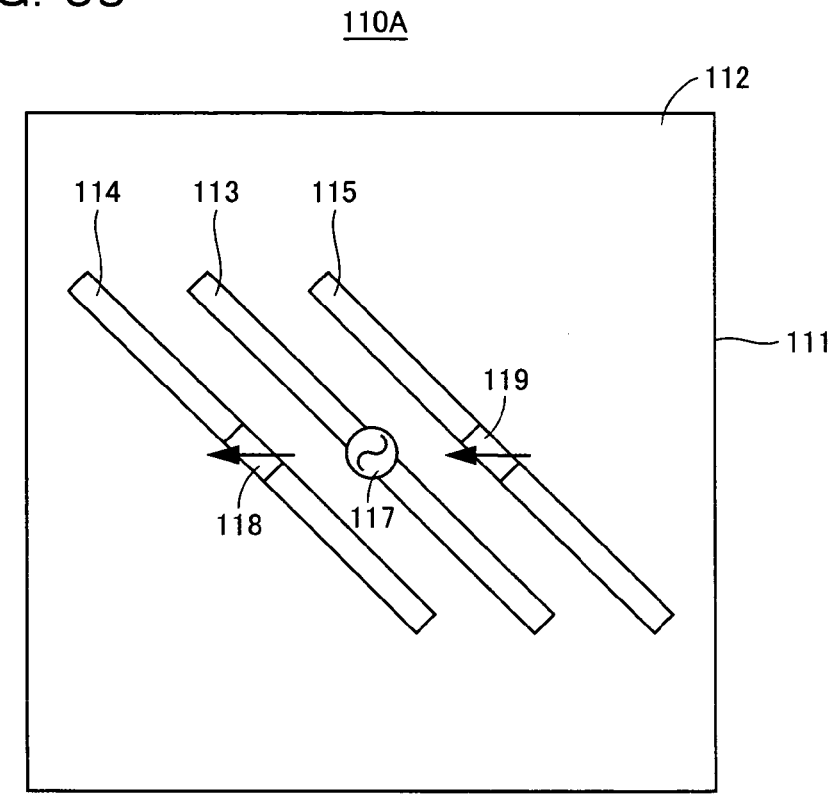
FIG. 33 is another plan view of the array antenna according to Embodiment 2.

FIG. 33 is another plan view of the array antenna according to Embodiment 2. An array antenna 110A is obtained by arranging slot lines 113 to 115 at a prescribed angle with respect to one side of dielectric substrate 111 in array antenna 110. Array antenna 110A is otherwise the same as array antenna 110.

In this manner, in Embodiment 2, slot lines 113 to 115 may be arranged diagonally to one side of the dielectric substrate.

Figure 34:
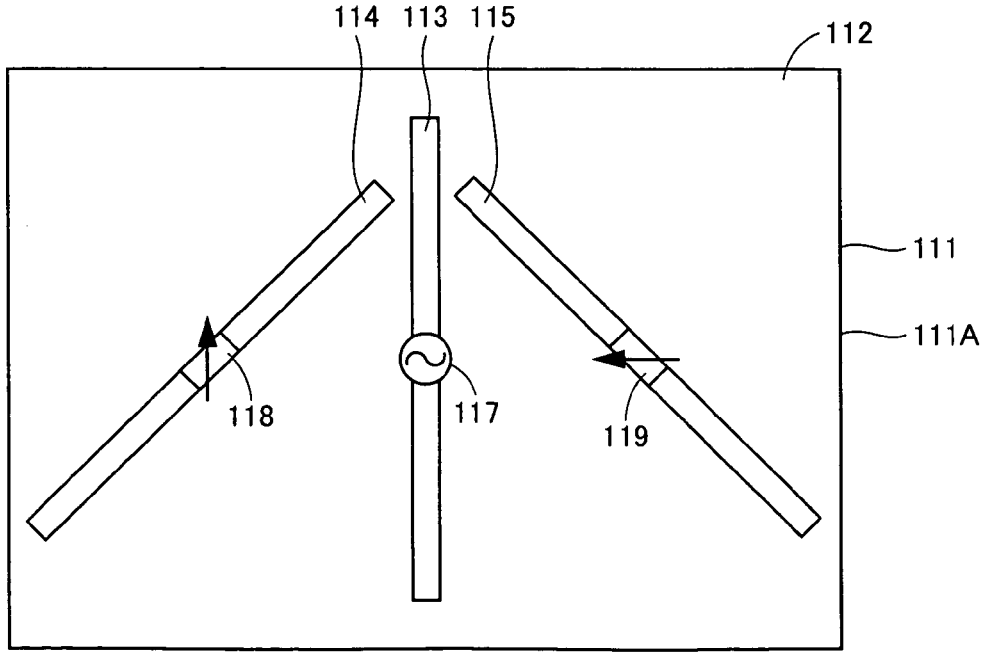
FIG. 34 is yet another plan view of the array antenna according to Embodiment 2.
Figure 35A:
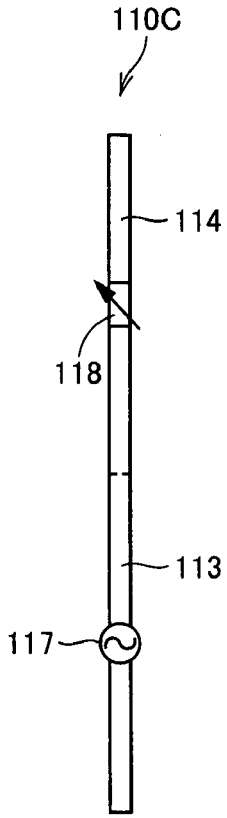
FIGS. 35A to 35E are further plan views of the array antenna according to Embodiment 2.
Figure 35B:
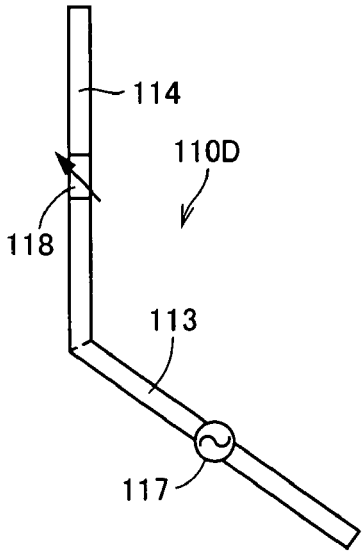
Figure 35C:
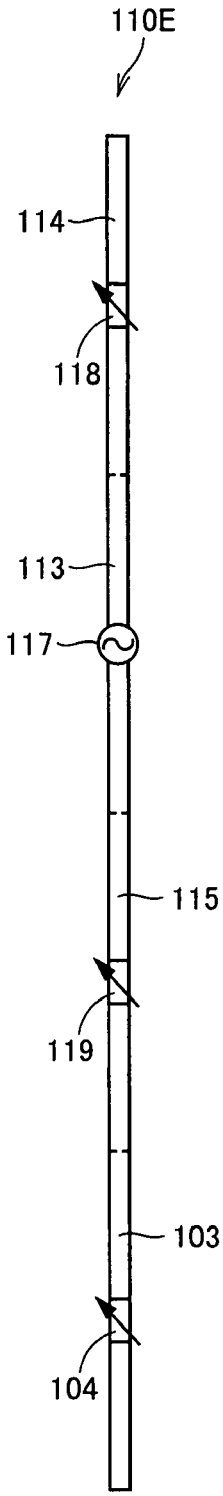
Figure 35D:
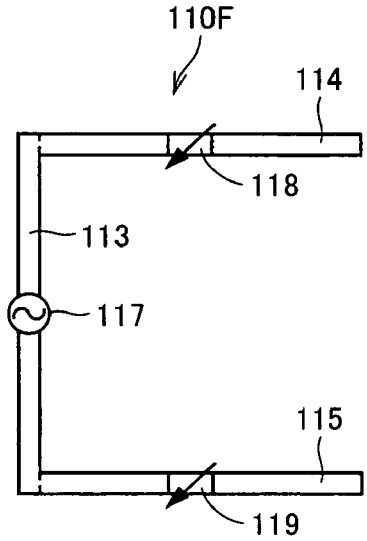
Figure 35E:
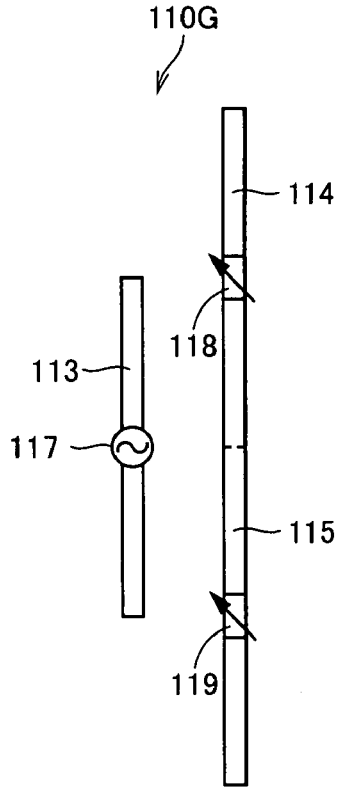

FIG. 34 is yet another plan view of the array antenna according to Embodiment 2. An array antenna 110B is obtained by arranging slot line 113 substantially in parallel to one side 111A of dielectric substrate 111 and by arranging slot lines 114, 115 at a prescribed angle with respect to one side 111A. Array antenna 110B is otherwise the same as array antenna 110. Here, slot line 114 and slot line 115 are arranged symmetrically around slot line 113. Interval d between centers of respective slots is set to $\lambda/4$.

FIGS. 35A to 35E are further plan views of the array antenna according to Embodiment 2. An array antenna 110C includes slot lines 113, 114. Slot lines 113 and 114 are arranged linearly, so as to implement one slot. In this manner, array antenna 110C is implemented by a linear one slot having feeder unit 117 and varactor diode 118 provided (see FIG. 35A).

An array antenna 110D includes slot lines 113 and 114. In array antenna 110D, slot lines 113, 114 are arranged so as to form a bent shape, thereby implementing one slot. In other words, slot lines 113 and 114 are arranged so as to define a prescribed angle therebetween. In this manner, array antenna 110D is implemented by a bent slot having feeder unit 117 and varactor diode 118 provided (see FIG. 35B).

An array antenna 110E includes slot lines 113, 114, 115, and 103. Slot line 103 has a length L and a width W the same as those of slot lines 113 to 115, and slot line 103 is connected to varactor diode 104. Varactor diode 104 has a structure the same as that of varactor diode 118, and is connected between conductors 112, 112 in a manner similar to varactor diode 118. Slot lines 113, 114, 115, and 103 are linearly arranged, so as to implement one slot. In other words, array antenna 110E is implemented by one slot having one feeder unit 117 and three varactor diodes 118, 119 and 104 provided (see FIG. 35C).

An array antenna 110F includes slot lines 113, 114, and 115. Slot lines 113, 114 and 115 are arranged in a substantial cup shape, so as to implement one slot. In this manner, array antenna 110F is implemented by one slot in a substantial cup shape having one feeder unit 117 and two varactor diodes 118, 119 provided (see FIG. 35D).

An array antenna 110G includes slot lines 113, 114, and 115. Slot lines 114, 115 are linearly arranged so as to implement one slot. Slot line 113 is arranged substantially in parallel to linearly connected slot lines 114, 115. In this manner, array antenna 110G is implemented by one slot (slot line 113) having feeder unit 117 provided and one slot (linearly arranged slot lines 114, 115) having two varactor diodes 118, 119 loaded (see FIG. 35E).

Figure 36:
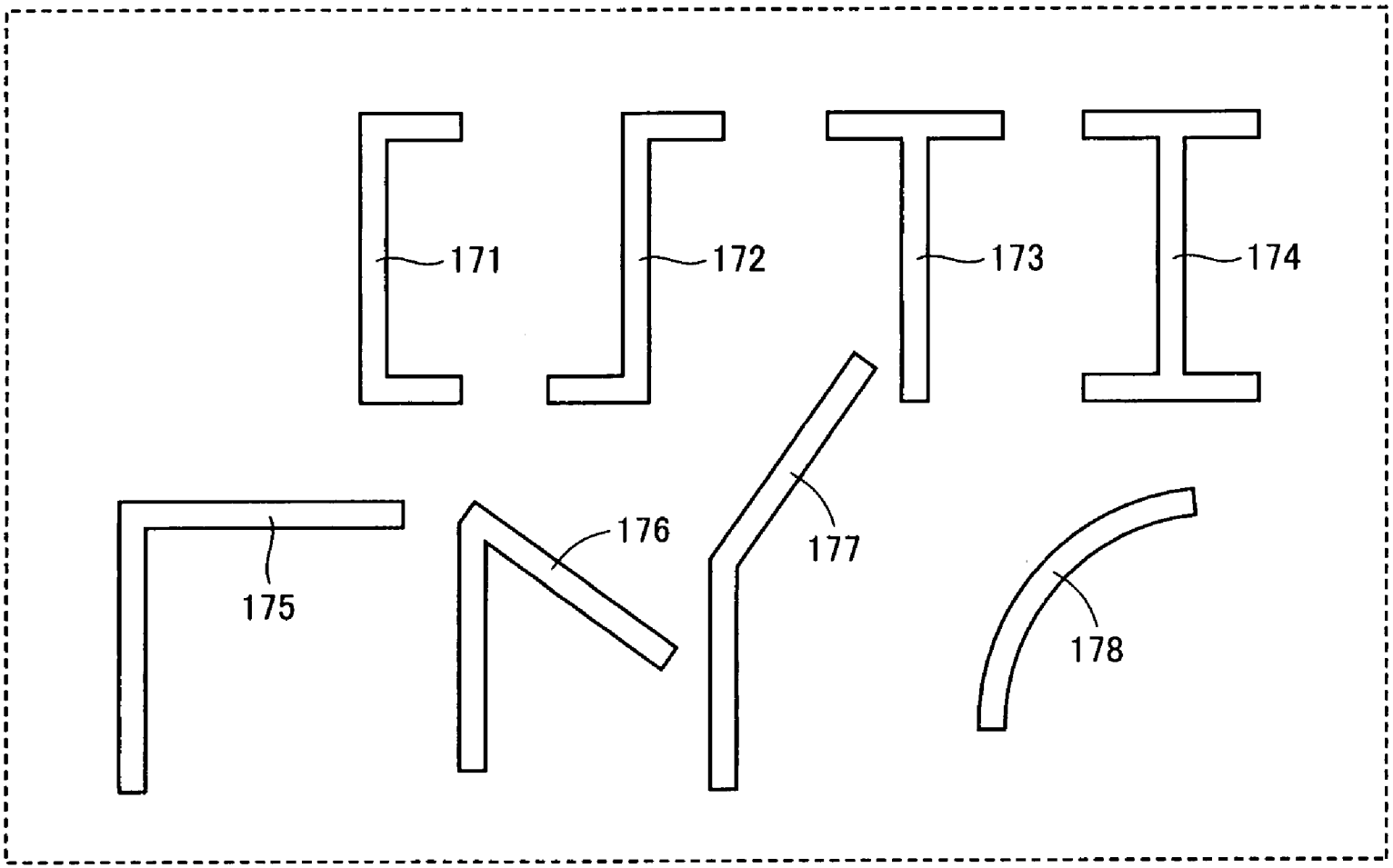
FIG. 36 shows another two-dimensional shape of the slot line in Embodiment 2.

FIG. 36 shows other two-dimensional shapes of the slot lines in Embodiment 2. In FIGS. 35A to 35E shown above, slot lines 113, 114, 115, and 103 have been described as slot lines having a linear shape of length L and width W. In the present invention, however, slot lines 113, 114, 115, and 103 are implemented by any of slot lines 171 to 178 shown in FIG. 36.

Figure 37:
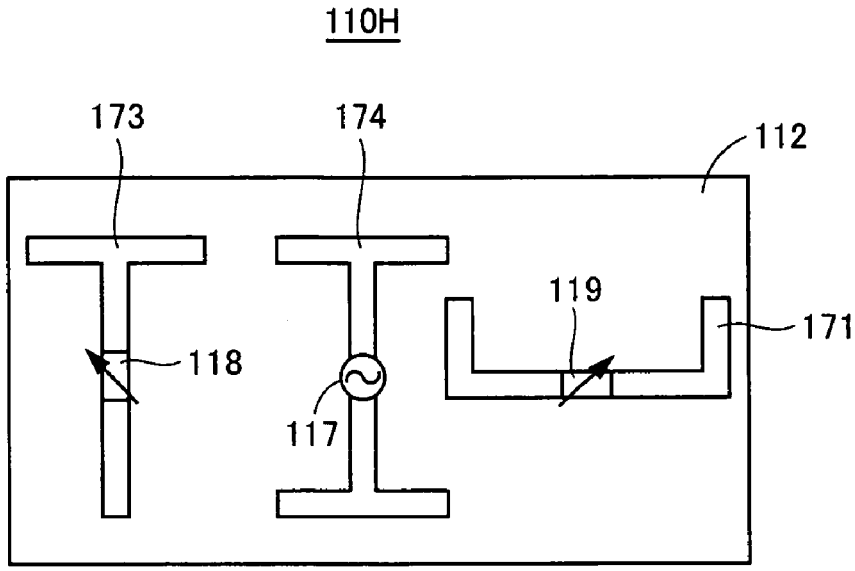
FIG. 37 is a plan view of the array antenna using a variety of slots shown in FIG. 36.

FIG. 37 is a plan view of the array antenna using a variety of slots shown in FIG. 36. An array antenna 110H is obtained by replacing slot lines 113, 114 and 115 of array antenna 110 with slot lines 174, 173 and 171 respectively, and array antenna 110H is otherwise the same as array antenna 110. Slot line 174 has feeder unit 117, and slot lines 173, 171 are connected to varactor diodes 118, 119 respectively.

Figure 38:
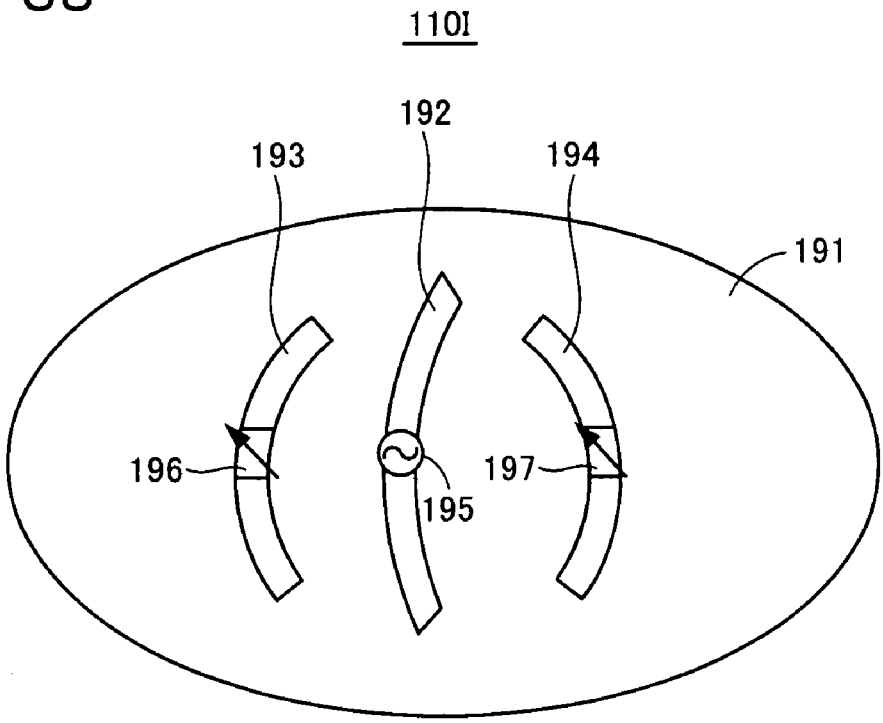
FIG. 38 is yet another plan view of the array antenna according to Embodiment 2.

FIG. 38 is yet another plan view of the array antenna according to Embodiment 2. An array antenna 110I includes a conductor 191 provided on a surface of a dielectric having a spherical shape (a curved surface), as well as slot lines 192 to 194. Slot line 192 has a feeder unit 195, and slot lines 193, 194 are connected to varactor diodes 196, 197 respectively. Each of varactor diodes 196, 197 consists of two varactor diodes 181, 182 connected between conductors 191, 191 in the anti-serial manner, in a manner similar to varactor diode 118.

As described above, the array antenna according to Embodiment 2 can be formed also on a curved surface.

Embodiment 3

Figure 39:
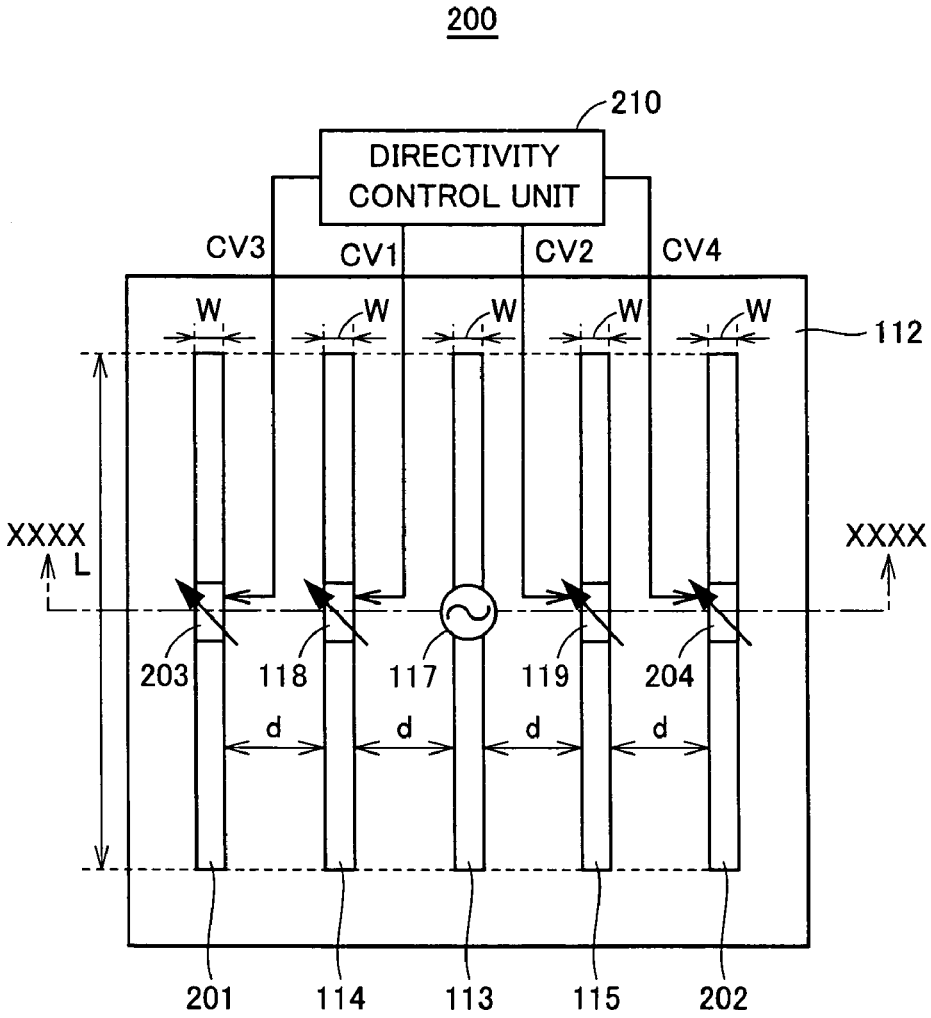
FIG. 39 is a plan view of an array antenna according to Embodiment 3.
Figure 40:
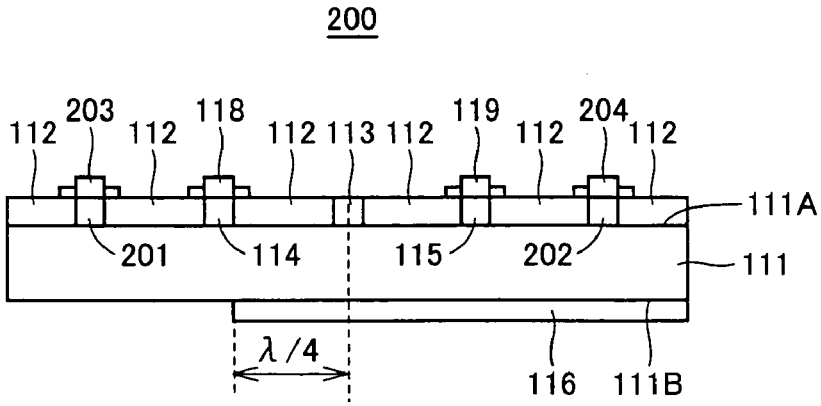
FIG. 40 is a cross-sectional view of the array antenna along the line XXXX—XXXX shown in FIG. 39.

FIG. 39 is a plan view of an array antenna according to Embodiment 3, while FIG. 40 is a cross-sectional view of the array antenna along the line XXXX—XXXX shown in FIG. 39.

An array antenna 200 according to Embodiment 3 is obtained by replacing directivity control unit 101 of array antenna 110 shown in FIGS. 28 and 29 with a directivity control unit 210 and by adding slot lines 201, 202 and varactor diodes 203, 204. Array antenna 200 is otherwise the same as array antenna 110.

Slot lines 201, 202 have a length L and a width W the same as those of slot lines 113, 114 and 115, and slot lines 201, 202 are provided in parallel to slot lines 113, 114 and 115. Slot line 201 is arranged on the left of slot line 114, while slot line 202 is arranged on the right of slot line 115. In addition, an interval between slot line 201 and slot line 114 and an interval between slot line 202 and slot line 115 are set to interval d (=λ/4) as described above.

Varactor diodes 203, 204 are connected between conductors 112, 112 present on opposing sides of slot lines 201, 202 respectively, in a manner similar to varactor diodes 118, 119. Each of varactor diodes 203, 204 consists of varactor diodes 181, 182 connected between conductors 112, 112 in the anti-serial manner. Therefore, slot lines 201, 202 implement parasitic elements.

Directivity control unit 210 supplies control voltages CV1 to CV4 to varactor diodes 118, 119, 203, and 204 respectively, so as to control directivity of array antenna 200. More specifically, directivity control unit 210 determines a set of control voltages CV1 to CV4 optimizing a reception signal, and applies the determined set of control voltages CV1 to CV4 to varactor diodes 118, 119, 203, and 204.

In this case, whether or not the reception signal is optimal is determined based on whether reception signal strength is not smaller than a threshold value, for example. Accordingly, directivity control unit 210 receives the reception signal strength from a demodulation processing unit (not shown), determines a set of control voltages CV1 to CV4 attaining the received reception signal strength not smaller than a threshold value, and applies the determined set of control voltages CV1 to CV4 to varactor diodes 118, 119, 203, and 204. In this manner, directivity of array antenna 200 is controlled so as to optimize the reception signal.

As described above, in array antenna 200, an equal number of parasitic elements (slot lines 114, 201 and slot lines 115, 202) are disposed on opposing sides of the feeder element (slot line 113), respectively. In other words, a plurality of parasitic elements (slot lines 114, 115, 201, 202) are arranged symmetrically around feeder element 113, and directivity is controlled so as to optimize the reception signal.

In array antenna 200, modification similar to modification applied to array antenna 110 for obtaining array antennas 110A to 110I described in Embodiment 2 may be applied.

The present embodiment is otherwise similar to Embodiment 2.

Embodiment 4

Figure 41:
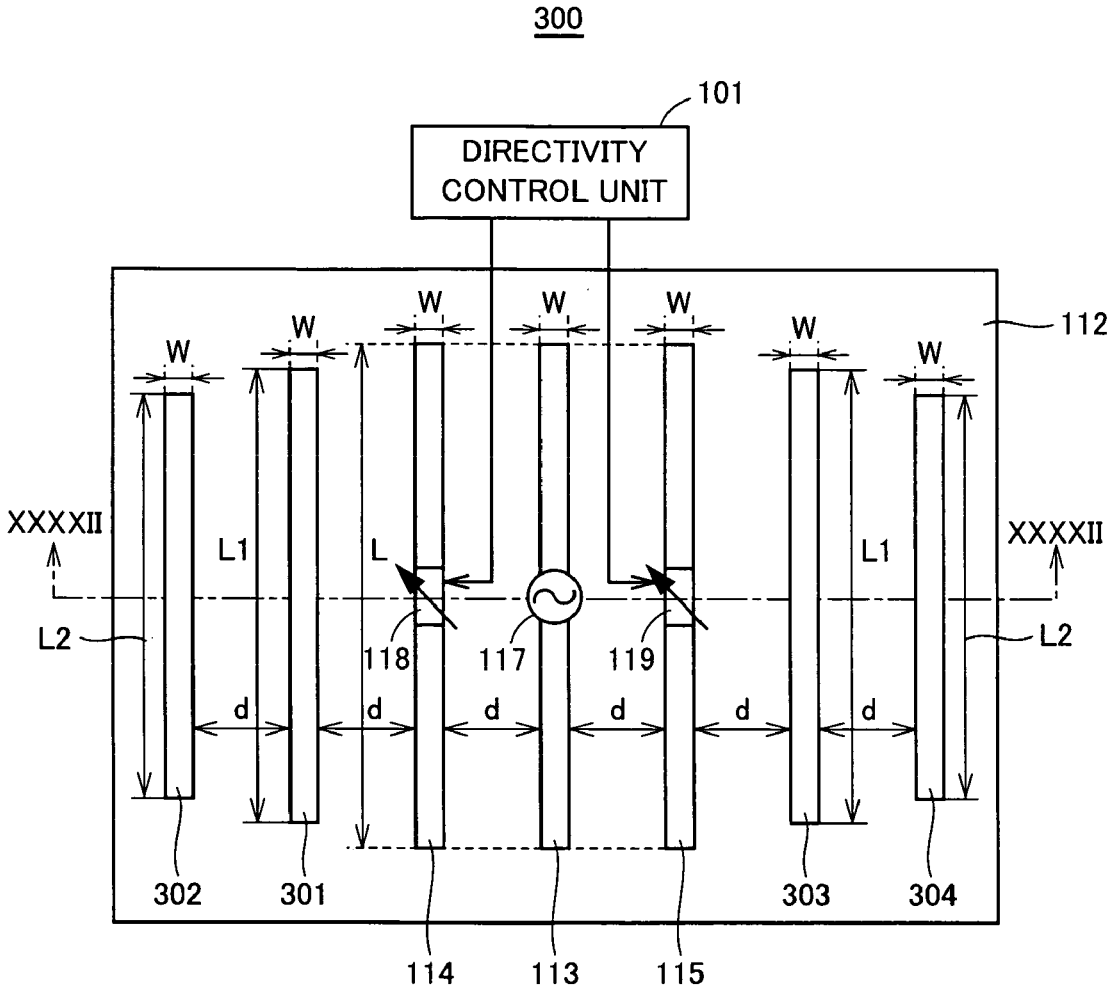
FIG. 41 is a plan view of an array antenna according to Embodiment 4.
Figure 42:
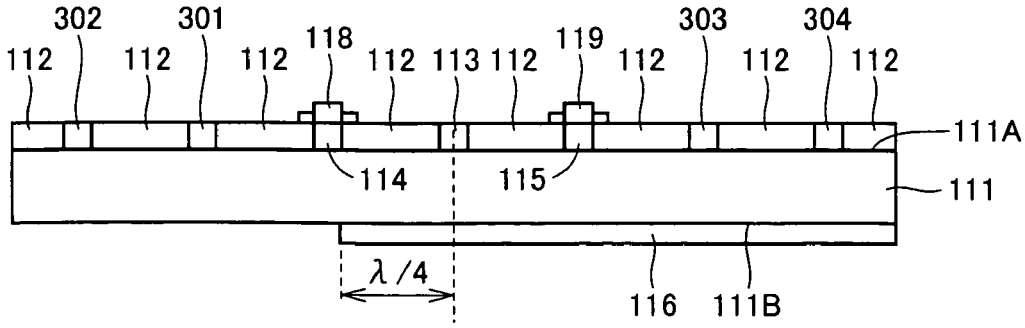
FIG. 42 is a cross-sectional view of the array antenna along the line XXXXII—XXXXII shown in FIG. 41.

FIG. 41 is a plan view of an array antenna according to Embodiment 4, while FIG. 42 is a cross-sectional view of the array antenna along the line XXXXII—XXXXII shown in FIG. 41.

An array antenna 300 according to Embodiment 4 is obtained by adding slot lines 301 to 304 to array antenna 110 shown in FIGS. 28 and 29, and array antenna 300 is otherwise the same as array antenna 110.

Slot lines 301 to 304 are provided in parallel to slot lines 113 to 115. Slot lines 301, 303 have a width W the same as that of slot lines 113 to 115, and has a length L1 smaller than length L of slot lines 113 to 115.

Slot lines 302, 304 have a width W the same as that of slot lines 113 to 115, and has a length L2 smaller than length L1 of slot lines 301, 303. In addition, an interval between slot line 301 and slot line 114, an interval between slot line 301 and slot line 302, an interval between slot line 303 and slot line 115, and an interval between slot line 303 and slot line 304 are set to interval d (=λ/4) as described above.

Slot lines 301 to 304 do not have varactor diodes loaded. That is, slot lines 301 to 304 do not have variable capacitance elements loaded. Slot lines 301 to 304 implement parasitic elements.

Therefore, in array antenna 300, a plurality of parasitic elements (slot lines 114, 301, 302) and a plurality of parasitic elements (slot lines 115, 303, 304) are arranged symmetrically around a feeder element (slot line 113).

In array antenna 300, slot lines 301 to 304 are designed as fixed directors, and achieve high gain based on a principle the same as that of Yagi-Uda array. Since some parasitic elements without having varactor diodes loaded (slot lines 301 to 304) are present in array antenna 300, lower cost can be achieved, as compared with an example in which all parasitic elements have varactor diodes loaded.

In array antenna 300, modification similar to modification applied to array antenna 110 for obtaining array antennas 110A to 110I described in Embodiment 2 may be applied.

The present embodiment is otherwise similar to Embodiment 2.

Figure 43A:
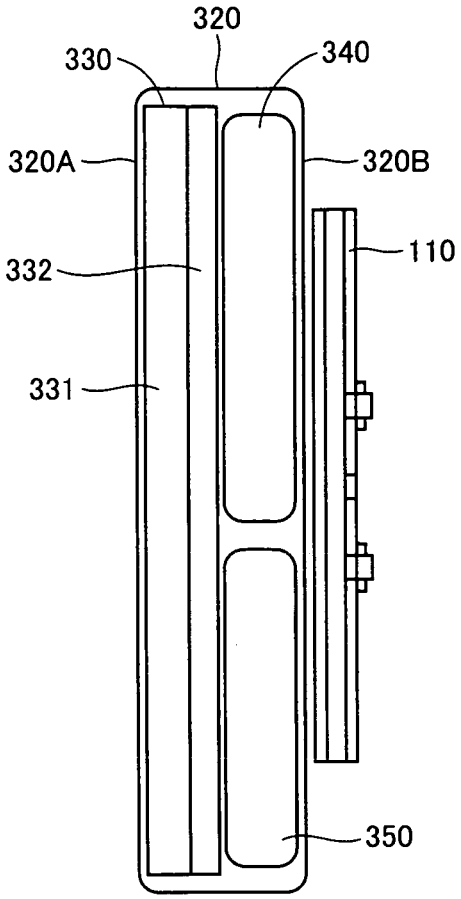
FIGS. 43A to 43C show specific arrangement examples of the array antenna from Embodiment 2 to Embodiment 4.
Figure 43B:
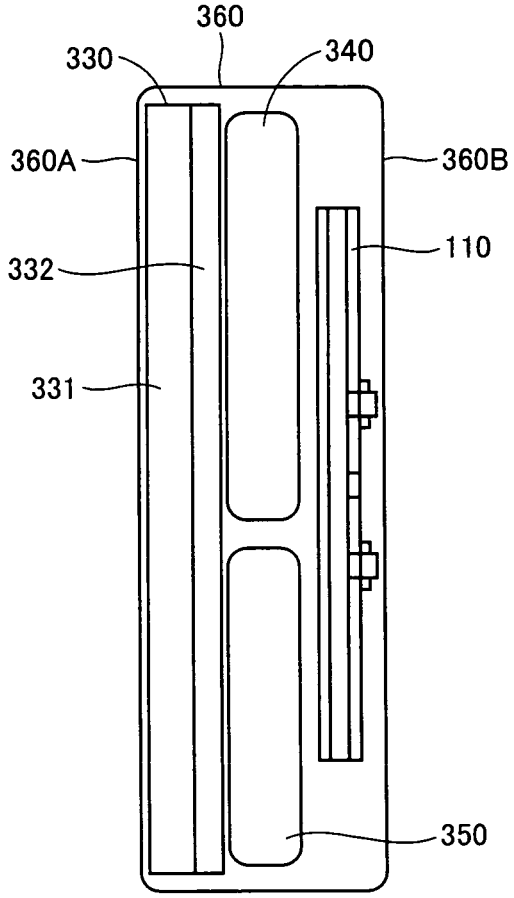
Figure 43C:
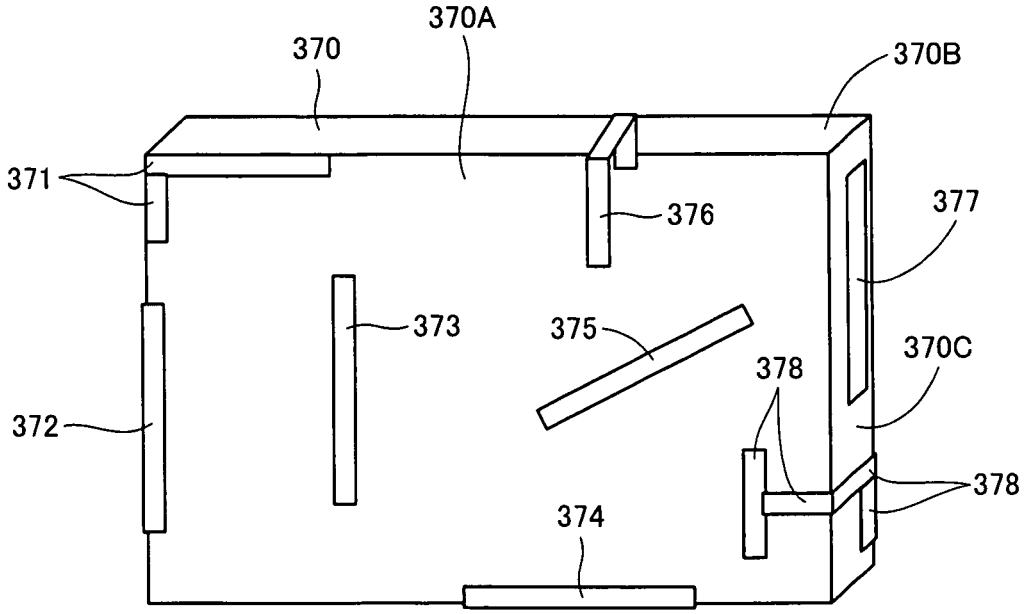

FIGS. 43A to 43C show specific arrangement examples of the array antenna from Embodiment 2 to Embodiment 4. A television 320 includes a liquid crystal display device 330, electronic parts 340, 350, and array antenna 110.

Liquid crystal display device 330 and electronic parts 340, 350 are contained in television 320. Liquid crystal display device 330 is constituted of a liquid crystal display screen 331 and metal 332, and arranged on a front 320A side of television 320. Electronic parts 340, 350 are arranged on a back surface side of metal 332 of liquid crystal display device 330.

As described above, as array antenna 110 emits a radio wave even when it is arranged in the vicinity of the metal, array antenna 110 is installed on a back surface 320B of television 320 (see FIG. 43A).

In addition, as shown in FIG. 43B, a television 360 contains liquid crystal display device 330, electronic parts 340, 350, and array antenna 110. Liquid crystal display device 330 is arranged on a front surface 360A of television 360, while array antenna 110 is arranged on a back surface of electronic parts 340, 350. That is, array antenna 110 is installed inside a back surface 360B of television 360.

In this manner, array antenna 110 is installed in the vicinity of metal 332 of liquid crystal display device 330 and the electronic parts of televisions 320, 360.

Moreover, in the present invention, as shown in FIG. 43C, slot lines 371 to 378 may be formed on a back surface 370A and on side surfaces 370B, 370C of a liquid crystal display device 370, so as to implement an array antenna. Here, slot line 376 extending over back surface 370A and side surface 370B also extends over a front surface.

As described above, the array antenna according to Embodiment 2 to Embodiment 4 includes a feeder element and a parasitic element; the feeder element and the parasitic element are implemented by slot lines; and directivity is controlled by varying a capacitance of a variable capacitance element loaded to the parasitic element. Therefore, the array antenna has directivity and can be arranged in the vicinity of the metal.

The array antenna according to Embodiment 2 to Embodiment 4 should be constituted of one feeder element implemented by a slot line and a parasitic element implemented by a slot line having a variable capacitance element loaded.

The slot line implementing the parasitic element may have a width and a length different from those of the slot line implementing the feeder element.

In addition, feeder unit 117 may be provided in a portion other than the central portion of slot line 113.

Moreover, reactance values Xa, Xb loaded in slot lines 114, 115 may continuously be switched, or alternatively, one value may be fixed while the other value is changed.

Furthermore, the number of slot lines implementing the parasitic elements and provided on opposing sides of the slot line implementing the feeder element may be different on those sides.

In addition, the slot line implementing the parasitic element may be arranged asymmetrically to the slot line implementing the feeder element.

Moreover, microstrip line 116 may be replaced with a coaxial line arranged in a manner electrically insulated from conductor 112 on one main surface 111A.

Embodiment 5

Figure 44:
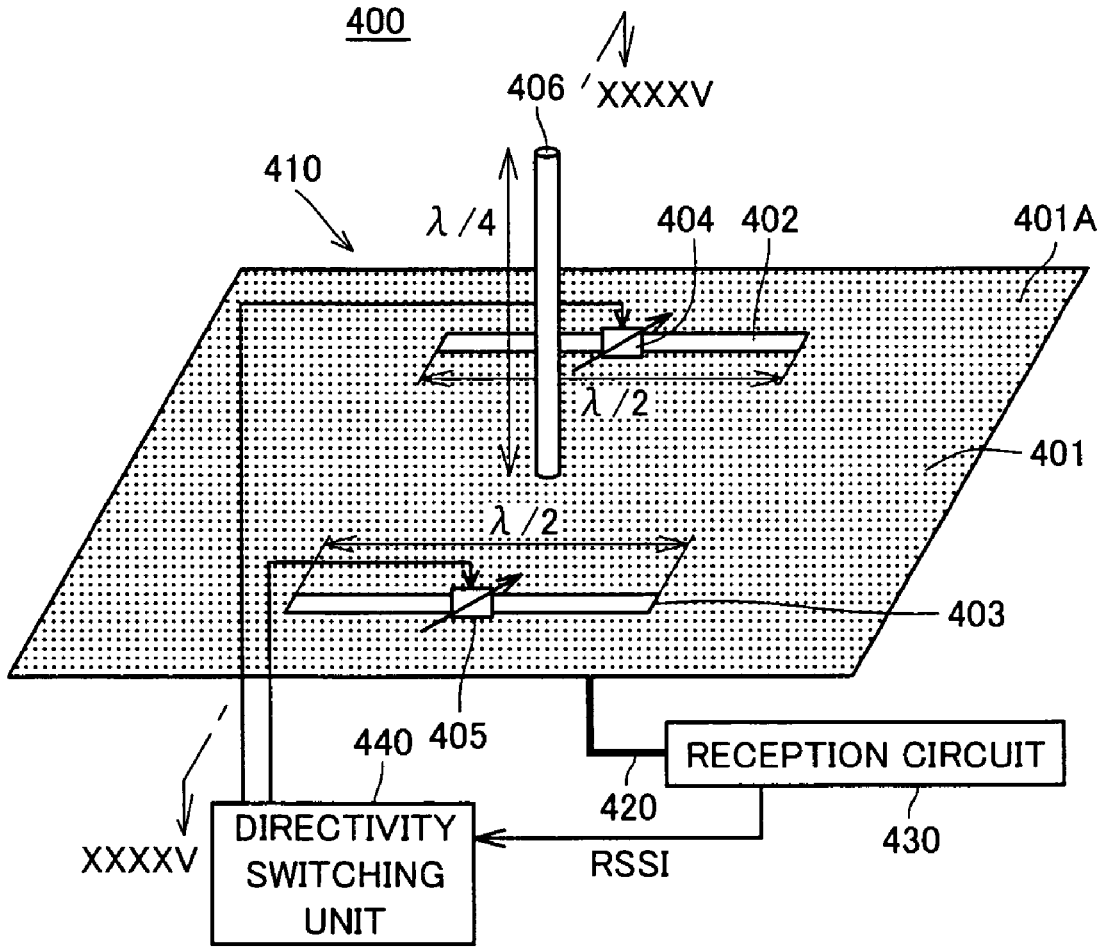
FIG. 44 is a schematic diagram of an array antenna according to Embodiment 5.

FIG. 44 is a schematic diagram of an array antenna according to Embodiment 5. Referring to FIG. 44, an array antenna 400 according to Embodiment 5 includes an element portion 410, a coaxial cable 420, a reception circuit 430, and a directivity switching unit 440.

Element portion 410 includes a dielectric substrate 401, slot lines 402, 403, varactor diodes 404, 405, and a feeder element 406. Slot lines 402, 403 are arranged substantially in parallel to each other on one main surface 401A of dielectric substrate 401. When a radio wave transmitted/received by array antenna 400 has a wavelength λ, slot lines 402, 403 have a length of λ/2.

Varactor diodes 404, 405 serve as variable capacitance elements to be loaded in slot lines 402, 403 respectively. Here, varactor diodes 404, 405 are loaded in central portions of slot lines 402, 403 in terms of a longitudinal direction thereof, respectively. Feeder element 406 has a length of λ/4, and has one end fixed to dielectric substrate 401. Feeder element 406 is provided in a position at an equal distance from both of slot lines 402, 403, between two slot lines 402, 403 arranged substantially in parallel.

Coaxial cable 420 connects one end of feeder element 406 to reception circuit 430. Reception circuit 430 receives a radio wave received by feeder element 406 through coaxial cable 420, and detects a strength RSSI of the received radio wave. Then, reception circuit 430 outputs detected strength RS SI to directivity switching unit 440. Reception circuit 430 carries out other general reception processings.

Directivity switching unit 440 supplies voltages Va, Vb respectively to varactor diodes 404, 405 loaded in slot lines 402, 403 respectively, so as to vary capacitances of varactor diodes 404, 405. When the capacitances of varactor diodes 404, 405 are varied, electrical lengths of slot lines 402, 403 are varied, thereby switching directivity of array antenna 400.

Therefore, by switching values of voltages Va, Vb supplied to varactor diodes 404, 405 respectively, directivity switching unit 440 can switch directivity of array antenna 400.

Specific methods with which directivity switching unit 440 switches the directivity of array antenna 400 are as follows:

(1) a set of voltages Va, Vb is switched between two sets [V1, V2] and [V2, V1];

(2) each value of voltages Va, Vb is switched continuously or in a stepwise manner; and (3) solely any one of voltages Va, Vb is switched continuously or in a stepwise manner.

Directivity switching unit 440 switches directivity of array antenna 400 with any one of the three methods described above, that is, by varying at least one capacitance of varactor diodes 404, 405 loaded in slot lines 402, 403. Here, directivity switching unit 440 receives radio wave strength RSSI from reception circuit 430, and switches directivity of array antenna 400 such that received strength RSSI attains a highest value.

Figure 45:
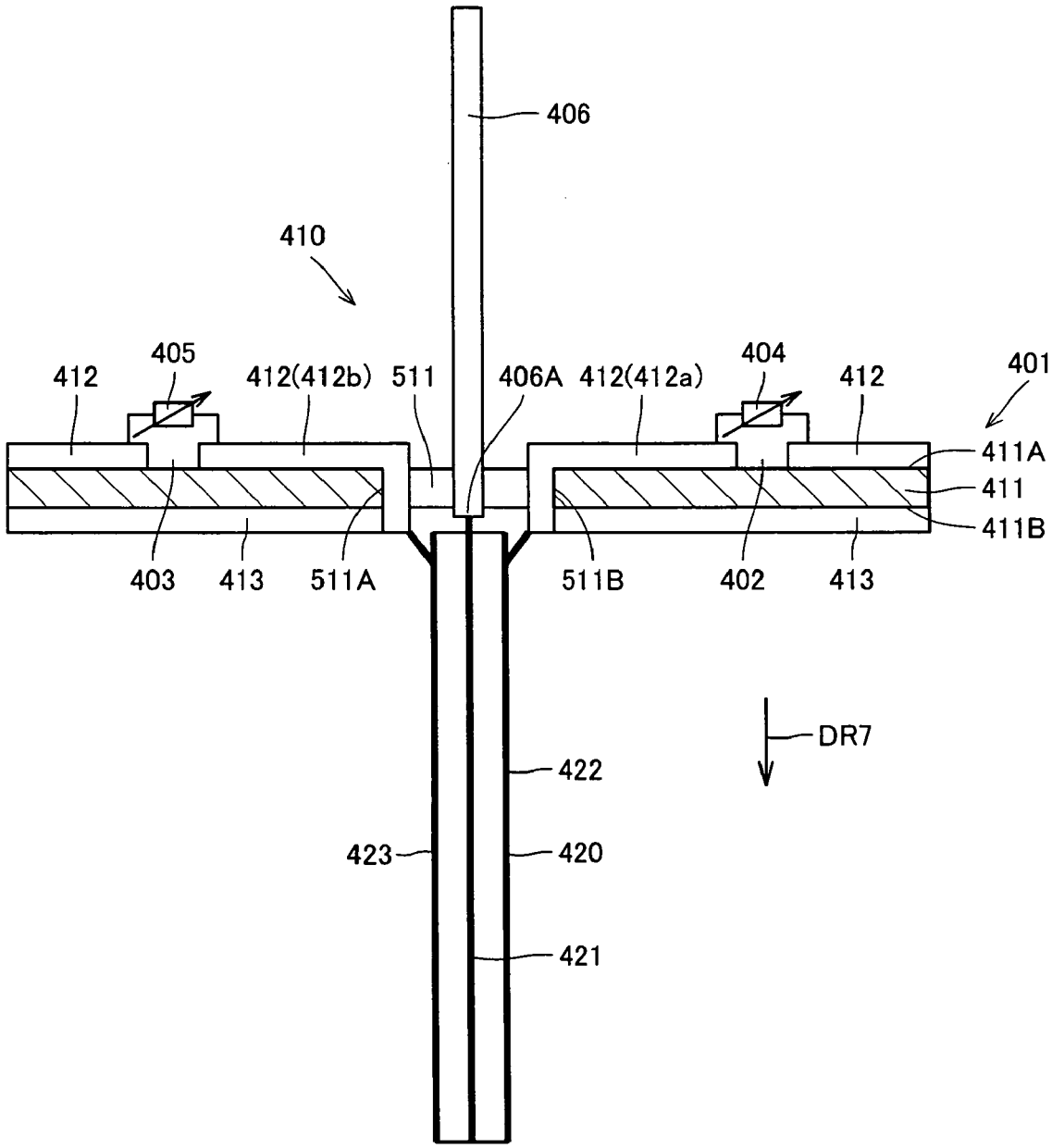
FIG. 45 is a cross-sectional view along the line XXXXV—XXXXV shown in FIG. 44.

FIG. 45 is a cross-sectional view along the line XXXXV—XXXXV shown in FIG. 44. Referring to FIG. 45, dielectric substrate 401 includes a dielectric 411 and conductors 412, 413. Conductor 412 is adhered to one main surface 411A of dielectric 411, and a portion thereof at which slot lines 402, 403 are to be formed is removed. In this manner, slot lines 402, 403 are formed on one main surface 411A of dielectric 411.

Varactor diodes 404, 405 are connected between conductors 412, 412 arranged on opposing sides of slot lines 402, 403 respectively.

Conductor 413 is adhered to a surface 411B opposite to one main surface 411A of dielectric 411. Conductor 413 is provided in order to prevent emission of a radio wave from slot lines 402, 403 to a downward direction DR7.

Dielectric 411 has a hole 511, and conductors 412*a*, 412*b* are formed also on walls 511A, 511B of hole 511. Conductors 412*a*, 412*b* are connected to outer conductors 422, 423 of coaxial cable 420.

Feeder element 406 has one end 406A inserted in hole 511 of dielectric 411 and connected to an inner conductor 421 of coaxial cable 420, whereby feeder element 406 has one end 406A fixed to dielectric substrate 401. Feeder element 406 is insulated from conductor 412 formed on one main surface 411A of dielectric 411.

Figure 46:
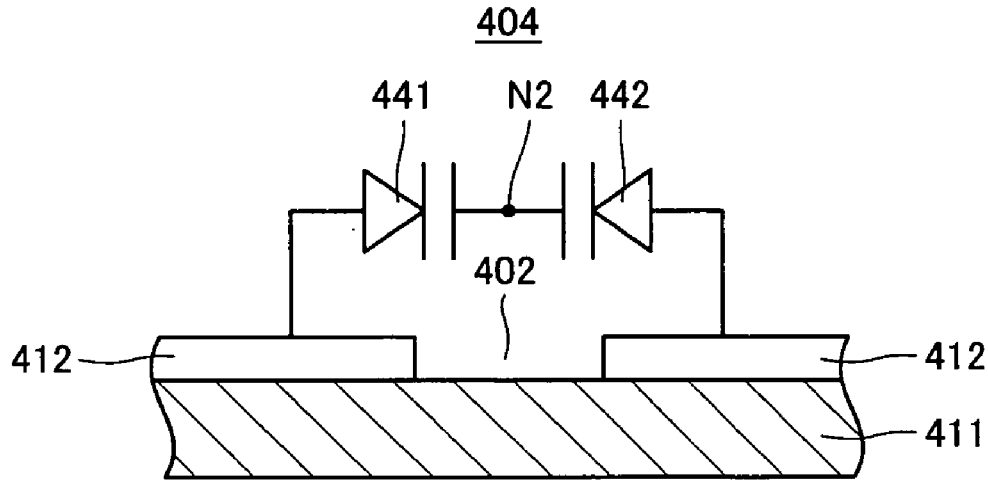
FIG. 46 is an enlarged view of the varactor diode shown in FIG. 45.

FIG. 46 is an enlarged view of varactor diode 404 shown in FIG. 45. Referring to FIG. 46, varactor diode 404 consists of a pair of varactor diodes 441, 442. Varactor diodes 441, 442 are connected between conductors 412, 412 arranged on opposing sides of slot line 402 in the anti-serial manner. Positive voltage Va is supplied from directivity switching unit 440 to a node N2 between varactor diode 441 and varactor diode 442, such that reverse bias is applied to each of varactor diodes 441, 442.

Figure 47:
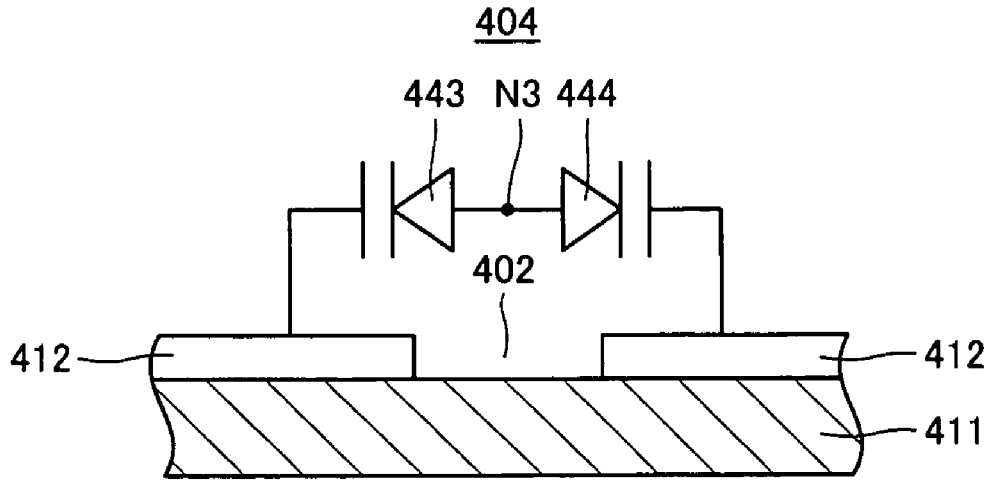
FIG. 47 is an enlarged view of a varactor diode having a different structure.

FIG. 47 is an enlarged view of varactor diode 404 having a different structure, in which negative voltage Va is supplied from directivity switching unit 440 to a node N3 such that reverse bias is applied to a pair of varactor diodes 443, 444.

As conductors 412, 412 arranged on opposing sides of slot line 402 are integrally formed on one main surface 411A of dielectric 411, equal voltage Va can be applied to two varactor diodes 441, 442 or two varactor diodes 443, 444 by supplying voltage Va to node N2 or N3.

Varactor diode 405 shown in FIG. 45 also consists of varactor diodes 441, 442 or varactor diodes 443, 444 shown in FIGS. 46 and 47. Here, positive voltage Vb is supplied to node N2, while negative voltage Vb is supplied to node N3.

Each of slot lines 402, 403 implements a "parasitic element". Array antenna 400 includes one feeder element and two parasitic elements (slot lines 402, 403), and two parasitic elements are formed along one main surface 401A of dielectric substrate 401. Therefore, array antenna 400 can be made compact.

In element portion 410, varactor diodes 404, 405 may be loaded in positions other than central portions of slot lines 402, 403.

Figure 48:
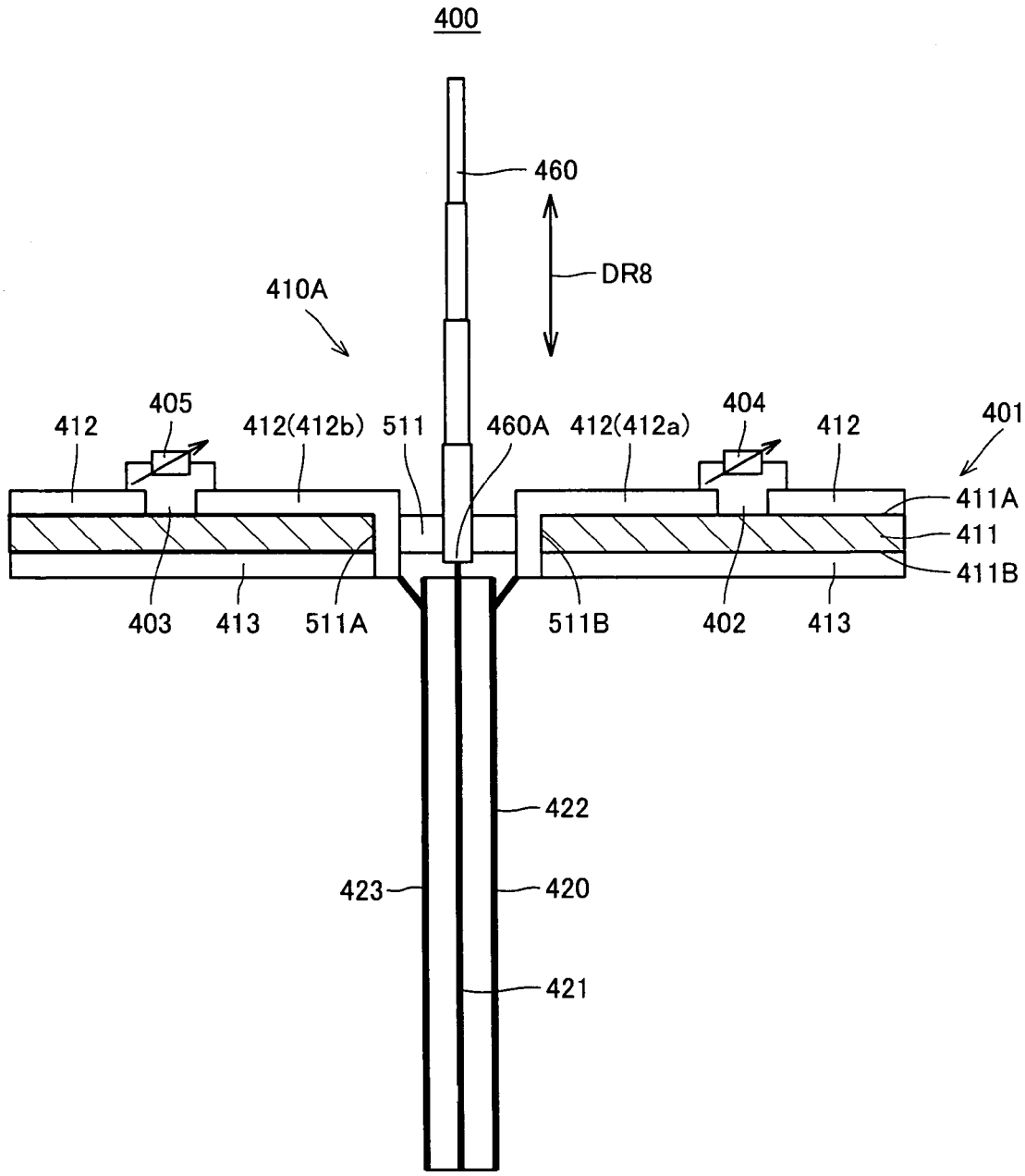
FIG. 48 is another cross-sectional view of an element portion.

FIG. 48 is another cross-sectional view of an element portion. Array antenna 400 may include an element portion 410A shown in FIG. 48, instead of element portion 410 shown in FIG. 45. Referring to FIG. 48, element portion 410A is obtained by replacing feeder element 406 in element portion 410 with a feeder element 460. Element portion 410A is otherwise the same as element portion 410.

Feeder element 460 has one end 460A inserted in hole 511 of dielectric 411 and connected to inner conductor 421 of coaxial cable 420, whereby feeder element 460 has one end 460A fixed to dielectric substrate 401 substantially perpendicular thereto. Feeder element 460 is retractable in an up-down direction DR8 (a direction perpendicular to dielectric substrate 401). When array antenna 400 is in use, feeder element 460 is extended, whereas it is contracted when array antenna 400 is not in use.

Therefore, while the array antenna is not in use, array antenna 400 can be made further compact by adopting element portion 410A, as compared with when element portion 410 shown in FIG. 45 is employed.

Figure 49:
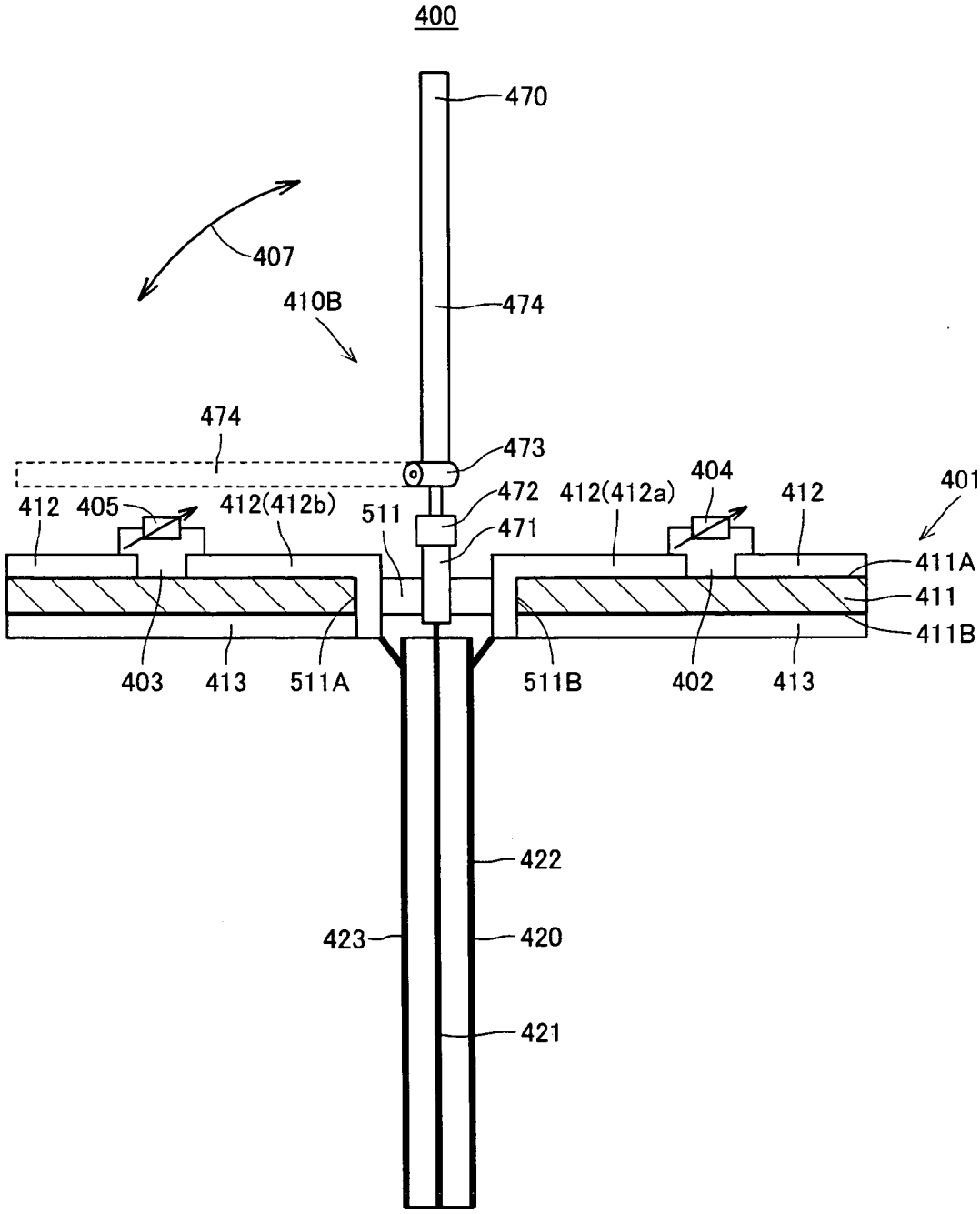
FIGS. 49 and 50 are further cross-sectional views of the element portion.

FIG. 49 is a further cross-sectional view of the element portion. Array antenna 400 may include an element portion 410B shown in FIG. 49, instead of element portion 410 shown in FIG. 45. Referring to FIG. 49, element portion 410B is obtained by replacing feeder element 406 in element portion 410 with a feeder element 470. Element portion 410B is otherwise the same as element portion 410.

Feeder element 470 includes a fixed portion 471, a pivot support portion 472, a tilt support portion 473, and a pole portion 474. Fixed portion 471 is inserted in hole 511 of dielectric 411 and connected to inner conductor 421 of coaxial cable 420, whereby feeder element 470 has one end (fixed portion 471) fixed to dielectric substrate 401 substantially perpendicular thereto.

Pivot support portion 472 is attached to an end of fixed portion 471 located on a side opposite to a portion connected to inner conductor 421 of coaxial cable 420, so as to allow pivot of tilt support portion 473 and pole portion 474 around a central axis of fixed portion 471. Tilt support portion 473 is connected to pivot support portion 472, so as to allow movement of pole portion 474 in a direction shown with an arrow 407 (around a central axis of tilt support portion 473). Pole portion 474 has one end attached to tilt support portion 473.

Pole portion 474 of feeder element 470 stands substantially perpendicular to one main surface 411A of dielectric 411 when array antenna 400 is in use, and it is tilted toward one main surface 411A of dielectric 411 when array antenna 400 is not in use (pole portion 474 shown with a dotted line).

Therefore, while the array antenna is not in use, array antenna 400 can be made further compact by adopting element portion 410B, as compared with when element portion 410 is employed.

In element portion 410B, pole portion 474 may be arranged at a prescribed angle with respect to a normal of one main surface 411A, without limited to a direction substantially perpendicular to one main surface 411A of dielectric 411. Pivot support portion 472 can freely allow pivot of pole portion 474 around the central axis of fixed portion 471, while tilt support portion 473 can allow movement of pole portion 474 in a direction shown with arrow 407. Therefore, pole portion 474 can be arranged at a prescribed angle with respect to the normal of one main surface 411A.

More specifically, pole portion 474 is arranged in such a direction that radio wave strength RSSI in reception circuit 430 becomes larger.

Figure 50:
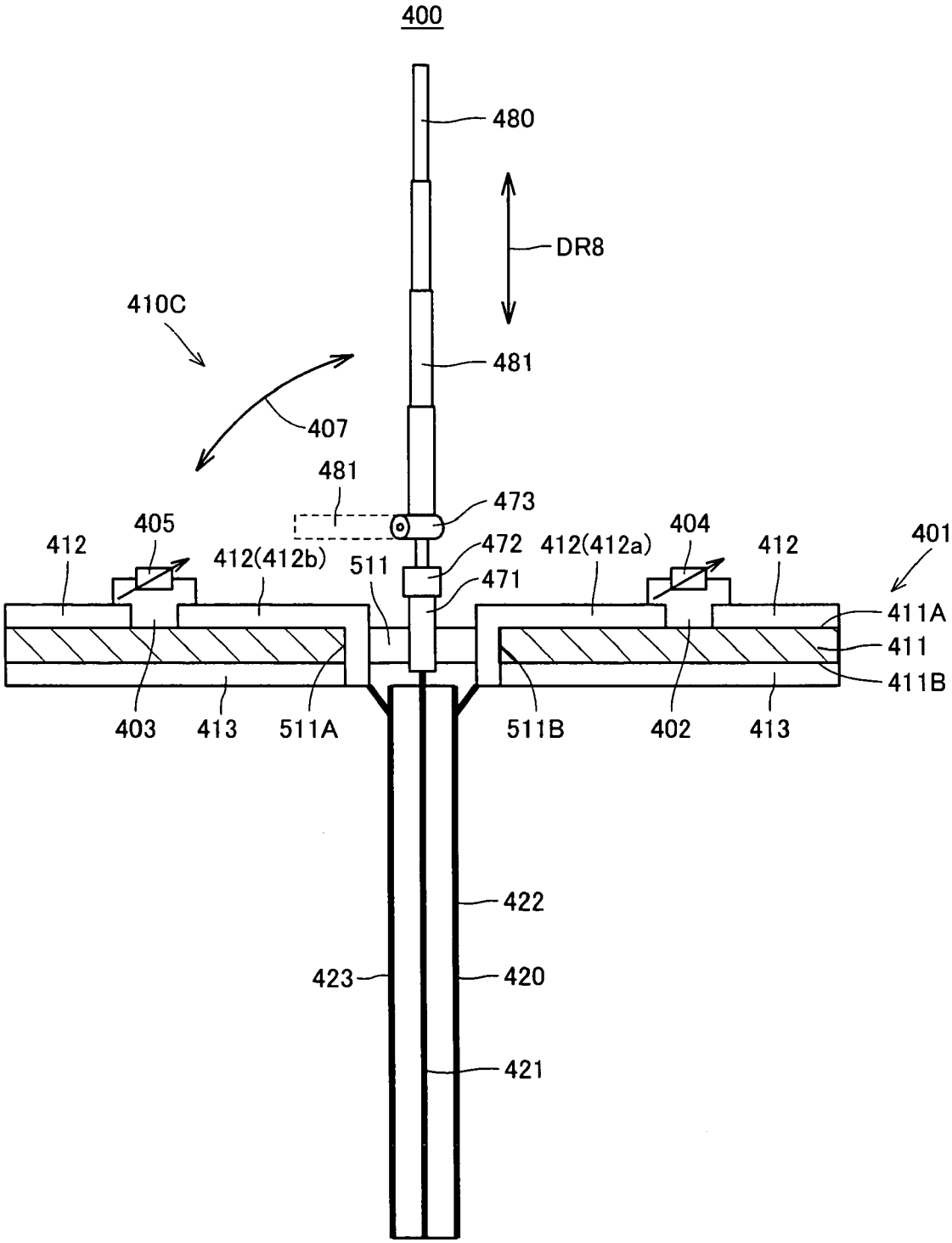

FIG. 50 is a further cross-sectional view of the element portion. Array antenna 400 may include an element portion 410C shown in FIG. 50 instead of element portion 410 shown in FIG. 45. Referring to FIG. 50, element portion 410C is obtained by replacing feeder element 406 in element portion 410 with a feeder element 480. Element portion 410C is otherwise the same as element portion 410.

Feeder element 480 is obtained by replacing pole portion 474 in feeder element 470 shown in FIG. 49 with a pole portion 481, and feeder element 480 is otherwise the same as feeder element 470. Pole portion 481 has one end attached to tilt support portion 473, and is retractable in up-down direction DR8 (a direction perpendicular to dielectric substrate 401). When array antenna 400 is in use, pole portion 481 is extended. On the other hand, when array antenna 400 is not in use, feeder element 480 is contracted and tilted toward one main surface 411A of dielectric 411 (pole portion 481 shown with a dotted line).

Therefore, while the array antenna is not in use, array antenna 400 can be made further compact by adopting element portion 410C, as compared with when element portion 410 is employed.

Element portion 410C is otherwise the same as element portion 470.

Figure 51:
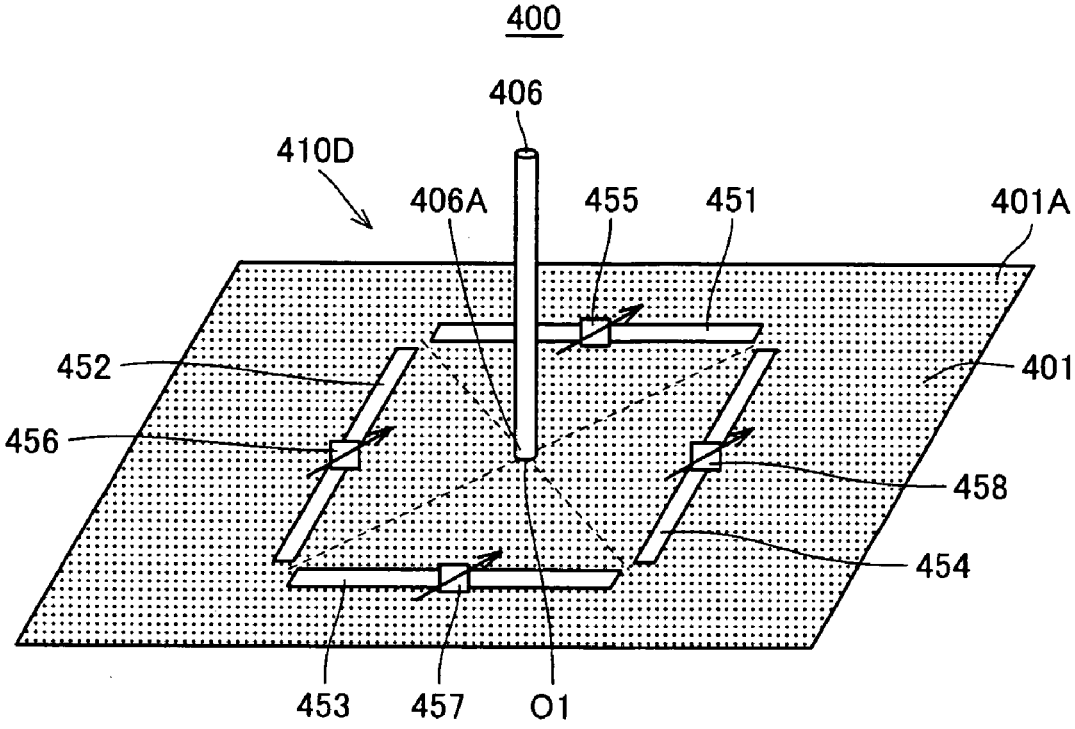
FIG. 51 is another perspective view of the element portion.

FIG. 51 is another perspective view of the element portion. Array antenna 400 may include an element portion 410D shown in FIG. 51 instead of element portion 410 shown in FIG. 45. Referring to FIG. 51, element portion 410D is obtained by replacing slot lines 402, 403 and varactor diodes 404, 405 in element portion 410 with slot lines 451 to 454 and varactor diodes 455 to 458. Element portion 410D is otherwise the same as element portion 410.

Slot lines 451 to 454 are formed on one main surface 401A of dielectric substrate 401 so as to substantially form a rectangle. Each of slot lines 451 to 454 has a length λ/2, which is the same as the length of slot lines 402, 403. In element portion 410D, feeder element 406 has one end 406A arranged at a center O1 (intersection of two diagonals) of the rectangle formed by slot lines 451 to 454. Therefore, slot lines 451 to 454 are arranged at an equal distance from feeder element 406.

Varactor diodes 455 to 458 are loaded in central portions of slot lines 451 to 454 in terms of a longitudinal direction thereof, respectively. Each of varactor diodes 455 to 458 consists of varactor diodes 441, 442 shown in FIG. 46 or varactor diodes 443, 444 shown in FIG. 47.

When element portion 410D is employed in array antenna 400, directivity switching unit 440 supplies voltages Va, Vb, Vc, and Vd to varactor diodes 455 to 458 respectively, so as to switch directivity of array antenna 400 with any one of the three methods described above.

In element portion 410D, any one of feeder element 460 shown in FIG. 48, feeder element 470 shown in FIG. 49, and feeder element 480 shown in FIG. 50 may be employed instead of feeder element 406.

In addition, each of slot lines 451 to 454 implements a "parasitic element".

Moreover, varactor diodes 455 to 458 may be loaded in positions other than central portions of slot lines 451 to 454.

Figure 52:
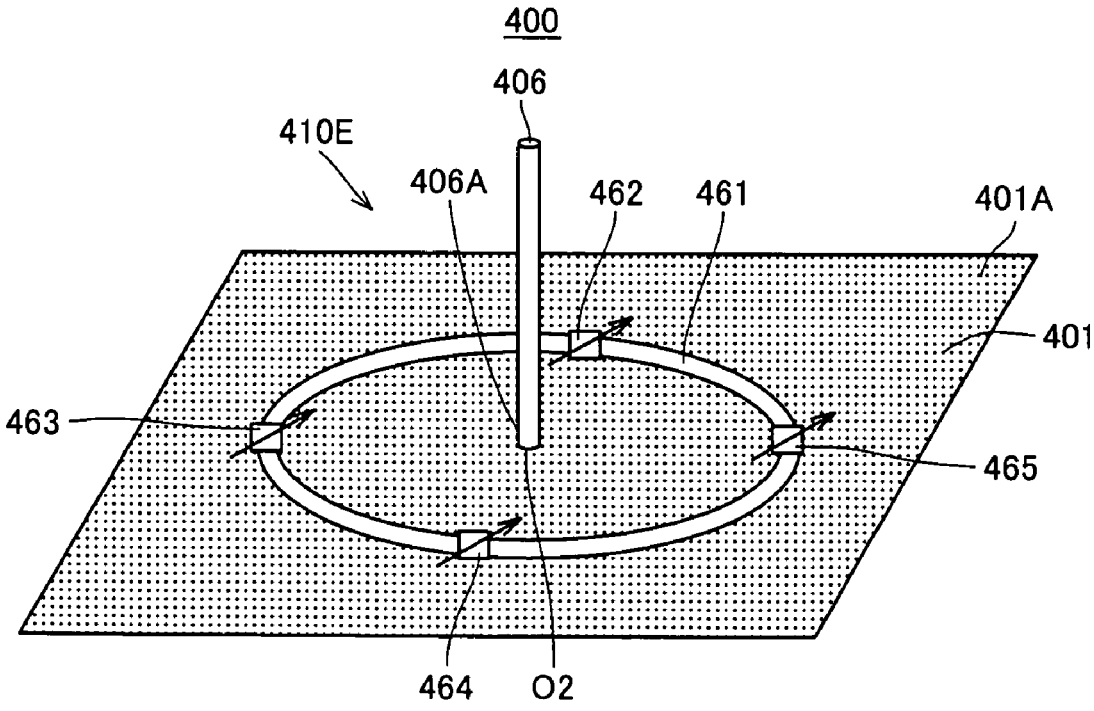
FIG. 52 is yet another perspective view of the element portion.

FIG. 52 is yet another perspective view of the element portion. Array antenna 400 may include an element portion 410E shown in FIG. 52 instead of element portion 410 shown in FIG. 45. Referring to FIG. 52, element portion 410E is obtained by replacing slot lines 402, 403 and varactor diodes 404, 405 in element portion 410 with slot line 461 and varactor diodes 462 to 465. Element portion 410E is otherwise the same as element portion 410.

Slot line 461 has an annular shape and slot line 461 is formed on one main surface 401A of dielectric substrate 401. Varactor diodes 462 to 465 are loaded in slot line 461. Here, varactor diodes 462 to 465 may be arranged on slot line 461 at regular intervals or at any interval. In element portion 410E, feeder element 406 has one end 406A arranged at a center O2 of slot line 461. Each of varactor diodes 462 to 465 consists of varactor diodes 441, 442 shown in FIG. 46 or varactor diodes 443, 444 shown in FIG. 47.

When element portion 410E is employed in array antenna 400, directivity switching unit 440 supplies voltages Va, Vb, Vc, and Vd to varactor diodes 462 to 465 respectively, so as to switch directivity of array antenna 400 with any one of the three methods described above.

In element portion 410E, at least one varactor diode should be loaded.

In addition, in element portion 410E, a radius of slot line 61 may be set to any value.

Moreover, in element portion 410E, slots may be provided concentrically.

Furthermore, in element portion 410E, any one of feeder element 460 shown in FIG. 48, feeder element 470 shown in FIG. 49, and feeder element 480 shown in FIG. 50 may be employed instead of feeder element 406.

Figure 53:
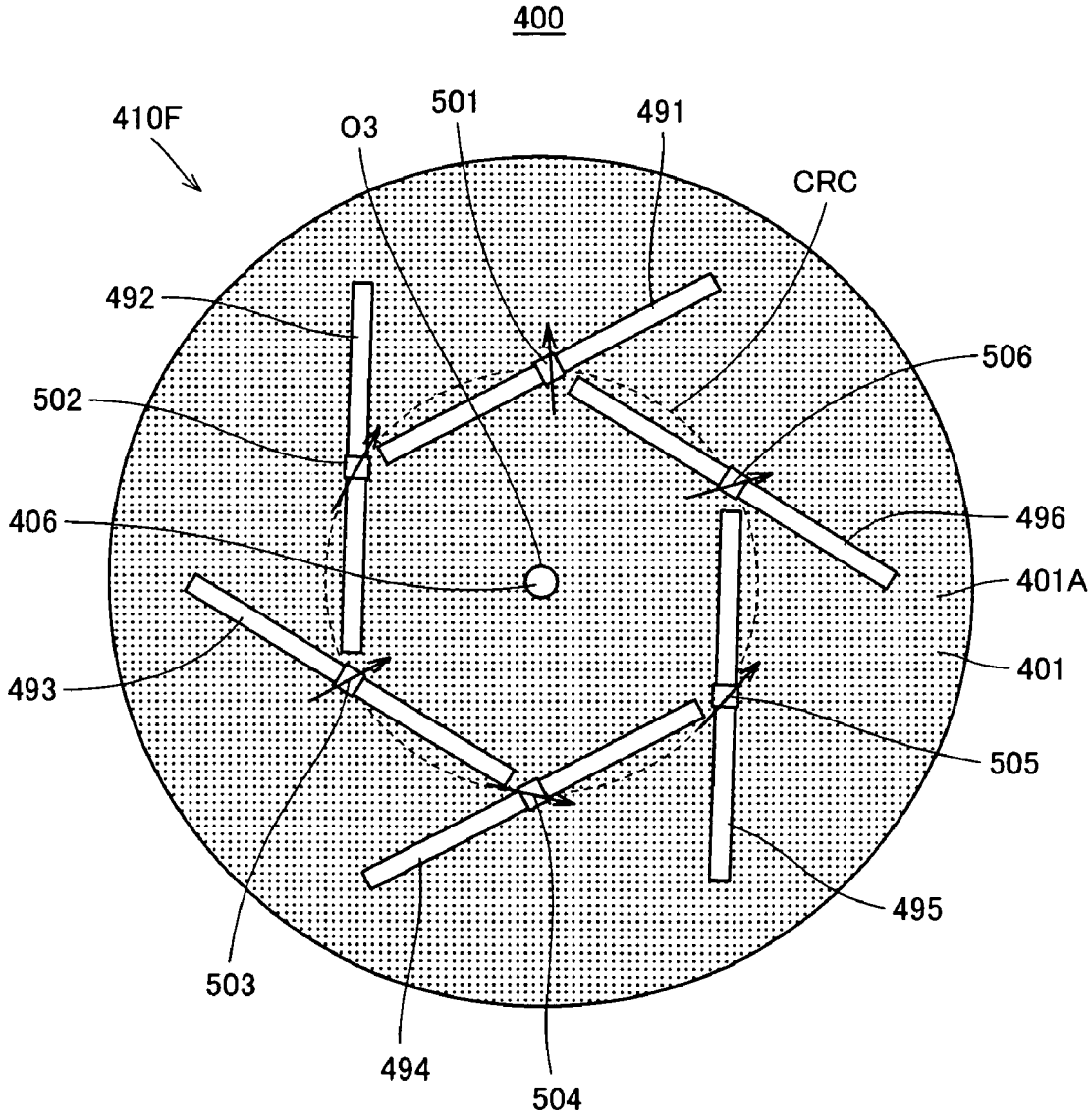
FIG. 53 is a plan view showing a further element portion.

FIG. 53 is a plan view showing a further element portion. Array antenna 400 may include an element portion 410F shown in FIG. 53 instead of element portion 410 shown in FIG. 45. Referring to FIG. 53, element portion 410F is obtained by replacing slot lines 402, 403 and varactor diodes 404, 405 in element portion 410 with slot lines 491 to 496 and varactor diodes 501 to 506 respectively. Element portion 410F is otherwise the same as element portion 410. In element portion 410F, dielectric substrate 401 has an annular shape.

Each of slot lines 491 to 496 has a length λ/2, which is the same as the length of slot lines 402, 403. Slot lines 491 to 496 are formed on one main surface 401A of dielectric substrate 401 so as to form an equilateral hexagon, using half the length of the slot line (=λ/4). Here, slot lines 491 to 496 are arranged such that two adjacent slot lines form an angle of 60° on one main surface 401A.

Feeder element 406 is arranged at a center O3 of the equilateral hexagon formed by slot lines 491 to 496. Varactor diodes 501 to 506 are loaded in central portions of slot lines 491 to 496 in terms of a longitudinal direction thereof respectively. Then, varactor diodes 501 to 506 are located on a circle CRC around feeder element 406. Each of varactor diodes 501 to 506 consists of varactor diodes 441, 442 shown in FIG. 46 or varactor diodes 443, 444 shown in FIG. 47.

When element portion 410F is employed in array antenna 400, directivity switching unit 440 supplies voltages Va, Vb, Vc, Vd, Ve, and Vf to varactor diodes 501 to 506 respectively, so as to switch directivity of array antenna 400 with any one of the three methods described above.

In addition, in element portion 410F, each of varactor diodes 501 to 506 may be loaded in a position other than the central portion of the slot.

Furthermore, in element portion 410F, any one of feeder element 460 shown in FIG. 48, feeder element 470 shown in FIG. 49, and feeder element 480 shown in FIG. 50 may be employed instead of feeder element 406.

In array antenna 400 including element portions 410, 410A, 410B, 410C, 410D, 410E, and 410F described above, feeder elements 406, 460, 470, and 480 are arranged substantially perpendicular to a plane where slot lines 402, 403 (or 451 to 454; 461; 491 to 496) are arranged or at a prescribed angle with respect to a normal of a plane where slot lines 402, 403 (or 451 to 454; 461; 491 to 496) are arranged. Therefore, array antenna 400 can be made compact, as compared with an example in which the feeder element and the parasitic element are arranged substantially perpendicular to the dielectric substrate. Coupling between feeder elements 406, 460, 470, and 480 and slot lines 402, 403 (or 451 to 454; 461; 491 to 496) can be strengthened, as compared with an example in which the feeder element and the parasitic element are arranged in one plane.

Though it has been described that element portions 410, 410A, 410B, 410C, 410D, and 410F include two or more slot lines, the present invention is not limited to such examples. Element portions 410, 410A, 410B, 410C, 410D, and 410F should only include at least one slot line. That is, the array antenna according to Embodiment 5 should include at least one slot line (that is, parasitic element).

Figure 54A:
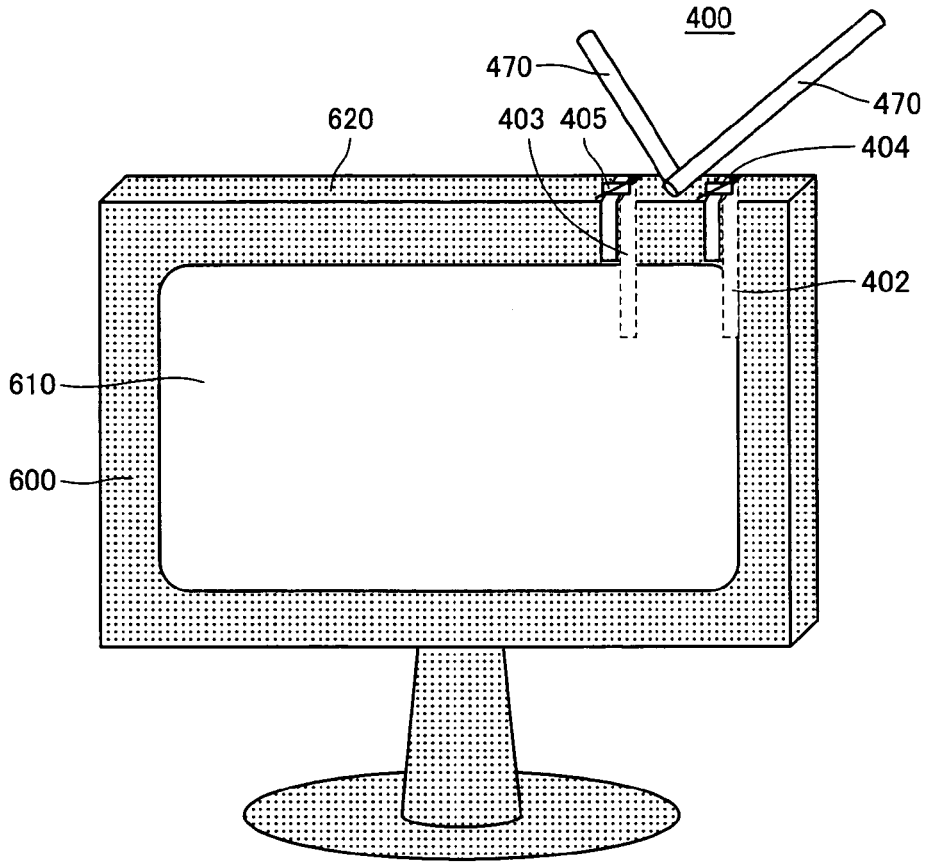
FIGS. 54A and 54B are schematic diagrams showing an installation example of the array antenna according to Embodiment 5.
Figure 54B:
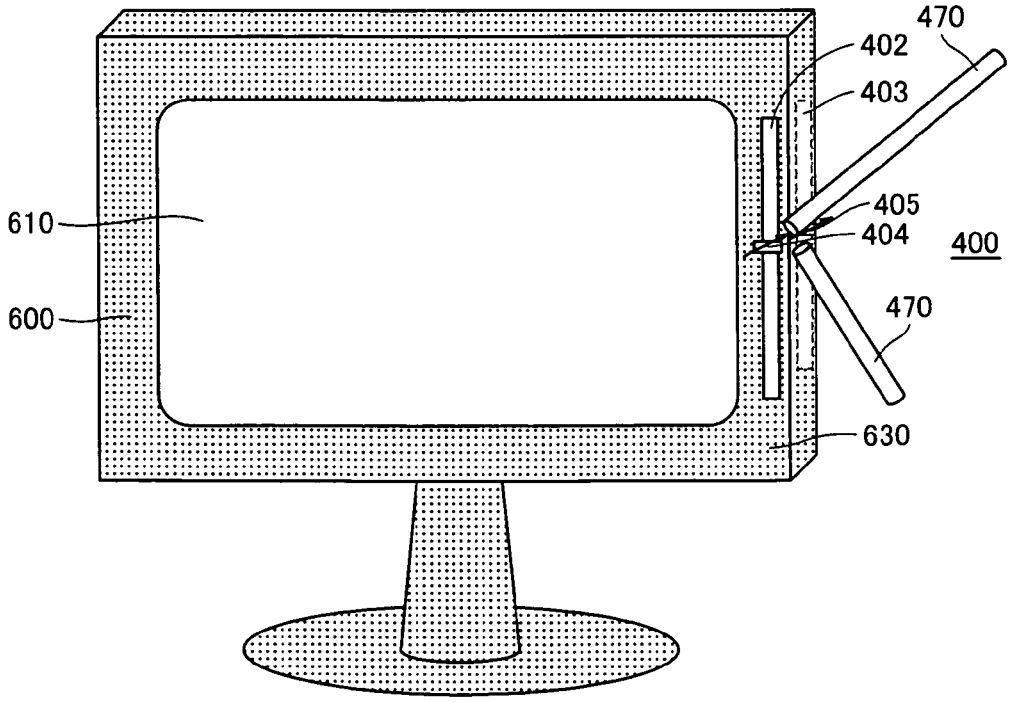

FIGS. 54A and 54B are schematic diagrams showing an installation example of array antenna 400 according to Embodiment 5. FIGS. 54A and 54B show an example in which array antenna 400 including element portion 410B shown in FIG. 49 is installed in a slim-type television 600.

Referring to FIG. 54A, antenna 400 is installed in slim-type television 600. Array antenna 400 is installed, for example, in a housing 620 on an upper side of a screen 610. Here, slot lines 402, 403 are formed over a front surface, an upper surface and a back surface of housing 620 in slim-type television 600, while varactor diodes 404, 405 are loaded in slot lines 402, 403 on the upper surface of housing 620 respectively. Feeder element 470 is also provided on the upper surface of housing 620. Feeder element 470 can manually be moved.

In addition, as shown in FIG. 54B, array antenna 400 according to Embodiment 5 is installed in a housing 630 on a side of screen 610. Here, slot line 402 is formed on the front surface of housing 630 in slim-type television 600, while slot line 403 is formed on the side surface of housing 630. Varactor diode 404 is loaded in slot line 402 on the front surface of slim-type television 600, while varactor diode 405 is loaded in slot line 403 on the side surface of housing 630. Feeder element 470 is also provided on the side surface of housing 630. Feeder element 470 can manually be moved.

It is noted that any of element portions 410, 410A, 410C, 410D, 410E, and 410F described above may be installed in slim-type television 600.

In addition, in dielectric substrate 401, a plurality of through holes may be provided in dielectric 411 around each of slot lines 402, 403, 451 to 454, 461, and 491 to 496 so as to connect conductor 412 to conductor 413. In this manner, propagation of a radio wave through dielectric 411 located between conductor 412 and conductor 413 can be suppressed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An array antenna allowing electrical switching of directivity, comprising:

a feeder element;

a parasitic element having a variable capacitance element loaded, and implemented by a slot line; and a directivity switching unit varying a capacitance of said variable capacitance element and switching said directivity.

2. The array antenna according to claim 1, further comprising a cavity conductor attaining a function as a resonator or a waveguide, wherein said feeder element is provided inside said cavity conductor, said parasitic element is implemented by a plurality of slot lines having at least one variable capacitance element loaded, and provided on a surface of said cavity conductor, and said directivity switching unit varies a capacitance of said at least one variable capacitance element.

3. The array antenna according to claim 2, wherein said cavity conductor has a substantially cylindrical shape, and said plurality of slot lines are provided substantially in parallel to one another on an outer circumferential surface of said cavity conductor.

4. The array antenna according to claim 3, wherein said feeder element has a spiral shape or a bar shape formed in a direction of a rotation axis of said cylindrical shape.

5. The array antenna according to claim 3, wherein said feeder element includes a first feeder element provided in a direction of the rotation axis of said cylindrical shape, and at least one second feeder element provided in a radial direction of said cylindrical shape.

6. The array antenna according to claim 2, wherein said cavity conductor has a substantially cylindrical shape, and said plurality of slot lines are arranged substantially in parallel to one another or substantially radially around the rotation axis of said cylindrical shape on at least one of two cylinder end surfaces provided perpendicular to said rotation axis in the direction of the rotation axis of said cylindrical shape.

7. The array antenna according to claim 6, wherein said feeder element has a spiral shape or a bar shape formed in a direction of a rotation axis of said cylindrical shape.

8. The array antenna according to claim 6, wherein said feeder element includes a first feeder element provided in a direction of the rotation axis of said cylindrical shape, and at least one second feeder element provided in a radial direction of said cylindrical shape.

9. The array antenna according to claim 1, wherein said parasitic element is implemented by at least one slot line having a variable capacitance element loaded, and provided on one main surface of a substrate member, said feeder element has one end provided in said substrate member at a prescribed angle with respect to a normal direction of said one main surface, and said directivity switching unit varies at least one capacitance of said variable capacitance element so as to switch said directivity.

10. The array antenna according to claim 9, wherein said feeder element has said one end fixed to said substrate member.

11. The array antenna according to claim 10, wherein said feeder element is retractable in its longitudinal direction.

12. The array antenna according to claim 9, wherein said feeder element can pivot around said one end.

13. The array antenna according to claim 9, wherein said feeder element can pivot around said one end and is retractable in its longitudinal direction.

14. The array antenna according to claim 1, wherein said feeder element is implemented by a first slot line formed on one main surface of a dielectric substrate, and said parasitic element is implemented by a second slot line formed on one main surface of said dielectric substrate and having said variable capacitance element loaded.

15. The array antenna according to claim 14, wherein said first and second slot lines are arranged substantially in parallel to each other.

16. The array antenna according to claim 14, wherein said first and second slot lines are arranged at a prescribed angle with respect to each other.

17. The array antenna according to claim 14, wherein said parasitic element is implemented by a plurality of parasitic elements, and said directivity switching unit varies at least one capacitance of a plurality of variable capacitance elements loaded in said plurality of parasitic elements, so as to control said directivity.

18. The array antenna according to claim 17, wherein an equal number of said plurality of parasitic elements are arranged on opposing sides of said feeder element, respectively.

19. The array antenna according to claim 17, wherein said plurality of parasitic elements are arranged symmetrically around said feeder element.

20. The array antenna according to claim 14, further comprising another parasitic element implemented by a third slot line formed on one main surface of said dielectric substrate without having a variable capacitance element loaded.

* * * * *